US008481895B2

(12) United States Patent
Taylor et al.

(10) Patent No.: US 8,481,895 B2
(45) Date of Patent: Jul. 9, 2013

(54) PORTABLE WARMING DEVICE AND METHOD FOR WARMING AN ARTICLE

(75) Inventors: Curtis Taylor, Chagrin Falls, OH (US); Douglas E. Whitner, Chagrin Falls, OH (US); Marc Louis Vitantonio, South Russell, OH (US)

(73) Assignee: HeatWave, Cleveland, OH (US)

( * ) Notice: Subject to any disclaimer, the term of this patent is extended or adjusted under 35 U.S.C. 154(b) by 1597 days.

(21) Appl. No.: 11/410,764

(22) Filed: Apr. 25, 2006

(65) Prior Publication Data

US 2006/0191901 A1 Aug. 31, 2006

Related U.S. Application Data

(63) Continuation-in-part of application No. 11/020,183, filed on Dec. 27, 2004, now abandoned, and a continuation-in-part of application No. 11/020,231, filed on Dec. 27, 2004, now abandoned.

(51) Int. Cl.
*H05B 3/06* (2006.01)

(52) U.S. Cl.
USPC ..... 219/521; 219/544; 219/535; 219/394; 219/385; 219/492

(58) Field of Classification Search
USPC .. 219/521, 544, 535, 394, 385, 492; 392/403, 392/390
See application file for complete search history.

(56) References Cited

U.S. PATENT DOCUMENTS

| | | | | |
|---|---|---|---|---|
| 1,914,190 | A | 6/1933 | Herr | |
| 3,138,699 | A | 6/1964 | Taylor | |
| 3,626,152 | A | 12/1971 | Governale | |
| 3,839,622 | A | 10/1974 | Mastin | |
| 3,849,629 | A | 11/1974 | Graham, Jr. | |
| 4,084,080 | A | 4/1978 | McMahan | |
| 4,117,309 | A | 9/1978 | Cayley | |
| 4,559,442 | A | 12/1985 | Graham | |
| 4,644,136 | A | 2/1987 | Watchman | |
| 4,684,787 | A | 8/1987 | Bunting | |
| 4,694,146 | A | 9/1987 | DeMars | |
| 4,694,973 | A * | 9/1987 | Rose et al. | 221/46 |
| 4,700,048 | A | 10/1987 | Levy | |
| RE32,616 | E | 3/1988 | Graham | |
| 4,760,243 | A | 7/1988 | Tedioli | |
| 4,794,228 | A * | 12/1988 | Braun, Jr. | 219/415 |
| 4,837,421 | A | 6/1989 | Luthy | |
| 4,849,610 | A | 7/1989 | Alvarez | |
| 4,918,290 | A | 4/1990 | DeMars | |
| 4,927,995 | A | 5/1990 | Lovett et al. | |
| 5,014,446 | A | 5/1991 | Reesman | |
| 5,210,396 | A | 5/1993 | Sanders | |
| 5,231,266 | A | 7/1993 | Warren | |
| 5,341,992 | A | 8/1994 | Bishopp | |
| 5,397,875 | A | 3/1995 | Bechtold, Jr. | |

(Continued)

FOREIGN PATENT DOCUMENTS

WO WO 03053101 A1 * 6/2003

*Primary Examiner* — Brian Jennison
(74) *Attorney, Agent, or Firm* — Fay Sharpe LLP

(57) ABSTRACT

A portable warming device for dry heating a towel. The portable warming device includes a heating arrangement that heats one or more surface of the portable warming device so as to heat a towel that is in contact with the one or more heated surfaces. The heating arrangement includes a controller to at least partially control the heating of the towel.

51 Claims, 23 Drawing Sheets

U.S. PATENT DOCUMENTS

| | | | |
|---|---|---|---|
| 5,408,576 | A | 4/1995 | Bishop |
| 5,569,403 | A | 10/1996 | Swanson |
| 5,606,640 | A | 2/1997 | Murphy |
| 5,642,462 | A | 6/1997 | Huff |
| 5,736,714 | A | 4/1998 | Bechtold |
| 5,842,287 | A | 12/1998 | Murphy |
| 5,981,923 | A | 11/1999 | Jackson |
| 6,005,227 | A | 12/1999 | Pappas |
| 6,018,145 | A | 1/2000 | Moreno |
| 6,046,436 | A | 4/2000 | Hunts |
| 6,080,974 | A | 6/2000 | Ambrosiano |
| 6,085,026 | A | 7/2000 | Hammons et al. |
| 6,153,862 | A | 11/2000 | Job |
| 6,154,607 | A | 11/2000 | Flashinski et al. |
| 6,189,230 | B1 | 2/2001 | Huen |
| 6,341,554 | B2 | 1/2002 | Thiriat |
| 6,431,360 | B1 | 8/2002 | Julius |
| 6,525,298 | B1 | 2/2003 | Hunts |
| 6,551,560 | B1 | 4/2003 | Flashinski et al. |
| 6,555,789 | B2 | 4/2003 | Owens et al. |
| 6,604,942 | B2 | 8/2003 | Sharp |
| 6,627,857 | B1 | 9/2003 | Tanner |
| 6,649,877 | B1 | 11/2003 | Mauffrey et al. |
| 6,667,464 | B2 | 12/2003 | Ellis |
| 6,693,260 | B1 | 2/2004 | Rodrigues |
| 6,774,343 | B2 | 8/2004 | Ibanez |
| 6,830,456 | B2 | 12/2004 | Obermeyer |
| 6,855,915 | B2 | 2/2005 | Gehring |
| 6,917,753 | B2 | 7/2005 | Cooper |
| 6,935,279 | B2 | 8/2005 | Bosworth |
| 6,982,399 | B1 | 1/2006 | Hunts |
| 7,191,546 | B2 * | 3/2007 | Maruca ..... 34/201 |
| 2003/0015513 | A1 | 1/2003 | Ellis |
| 2004/0190882 | A1 | 9/2004 | Cooper |
| 2004/0245234 | A1 | 12/2004 | Gehring |
| 2005/0121435 | A1 | 6/2005 | Hofer-Noser et al. |

* cited by examiner

PORTABLE WARMING DEVICE AND METHOD FOR WARMING AN ARTICLE

The present invention is a continuation-in part of U.S. patent application Ser. Nos. 11/020,183 filed Dec. 27, 2004 now abandoned and 11/020,231 filed Dec. 27, 2004, now abandoned both of which are incorporated herein by reference.

FIELD OF THE INVENTION

The present invention is directed to a warming device and methods for warming an article, and more particularly to a portable warming device and method for warming one or more textile materials, and still even more particularly to a portable warming device and method for warming one or more towels.

BACKGROUND OF THE INVENTION

Towels and similar articles are frequently employed by individuals for a variety of purposes, most notably including removing water from the surface of an individual's body following, for example, showering, bathing, swimming, using a hot tub, or other bodily contact with water. Individuals that take a shower, bathe in a tub, etc. generally used a towel to dry off. The towel is generally located on a wall mounted towel rack or on some other location in close proximity to the shower, tub, etc.

An unpleasant or undesirable complication associated with bathing and/or relaxing in a shower, tub, etc. is that once the individual exits the shower, tub etc., the individual is exposed to a colder ambient environment due to the disparity between the ambient temperature of a bathroom, tub room, etc. and the temperature of the water used for showering, bathing, soaking etc. For instance, an individual typically takes a shower at a water temperature that is higher than normal body temperature (e.g., 98.2° F.) so that the water feels warm to the skin. The ambient temperature of the bathroom is typically about 60-80° F. As such, when the individual exits the shower stall, the skin of the individual is immediately exposed to a significant temperature drop, which can be uncomfortable for many individuals. The water on the skin surface also acts as a good heat conductor, thereby increasing the rate at which the outer surface of the skin is cooled, thus increasing the level of discomfort to some individuals. As such, most individuals, upon exiting the shower, quickly grab a towel and dry their skin as fast as possible. The towel also functions as an insulator from the cooler ambient air. Consequently, many individuals wrap a towel over their hair and/or about portions of their body to keep their body warmer.

Although the rapid drying of the individual after showering, bathing, soaking, etc. reduces the discomfort many individuals experience when exiting a shower, tub, etc., the temperature of the towel on the skin when drying off and/or wrapping the towel over their hair and/or about portions of their body can still cause some discomfort to the individual due to the temperature of the towel. During showering, bathing, soaking, etc., the towel is left exposed to the ambient temperature of the bathroom, tub house, etc., thus causing the towel to have the same or similar temperature as the ambient air. Consequently, the cooler towel surface when contacting the wet skin surface of an individual can cause some discomfort to the individual. Some individuals have attempted to overcome this problem by heating the towel prior to using the towel for drying. By heating the towel, the temperature of the towel is elevated above ambient temperature thereby minimizing or overcome the discomfort of using the towel after exiting the shower, tub, etc.

A variety of towel warming devices have been commercially developed and offered to the public. Although several types of towel heating devices are known, these towel heating devices suffer from one or more disadvantages. For example, many of these towel warming devices require invasive structural modifications to accommodate the towel warming device, leading to undesired expense and cosmetic alteration of a bathroom. In addition, many of these towel warming devices are very expensive, thus only used commercially or by a small portion of the population. Furthermore, many of these towel warming devices are not portable, take a significant amount of time to proper heat the towel and/or use a significant amount of energy to heat the towel.

In view of the state of the prior art of towel warming devices, there is a need for a portable, low-cost towel warming device that quickly and efficiently warm towel and/or other textiles.

SUMMARY OF THE INVENTION

The present invention is directed to a warming device and methods for warming an article, and more particularly to a portable warming device and method for warming one or more textile materials, and still even more particularly to a portable warming device and method for warming one or more towels. The portable warming device of the present invention will be described with particular reference to the warming of one or more standard bath towels; however, it will be appreciated that other or additional articles (e.g., bath sheet, hand towel, wash cloth, bath robe, diaper, children and/or baby clothing, sock, undergarment, shirt, short, glove, scarf, mitten, house shoe, etc.) can be warmed by the portable warming device of the present invention. As defined herein, a standard bath towel is about 27-30" by 52-60" and has a thickness of about 0.125-0.25", thus having an average volume of about 175-450 cubic inches. The portable warming device of the present invention will also be described as a portable unit that can be relatively easily and conveniently transported by a user to various locations. The portability of the portable warming device is at least in part based on the size and weight of the portable warming device. In accordance with one non-limiting embodiment of the present invention, the portable warming device has a weight, when not including one or more articles, of no more than about 50 lbs. The relatively low weight of the portable warming device enables an average adult to relatively easily move the portable warming device to various locations, as opposed to moving a standard clothing dryer that typically weighs over 75-100 lbs. and is designed to be positioned in a single location. In one non-limiting aspect of this embodiment, the portable warming device has a weight, when not including one or more articles, of no more than about 40 lbs. In additional and/or alternative non-limiting aspect of this embodiment, the portable warming device has a weight, when not including one or more articles, of no more than about 30 lbs. In still additional and/or alternative non-limiting aspect of this embodiment, the portable warming device has a weight, when not including one or more articles, of no more than about 20 lbs. In yet additional and/or alternative non-limiting aspect of this embodiment, the portable warming device has a weight, when not including one or more articles, of about 3-15 lbs. In still yet additional and/or alternative non-limiting aspect of this embodiment, the portable warming device has a weight, when not including one or more articles, of about 5-10 lbs. The size of the portable warming device is also selected to enable an average adult to relatively easily grasp and move the portable warming device to various locations. In accordance with additional and/or alternative non-limiting embodiment of the present invention, the body of the portable warming device has a total volume of no more than about 8000 cubic inches. This relatively small size of the portable warming device distinguishes the portable warming device from standard and compact dryers that have volumes that generally exceed 12000 cubic inches, thereby making such dryers difficult to move without assistance from another individual and/or with the use of a dolly. In one non-limiting aspect of this embodiment, the body of the portable warming device has a total volume of no more than about 7000 cubic inches. In still additional and/or alternative non-limiting aspect of this embodiment, the body of the portable warming device has a total volume of no more than about 6000 cubic inches. In yet additional and/or alternative non-limiting aspect of this embodiment, the body of the portable warming device has a total volume of no more than about 5000 cubic inches. In still yet additional and/or alternative non-limiting aspect of this embodiment, the body of the portable warming device has a total volume of about 400-2500 cubic inches. In additional and/or alternative non-limiting aspect of this embodiment, the body of the portable warming device has a total volume of about 450-2000 cubic inches. In still additional and/or alternative non-limiting aspect of this embodiment, the body of the portable warming device has a total volume of about 500-1750 cubic inches. As can be appreciated, the total volume of the portable warming device of the present invention will in part depend on the number and/or types of articles the portable warming device is designed to warm. For instance, if the portable warming device is designed to simultaneously warm 2-3 standard bath towels, then such device will generally have, but is not required to have, a total volume than is greater than a portable warming device that is designed to warm only a single standard bath towel at a time. The portable warming device of the present invention will be described as a portable device that is typically placed on a generally flat surface (e.g., counter top, floor, commode seat or top, tub deck, shelf, chair seat, bench, table, toilet seat, toilet tank top, etc.); however, it will be appreciated that the portable warming device can include, but is not required to include, one or more connectors that enable the portable warming device to be mounted on and/or secured to the generally flat surface, a wall or other location. The ability of the portable warming device to be secured to a generally flat surface, a wall or other location does not detract from the portable nature of the portable warming device.

In accordance with additional and/or alternative non-limiting aspect of the present invention, the portable warming device is designed to at least partially dry heat one or more articles. The term "dry heat" is defined herein as primarily heating the one or more articles by a means other than the use of a heated liquid such as, but not limited to, heated water and/or steam. As such "dry heating" includes a heating process wherein no additional moisture is purposely or intentionally introduced during the heating process. The positioning of moist or slightly moist articles on and/or into the portable warming device does not constitute purposeful or intentional introduction of moisture during the heating process. In addition, the use of the portable arming device in a humid environment (e.g., bathroom, steam room, sauna, indoor hot tub room, indoor swimming pool, etc.) also does not constitute purposeful or intentional introduction of moisture during the heating process. When the one or more articles are primarily heated by dry heat, the warmed article when first removed from the portable warming device has a generally dry feel as opposed to an article that is heated by steam. In accordance with one non-limiting embodiment of the invention, the of one or more articles are at least partially heated by a radiation heating mechanism, a conduction heating mechanism and/or a convection heating mechanism. In accordance with one non-limiting aspect of this embodiment, the one or more articles are primarily heated by a radiation heating mechanism, a conduction heating mechanism and/or a convection heating mechanism. In accordance with additional and/or alternative non-limiting aspect of this embodiment, the one or more articles are primarily heated by a conduction heating mechanism and/or a convection heating mechanism. In accordance with still additional and/or alternative non-limiting aspect of this embodiment, the one or more articles are primarily heated by a conduction heating mechanism. In accordance with one aspect of this embodiment, one or more portions of the portable warming device are heated by one or more heating elements. As the one or more portions of the portable warming device begin to elevate in temperature, the one or more articles in contact with one or more portions of the portable warming device also begin to be warmed or heated by the conduction mechanism. It will be appreciated that some air will also be heated by the warmer surfaces on the portable warming device and that at least a portion of such heated air will then contact the one or more articles on and/or in the portable warming device thereby heating the one or more articles by a convection heating mechanism; however, such convection heating mechanism is merely a secondary heating mechanism as compared to the heating of the one or more articles by the conduction mechanism. As can be appreciated, the portable warming device can include one or more air circulating devices (e.g., fan, blower, etc.) to increase the heating of the one or more articles by the use of a convection heating mechanism; however, this is not required.

In accordance with still additional and/or alternative non-limiting aspect of the present invention, the portable warming device includes a warming or inner cavity having at least one side wall. The one or more side walls are used to at least partially retain one or more articles in the portable warming device as the one or more articles are warmed. The one or more side walls can be made of a variety of materials (e.g., metal, plastic, ceramic, fiber reinforced materials, composite materials, etc.). In accordance with one non-limiting embodiment of the present invention, the one or more side walls are formed of an oxidizing resistance surface so as to not rapidly oxidize when exposed to moisture. Non-limiting examples of such oxidizing resistance surfaces include, but are not limited to, stainless steel, aluminum, ceramic, plastics, etc. In accordance with an additional and/or alternative non-limiting embodiment of the present invention, when one or more side walls are used to at least partially heat the one or more articles in the warming or inner cavity by a conduction mechanism, one or more portions of the one or more side walls typically include a material having good heat conducting properties (e.g., stainless steel, aluminum, tin, nickel, chrome, etc.). In accordance with still an additional and/or alternative non-limiting embodiment of the invention, the warming or inner cavity includes one side wall. In accordance with one non-limiting aspect of this embodiment, the warming or inner cavity has a generally circular cross-sectional shape that is formed by a single side wall. In accordance with yet an additional and/or alternative non-limiting embodiment of the invention, the warming or inner cavity includes a plurality of side walls. In accordance with one non-limiting aspect of this embodiment, the warming or inner cavity has a non-circular cross-sectional shape (e.g., polygonal, oval, one or more straight sides and one or more arcuate sides, etc.) that is formed by a plurality of side walls. In accordance with an additional and/or alternative non-limiting aspect of this embodiment, the warming or inner cavity is formed by at least two side walls that a) lie in generally the same plane, b) are spaced from one another, and c) the inner surfaces are generally parallel to one another. In accordance with yet an additional and/or alternative non-limiting embodiment of the invention, the warming or inner cavity includes a bottom wall. The bottom wall can be formed of the same or a different material from the one or more side walls. The bottom wall may or may provide heat to the one or more articles in the warming or inner cavity. The bottom wall may or may not be connected to interconnected with all or less than all of the one or more side walls. The bottom wall can have a variety of configurations and shapes (e.g., flat, dome-shaped, inverted-dome shaped, oval, circular, polygonal, etc.).

In accordance with yet additional and/or alternative non-limiting aspect of the present invention, the portable warming device can include one or more lids or doors designed to substantially encapsulate one or more articles that have been positioned in the warming or inner cavity; however, this is not required. The substantial or complete encapsulation of the one or more articles in the warming or inner cavity can be used to increase the rate at which the one or more articles are heated by the portable warming device. In accordance with one non-limiting embodiment of the invention, one or more of the lids or doors are rotatably (e.g., pivotly connected, etc.) and/or slidably connected or interconnected to the warming or inner cavity and/or the housing of the portable warming device which includes the warming or inner cavity. In accordance with one non-limiting aspect of this embodiment, a single lid is pivotly connected or interconnected to the warming or inner cavity and/or the housing of the portable warming device. In accordance with an additional and/or alternative non-limiting embodiment of the invention, one or more of the lids or doors are removable from the warming or inner cavity and/or the housing of the portable warming device. In accordance with still an additional and/or alternative non-limiting embodiment of the invention, one or more of the lids or doors can include an opening and/or closing mechanism to facilitate in the opening and/or closing of the one or more lids. In accordance with one non-limiting aspect of this embodiment, the opening and/or closing mechanism includes one or more springs. In accordance with an additional and/or alternative non-limiting aspect of this embodiment, the opening and/or closing mechanism includes a friction and/or ratchet arrangement. As can be appreciated, other or addition arrangements can be used to facilitate in the opening and/or closing of the one or more lids or doors. In accordance with still an additional and/or alternative non-limiting embodiment of the invention, one or more of the lids or doors can include a retaining arrangement to facilitate in maintaining the one or more lids in a partial or fully closed position. In accordance with one non-limiting aspect of this embodiment, the retaining arrangement can include, but is not limited to, a locking arrangement, a latch arrangement, a magnet arrangement, Velcro, a spring arrangement, friction arrangement, ratchet arrangement, etc. As can be appreciated, other or addition arrangements can be used to facilitate in maintaining the one or more lids or doors in a partial or fully closed position. In accordance with still yet an additional and/or alternative non-limiting embodiment of the invention, one or more of the lids or doors can include a handle, lip and/or other type of arrangement to facilitate in the opening and/or closing of the one or more lids or doors. In accordance with an additional and/or alternative non-limiting embodiment of the invention, one or more of the lids or doors can be formed of a variety of materials (e.g., metal, plastic, glass, wood, composite materials, fiber reinforced materials, etc.). One non-limiting example of a material that can form all or a portion of the one or more lids or doors is a plastic. As defined herein, "plastic" is a general term to refer to a variety of polymer materials such as, but not limited to, thermoplastic polymers (e.g., polyurethane, polypropylene, acrylic resins, etc.), thermoset polymers (e.g., silicones, rubber, epoxides, etc.), etc. One non-limiting example of a plastic that can be used to form one or more portions of a lid or door is polypropylene. In accordance with still an additional and/or alternative non-limiting embodiment of the invention, one or more of the lids or doors can be at least partially formed of and/or include a transparent or semi-transparent material (e.g., clear or opaque plastic or glass, etc.). In accordance with yet an additional and/or alternative non-limiting embodiment of the invention, one or more of the lids or doors can be at least partially formed of a heat conducting material or a heat insulating material. In accordance with still yet an additional and/or alternative non-limiting embodiment of the invention, one or more of the lids or doors can include an opening and/or closing actuator to facilitate in the opening and/or closing of the one or more lids or doors. The opening and/or closing actuator can be formed or mechanical and/or electrical components. The opening and/or closing actuator can be designed to cause the one or more lids or doors to be manually or automatically opened and/or closed. In accordance with one non-limiting aspect of this embodiment, the portable warming device includes a foot pedal to cause one or more doors or lids to open and/or close. In accordance with an additional and/or alternative non-limiting aspect of this embodiment, the portable warming device includes a button or switch to cause one or more doors or lids to open and/or close. In accordance with still an additional and/or alternative non-limiting aspect of this embodiment, the portable warming device includes a controller to automatically to cause one or more doors or lids to open and/or close.

In accordance with still yet additional and/or alternative non-limiting aspect of the present invention, the warming or inner cavity of the portable warming device has a volume, when used in combination with one or more lids or doors to substantially encapsulate up to one or more standard bath towels. In accordance with one non-limiting embodiment of the invention, the warming or inner cavity of the portable warming device has a volume, when used in combination with one or more lids or doors to substantially encapsulate up to four standard bath towels. In accordance with one non-limiting aspect of this embodiment of the invention, the warming or inner cavity of the portable warming device has a volume, when used in combination with one or more lids or doors, to substantially encapsulate up to three standard bath towels. In accordance with an additional and/or alternative non-limiting aspect of this embodiment, the warming or inner cavity of the portable warming device has a volume, when used in combination with one or more lids or doors, to substantially encapsulate up to two standard bath towels. In accordance with still an additional and/or alternative non-limiting aspect of this embodiment of the invention, the warming or inner cavity of the portable warming device has a volume, when used in combination with one or more lids or doors, to substantially encapsulate up to one standard bath towel. In accordance with an additional and/or alternative embodiment of the invention, the warming or inner cavity of the portable warming device has an enclosed volume, when used in combination with one or more lids or doors, which is up to about 4000 cubic inches. In accordance with one non-limiting aspect of this embodiment, the warming or inner cavity of the portable warming device has an enclosed volume, when used in combination with one or more lids or doors, which is up to about 2000 cubic inches. In accordance with an additional and/or alternative non-limiting aspect of this embodiment, the warming or inner cavity of the portable warming device has an enclosed volume, when used in combination with one or more lids or doors, which is about 175-1500 cubic inches. In accordance with still an additional and/or alternative non-limiting aspect of this embodiment, the warming or inner cavity of the portable warming device has an enclosed volume, when used in combination with one or more lids or doors, which is about 200-1000 cubic inches. In accordance with yet an additional and/or alternative non-limiting aspect of this embodiment, the warming or inner cavity of the portable warming device has an enclosed volume, when used in combination with one or more lids or doors, which is about 350-750 cubic inches.

In accordance with additional and/or alternative non-limiting aspect of the present invention, the warming or inner cavity of the portable warming device generally does not include a rack and/or other type of support arrangement. The warming or inner cavity is designed to enable a folded and/or unfolded article (e.g., bath towel, etc.) to be inserted into the warming or inner cavity. As such, no specific orientation of the article in the warming or inner cavity of the portable warming device is required in order to warm the article in the warming or inner cavity. The absence of a rack and/or other type of support arrangement in the warming or inner cavity simplifies the design of the warming or inner cavity of the portable warming device and the use of the portable warming device. As can be appreciated, a rack and/or other type of support arrangement can be included in the warming or inner cavity if so desired.

In accordance with still additional and/or alternative non-limiting aspect of the present invention, the warming or inner cavity of the portable warming device can include one or more drain openings. The one or more drain openings are used to enable liquid that collects in the warming or inner cavity to exit the warming or inner cavity. Wet or damp articles may be placed in the warming or inner cavity by a user. The liquid in the one or more wet or damp articles can accumulate at the base of the warming or inner cavity. During the heating of the one or more articles in the warming or inner cavity, the liquid in the warming or inner cavity can cause the one or more articles to feel damp after being removed from the warming or inner cavity by a user. The one or more drains in the warming or inner cavity can reduce the amount of liquid in the warming or inner cavity, thereby reducing the dampness of the one or more articles being warmed or heated in the warming or inner cavity. The one or more drains can also or alternatively be used to reduce the amount of liquid in the warming or inner cavity so that when other articles are place in the warming or inner cavity, such articles do not contact significant amounts of liquid in the warming or inner cavity so as to cause the articles to feel damp after being heated and removed from the warming or inner cavity by the user. The one or more drains can also or alternatively be used to inhibit or prevent damage, discoloration, etc. to one or more components of the portable warming device. In accordance with one non-limiting embodiment of the invention, one or more drain openings are position in the base or bottom of the warming or inner cavity. As can be appreciated, one or more drain openings can be positioned in other regions of the warming or inner cavity. In accordance with one aspect of this embodiment, at least one drain opening is positioned generally in the center of the base or bottom of the warming or inner cavity. In accordance with an additional and/or alternative non-limiting embodiment of the invention, the base or bottom of the warming or inner cavity includes one or more recessed or depressed regions so as to facilitate in the accumulation of the liquid in such recessed or depressed regions. When the base or bottom of the recessed or depressed regions include one or more of such recessed or depressed regions, one or more drain openings, when used, are typically located in the recessed or depressed regions to remove the accumulated liquid in such recessed or depressed regions. In accordance with still an additional and/or alternative non-limiting embodiment of the invention, a drain pan and/or other type of liquid retention device can be used to hold liquid that passes though the one or more drain openings so as to reduce or prevent the liquid from being deposited on a surface below the one or more drain openings. When drain pan and/or other type of liquid retention device is used, the drain pan and/or other type of liquid retention device can be designed to be removed or otherwise emptied by a user; however, this is not required.

In accordance with yet additional and/or alternative non-limiting aspect of the present invention, the portable warming device generally does not include a spinning warming or inner cavity and/or a spinning device in the warming or inner cavity. In most clothes dryers, articles of clothing are placed in a drum. This drum is rotated during a drying cycle of the one or more articles in the drum. The portable warming device does not require the use of rotating components to warm or heat the one or more articles in the warming or inner cavity. The elimination of rotating components in the portable warming device results in a more simplified design of the portable warming device. As can be appreciated, one or more spinning devices and/or arrangements can be included in the portable warming device, if so desired.

In accordance with still yet additional and/or alternative non-limiting aspect of the present invention, the portable warming device includes an outer shell. In this arrangement, the outer surface of the outer shell forms the outer surface of the portable warming device. The outer shell can be formed or a variety of the materials (e.g., metal, plastic, ceramic, glass, wood, etc.). The outer shell can have a variety of configurations (e.g., circular, oval, polygonal, etc.). The outer surface of the shell can have a variety of colors and/or designs. In accordance with one non-limiting embodiment of the invention, the portable warming device includes an inner shell and an outer shell. The inner shell and outer shell can be formed of the same or different materials. The inner shell and outer shell can have the same general shape or have different shapes. The inner shell and outer shell can have generally the same thickness or different thicknesses. In accordance with one non-limiting aspect of this embodiment, there is provided an outer shell having an inner and outer surface and an inner shell having an inner and outer surface. The inner surface of the inner shell at least partially forms the warming or inner cavity of the portable warming device. The outer surface of the inner shell and the inner surface of the outer shell may be in contact with one another or be partially or fully spaced apart from one another. In accordance with one non-limiting design of this aspect of the embodiment, the outer surface of the inner shell and the inner surface of the outer shell are at least partially spaced apart from one another and one or more heating and/or electronic components are positioned in the one or more spaces between the inner and outer shells. In accordance with an additional and/or alternative non-limiting embodiment of the invention, the outer shell of the portable warming device includes an inner surface that at least partially forms the warming or inner cavity of the portable warming device. In accordance with one non-limiting aspect of this embodiment, the outer shell is a single component that includes at least one cavity designed to at least partially include one or more heating and/or electronic components and has an outer wall that forms at least a portion of the outer surface of the portable warming device and an inner surface that form at least a portion of the warming or inner cavity of the portable warming device. In accordance with an additional and/or alternative non-limiting embodiment of the invention, the outer shell is a single component that includes one or more heating and/or electronic components and has an outer wall that forms at least a portion of the outer surface of the portable warming device and which outer wall creates a heated surface to warm or heat one or more articles on the outer surface.

In accordance with an additional and/or alternative non-limiting aspect of the present invention, the portable warming device can include a top and/or bottom housing; however, this is not required. The top and/or bottom housing can be formed of the same or different material. The top and/or bottom housing can be formed of the same or different material from the outer shell. The top and/or bottom housing can be formed of the same or different material from the inner shell, when an inner shell is used. The top and/or bottom housing can have the same or a different shape. The top and/or bottom housing can be detachably connected or permanently connected to the outer shell. The top and/or bottom housing can be detachably connected or permanently connected to the inner shell, when an inner shell is used. The top and/or bottom housing can be formed of a variety of materials (e.g., metal, wood, plastic, ceramic, composite materials, fiber reinforced materials, etc.). The top and/or bottom housing can be formed of a heat conducting or heating insulating material. The top and/or bottom housing can include a surface (e.g., rough surface, grooved surface, ribbed surface, non-slick surface, etc.) that facilitates in gripping the portable warming device by a user; however, this is not required. The bottom housing can include a non-slick surface (e.g., rubber surface, silicone surface, etc.) that inhibits or prevents the bottom housing from slipping and/or inadvertently moving on a surface; however, this is not required. The non-slick surface, when used, can include one or more legs, dimple, feet, etc. in the bottom housing; however, this is not required. The top and/or bottom housing can include one or more connectors (e.g., slot, groove, rib, screw hole, clip, clamp, etc.) used to secure the outer shell and/or inner shell to the top and/or bottom housing; however, this is not required. The top and/or bottom housing can include one or more connectors to at least partially maintain the position of the outer shell and inner shell relative to on another; however, this is not required. The top and/or bottom housing can include one or more connectors to at least partially mount the top and/or bottom housing to another surface; however, this is not required.

In accordance with still additional and/or alternative non-limiting aspect of the present invention, the portable warming device includes a heating arrangement. One or more portions of the heating arrangement can be secured to and/or form part of a) the inner and/or outer shell of the portable warming device, b) the top and/or bottom housing of the portable warming device, and/or c) the lid and/or door of the portable warming device. In accordance with one non-limiting embodiment of the invention, the heating arrangement includes a conduction heating mechanism that conducts heat through at least a portion of the inner and/or outer shell of the portable warming device so as to heat at least a portion of an outer surface of the portable warming device or at least a portion of an inner surface of the warming or inner cavity. In accordance with one non-limiting aspect of this embodiment, the conduction heating mechanism includes one or more heating elements. In accordance with an additional and/or alternative non-limiting embodiment of the invention, at least one of the heating elements includes one or more electrically conductive wires (e.g., copper wire, aluminum wire, tin wire, steel wire, etc.) that are at least partially encapsulated and/or coated in one or more layers of an electrical insulting material (e.g., silicone, plastic, rubber, fiberglass, etc.). The electrical insulating material is typically not a heat insulating material; however, this is not required. In accordance with still an additional and/or alternative non-limiting embodiment of the invention, at least one of the heating elements includes one or more electrically conductive wires that are at least partially encapsulated/coated in an electrical insulting material and which one or more protective layers (e.g., plastic tape, metal tape, fiberglass material, etc.) are place over and/or about the electrical insulting material so as to provide protection to the electrical insulting material and/or to facilitate in securing the heating element to at least a portion of the inner and/or outer shell of the portable warming device. In accordance with yet an additional and/or alternative non-limiting embodiment of the invention, one or more of the heating elements can be a) positioned in the outer and/or inner shell, b) positioned on or closely adjacent to the inner and/or outer surface of the outer and/or inner shell, and/or c) spaced from the inner and/or outer surface of the outer and/or inner shell. In accordance with one non-limiting aspect of this embodiment, the portable warming device includes an inner and outer shell and one or more of the heating elements are positioned closely adjacent to or are in contact with at least a portion of the outer surface of the inner shell. In accordance with an additional and/or alternative non-limiting aspect of this embodiment, the portable warming device includes an inner and outer shell and one or more of the heating elements are positioned closer to the outer surface of the inner shell than to the inner surface of the outer shell. In accordance with still yet an additional and/or alternative non-limiting embodiment of the invention, the conduction heating mechanism includes one or more heating elements that can generate at least about 100 watts of energy. In accordance with one non-limiting aspect of this embodiment, the conduction heating mechanism includes one or more heating elements that can generate up to about 1500 watts of energy. In accordance with an additional and/or alternative non-limiting aspect of this embodiment, the conduction heating mechanism includes one or more heating elements that can generate about 200-1000 watts of energy. In accordance with still an additional and/or alternative non-limiting aspect of this embodiment, the conduction heating mechanism includes one or more heating elements that can generate about 300-800 watts of energy. In yet additional and/or alternative non-limiting aspect of this embodiment, the conduction heating mechanism includes one or more heating elements that can generate about 350-600 watts of energy. In accordance with an additional and/or alternative embodiment of the invention, the conduction heating mechanism includes one or more heating elements that can heat at least a portion of an outer surface of the portable warming device or at least a portion of the inner surface of the warming or inner cavity to a temperature up to about 330° F. Temperatures that exceed 330° F. can result in damage to certain types of polymer or acrylic fabric blends. In accordance with one non-limiting aspect of this embodiment, the conduction heating mechanism includes one or more heating elements that can heat at least a portion of an outer surface of the portable warming device or at least a portion of the inner surface of the warming or inner cavity to a temperature of at least about 105° F. In accordance with an additional and/or alternative non-limiting aspect of this embodiment, the conduction heating mechanism includes one or more heating elements that can heat at least a portion of an outer surface of the portable warming device or at least a portion of the inner surface of the warming or inner cavity to a temperature of about 110-300° F. In accordance with still an additional and/or alternative non-limiting aspect of this embodiment, the conduction heating mechanism includes one or more heating elements that can heat at least a portion of an outer surface of the portable warming device or at least a portion of the inner surface of the warming or inner cavity to a temperature of about 150-290° F. In accordance with yet an additional and/or alternative non-limiting aspect of this embodiment, the conduction heating mechanism includes one or more heating elements that can heat at least a portion of an outer surface of the portable warming device or at least a portion of the inner surface of the warming or inner cavity to a temperature of about 200-260° F. In accordance with still an additional and/or alternative embodiment of the invention, the conduction heating mechanism includes one or more heating elements that can heat a standard bath towel positioned on least a portion of an outer surface of the portable warming device or in the warming or inner cavity of the portable warming device to an average temperature of at least about 130° F. in less than about 30 minutes; however, it will be appreciated that the time period can be greater than 30 minutes. The heating of the standard bath towel to elevated temperatures not only heats the standard bath towel to a desired temperature level for the user, the elevated temperature can also or alternatively reduce or eliminate bacteria, mold, mildew, fungus, allergens, dust mites, viruses, etc. from the standard bath towel. In one non-limiting example, mold and/or mildew common grow in damp and moist regions. A standard bath towel that has been used to dry an individual will be damp and can be susceptible to the growth of mold and/or mildew. As such, after several days of use, the standard bath towel may have an undesired smell and require washing to achieve a fresh and clean scent. The towel warming device of the present invention can warm or heat the standard bath towel to elevated temperatures that can cause some or all of the mold and/or mildew growing on the standard bath towel to be killed. In another and/or alternative non-limiting example, bacteria, dust mites, viruses, etc. in the surrounding environment can become deposited on a standard bath towel. The towel warming device of the present invention can warm or heat the standard bath towel to elevated temperatures that can cause some or all of the bacteria, dust mites, viruses, etc. on the standard bath towel to be killed, thus at least in part disinfecting the standard bath towel. As can be appreciated, other or additional foreign objects on the standard bath towel can be reduced or eliminated by the warming or heating of the standard bath towel by the portable towel warming device. As can also be appreciated, other or additional articles can be warmed or heated by the towel warming device to reduce or eliminate various foreign objects on such articles. In accordance with one non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 130° F. in less than about 20 minutes. In accordance with an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 130° F. in less than about 15 minutes. In accordance with still an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 130° F. in less than about 10 minutes. In accordance with yet an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 150° F. in less than about 30 minutes; however, it will be appreciated that the time period can be greater than 30 minutes. In accordance with still yet an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 150° F. in less than about 20 minutes. In accordance with an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 150° F. in less than about 15 minutes. In accordance with still an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 150° F. in less than about 10 minutes. In accordance with yet an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 180° F. in less than about 30 minutes; however, it will be appreciated that the time period can be greater than 30 minutes. In accordance with still yet an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 180° F. in less than about 20 minutes. In accordance with an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 180° F. in less than about 15 minutes. In accordance with still an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 180° F. in less than about 10 minutes. In accordance with yet an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 200° F. in less than about 30 minutes; however, it will be appreciated that the time period can be greater than 30 minutes. In accordance with still yet an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 200° F. in less than about 20 minutes. In accordance with an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 200° F. in less than about 15 minutes. In accordance with still an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to an average temperature of at least about 200° F. in less than about 10 minutes. In accordance with yet an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to a temperature that can cause at least about 2% of the foreign objects (e.g., bacteria, mold, mildew, fungus, allergens, dust mites, viruses, etc.) on the standard bath towel to be disabled, killed and/or eliminated within less than about 10 minutes. In accordance with still yet an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to a temperature that can cause at least about 5% of the foreign objects on the standard bath towel to be disabled, killed and/or eliminated within less than about 10 minutes. In accordance with an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to a temperature that can cause at least about 10% of the foreign objects on the standard bath towel to be disabled, killed and/or eliminated within less than about 10 minutes. In accordance with still an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to a temperature that can cause at least about 20% of the foreign objects on the standard bath towel to be disabled, killed and/or eliminated within less than about 10 minutes. In accordance with yet an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to a temperature that can cause at least about 25% of the foreign objects on the standard bath towel to be disabled, killed and/or eliminated within less than about 10 minutes. In accordance with still yet an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to a temperature that can cause at least about 40% of the foreign objects on the standard bath towel to be disabled, killed and/or eliminated within less than about 10 minutes. In accordance with an additional and/or alternative non-limiting aspect of this embodiment, the conduction heating mechanism includes one or more heating elements that can heat a standard bath towel positioned on least a portion of an outer surface of the portable warming device or in the warming or inner cavity of the portable warming device to a temperature that can cause at least about 50% of the foreign objects on the standard bath towel to be disabled, killed and/or eliminated within less than about 10 minutes. In accordance with yet an additional and/or alternative one non-limiting embodiment of the invention, the conduction heating mechanism includes one or more heating elements that uniformly heat or non-uniformly heat the outer surface of the portable warming device or inner surface of the warming or inner cavity. In accordance with one non-limiting aspect of this embodiment, the one or more heating elements only heat one or more side walls of the warming or inner cavity. In additional and/or alternative non-limiting aspect of this embodiment, the one or more heating elements heat one or more side walls of the warming or inner cavity and at least a portion of the bottom or base of the warming or inner cavity. In still additional and/or alternative non-limiting aspect of this embodiment, the one or more heating elements heat one or more side walls of the warming or inner cavity and at least a portion of the bottom or base of the warming or inner cavity and at least one or more lid and/or doors of the portable warming device. In yet additional and/or alternative non-limiting aspect of this embodiment, the one or more heating elements heat one or more side walls of the warming or inner cavity to a higher temperature than the bottom or base of the warming or inner cavity. In still yet additional and/or alternative non-limiting aspect of this embodiment, the one or more heating elements heat one or more side walls of the warming or inner cavity and the bottom or base of the warming or inner cavity to a higher temperature than the one or more lid and/or doors of the portable warming device.

In accordance with yet additional and/or alternative non-limiting aspect of the present invention, the portable warming device includes a heating arrangement having a controller (e.g., fuse, timer, thermostat, electronic circuit, microprocessor, etc.) that terminates the heating of the outer surface of the portable warming device or the warming or inner cavity after a predetermined event; however, this is not required. The controller is designed to eventually terminate the heating of the outer surface of the portable warming device or the warming or inner cavity after the heating arrangement has been activated. The use of such a controller prevents the heating arrangement from continuously heating the one or more articles on the outer surface of the portable warming device or in the warming or inner cavity after the heating arrangement has been activated. The continued heating of the outer surface of the portable warming device or the warming or inner cavity can result in 1) damage to one or more components of the heating arrangement and/or one or more other components of the portable warming device, 2) damage to one or more articles on the outer surface of the portable warming device or in the warming or inner cavity, 3) the wasting of electrical energy, 4) heating of the one or more articles on the outer surface of the portable warming device or in the warming or inner cavity to an undesired elevated temperature, and/or 5) heating the outer surfaces of the portable warming device an undesired elevated temperature. In accordance with one non-limiting embodiment of the invention, the predetermined event includes a predetermined temperature one or more regions of the portable warming device are heated to. In accordance with one non-limiting aspect of this embodiment, one or more thermostats or other temperature measuring devices are used to detect a temperature in one or more regions of the portable warming device and to then cause one or more of the heating elements to temporarily or permanently stop generating heat. In accordance with an additional and/or alternative non-limiting aspect of this embodiment, the detected temperature is up to about 330° F. In accordance with still an additional and/or alternative non-limiting aspect of this embodiment, the detected temperature in combination with a certain amount of time after achieving a certain detected temperature is used then cause one or more of the heating elements to temporarily or permanently stop generating heat. In accordance with an additional and/or alternative non-limiting embodiment of the invention, the predetermined event includes a predetermined time period the one or more heating elements generate heat. In accordance with one non-limiting aspect of this embodiment, a timer is used to cause one or more of the heating elements to temporarily or permanently stop generating heat after a certain time period of heating by the one or more heating elements. In accordance with one non-limiting design of this aspect of the embodiment, a timer causes and/or generates a signal to cause one or more of the heating elements to temporarily or permanently stop generating heat after a time of up to about 60 minutes; however, it will be appreciated that the time period can be greater than 60 minutes. In accordance with still an additional and/or alternative non-limiting design of this aspect of the embodiment, a timer causes and/or generates a signal to cause one or more of the heating elements to temporarily or permanently stop generating heat after a time of up to about 30 minutes. In accordance with yet an additional and/or alternative non-limiting design of this aspect of the embodiment, a timer causes and/or generates a signal to cause one or more of the heating elements to temporarily or permanently stop generating heat after a time of up to about 20 minutes. In accordance with still yet an additional and/or alternative non-limiting design of this aspect of the embodiment, a timer causes and/or generates a signal to cause one or more of the heating elements to temporarily or permanently stop generating heat after a time of up to about 15 minutes. In accordance with an additional and/or alternative non-limiting design of this aspect of the embodiment, a timer causes and/or generates a signal to cause one or more of the heating elements to temporarily or permanently stop generating heat after a time of up to about 10 minutes. As can be appreciated, the timer can cause and/or generate a signal to make one or more of the heating elements temporarily or permanently stop generating heat after some other period of time. In accordance with still an additional and/or alternative non-limiting embodiment of the invention, the predetermined event includes a predetermined number of heating cycles. In accordance with one non-limiting aspect of this embodiment, the portable warming device includes a heating arrangement having a controller that deactivates one or more heating elements after one or more heating cycles. In accordance with one non-limiting aspect of this embodiment, the controller is designed to terminate the heating of the outer surface of the portable warming device or the warming or inner cavity after a predetermined period of time has transpired and/or after a predetermined number of heating cycles has occurred. In accordance with an additional and/or alternative non-limiting aspect of this embodiment, the controller only allows a single heating cycle for a portion or all of the heating elements after the heating arrangement has been activated. In this arrangement, once the heating arrangement has been activated, one or more heating elements are activated to heat the outer surface of the portable warming device or the warming or inner cavity and then one or more of the heating elements are terminated from further generating heat after a predetermined event. In accordance with still an additional and/or alternative non-limiting embodiment, the controller only allows a predefined number of heating cycles to occur for a portion or all of the heating elements after the heating arrangement has been activated. In this arrangement, once the heating arrangement has been activated, one or more heating elements are activated to heat the outer surface of the portable warming device or the warming or inner cavity and then one or more of the heating elements are terminated after a predetermined event and then reactivated at least one additional time and then again terminated after a predetermined event. The time period between each heating cycle can be less than a second to several minutes. The duration of each heating cycle can be the same or different. The temperature that the outer surface of the portable warming device or the warming or inner cavity is heated to during each heating cycle can be the same or different. In one non-limiting aspect of this embodiment, the number of predefined heat cycles is no more than ten; however, it will be appreciated that predefined number of heating cycles can be more than ten cycles. In additional and/or alternative non-limiting aspect of this embodiment, the number of predefined heat cycles is no more than three. In additional and/or alternative non-limiting aspect of this embodiment, the number of predefined heat cycles is no more than two.

In accordance with still yet additional and/or alternative non-limiting aspect of the present invention, the portable warming device includes a heating arrangement that can be powered by an internal and/or external power source. In accordance with one non-limiting embodiment of the invention, the heating arrangement can be at least partially powered by an external power source. Such external power sources can included, but are not limited to, a 120V and/or 220V wall plug or other 120V and/or 220V electric source (e.g., electric generator, hand-crank generator, etc.). When an external power source is used, the portable warming device typically includes a power cord having a plug that is used to connect to the external power source. The power may or may not include a ground connector. The portable warming device can include a storage cavity for the power cord; however, this is not required. If the portable warming device includes a storage cavity for the power cord, the storage cavity can include a cord winding mechanism to take-up and payout the power cord; however, this is not required. In accordance with an additional and/or alternative non-limiting embodiment of the invention, the heating arrangement can be at least partially powered by an internal power source. One non-limiting internal power source is a battery; however other or additional internal power sources can be used (e.g., solar panel, fuel cell, hand-crank generator, etc.). When an internal power source is used, portable warming device can include a power source cavity that enables a user to access the internal power source and replace the internal power source; however, this is not required. When an internal power source is used, the portable warming device can include a recharging arrangement (e.g., power cord that is connectable to an external power source, etc.) to enable a user to recharge the internal power source; however, this is not required.

In accordance with additional and/or alternative non-limiting aspect of the present invention, the portable warming device can include a heating arrangement that has one or more activators used to begin one or more heating cycles of the heating elements of the heating arrangement; however, this is not required. In accordance with one non-limiting embodiment of the invention, an activation switch is used by a user to activate/deactivate the heating arrangement. The type activator and/or location of the activator on the portable warming device can be numerous. Non limiting examples of an activation switch include, but are not limited to, toggle switches, rocker switches, push button switches, slide switches, rotary switches, keylock switches, leaf switches, snap-action switches, grasp switches, membrane switches, light touch switches, cylindrical touch switch, fiber optic switch, adjustable proximity switch, adjustable photoelectric switch, eyeblink switch, voice activated switch, vibration switch, etc. Non-limiting examples of the location of the activation switch on the portable warming device includes, but is not limited to, the top housing, the bottom housing, the lid, the door, the outer shell, the inner shell, the space between the outer and inner shell, etc. In accordance with an additional and/or alternative non-limiting embodiment of the invention, a mechanical timer and/or electronic circuit can be used to activate/deactivate the heating arrangement. The mechanical timer and/or electronic circuit can be set or programmed to automatically activate the heating arrangement at a certain time. In accordance with still an additional and/or alternative non-limiting embodiment of the invention, a remote control device can be used to activate/deactivate the heating arrangement. The remote control can use RF, IR, sound waves (e.g., voice activated, ultrasound waves, etc.), etc. to control the heating arrangement from a remote location.

In accordance with still additional and/or alternative non-limiting aspect of the present invention, the portable warming device can include one or more light generating visual indicators and/or audible indicators; however, this is not required. Non-limiting examples of light generating visual indicators include, but are not limited to, LED lights, incandescent lights, fluorescent lights, HID lights, halogen lights etc. Non-limiting examples of audible indicators include, but are not limited to, an electronic buzzer, electronic bell, electronic music, etc. The one or more light generating visual indicators and/or audible indicators can be positioned in a variety of locations on the portable warming device such as, but not limited to, the top housing, the bottom housing, the lid, the door, the outer shell, the inner shell, the space between the outer and inner shell, etc. The one or more light generating visual indicators and/or audible indicators can be used for a variety of reasons in combination with the heating arrangement such as, but not limited to, 1) indicating that one or more heating elements are generating heat, 2) indicating that one or more heating elements are not generating heat, 3) indicating that the portable warming device is connected to a power source, 4) indicating that one or more heating elements are cooling down and/or heating up, 5) indicating when an article is properly heated, 6) indicating when one or more articles can or should be inserted and/or removed from the outer surface of the portable warming device or the warming or inner cavity, 7) indicating when one or more lids or doors can or should be opened or closed, 8) indicating that lid or door is open or closed, 9) indicating the proper operation and/or a malfunction of the heating arrangement, 10) indicating that one or more articles on the outer surface of the portable warming device or in the warming or inner cavity have been heated to some temperature, 11) illuminating one or more controls and/or displays on the portable warming device, 12) indicating that one or more controls on the portable warming device have been activated, deactivated, etc., 13) indicating that heating elements were activated but no articles where placed on the outer surface of the portable warming device or in the warming or inner cavity, 14) indicating that heating elements were activated but articles on the outer surface of the portable warming device or in a warming or inner cavity were not removed after completion or partial completion of one or more heating cycles, 15) indicating that a lid or door was not opened after completion or partial completion of one or more heating cycles, 16) indicating that one or more components of the portable warming device are not working, are not properly working, and/or require service and/or replacement, 17) indicating that a power source is recharging, needs recharging and/or needs to be replaced, 18) providing a temperature display and/or illuminating a temperature display to display ambient temperature and/or temperature on the outer surface of the portable warming device or in warming or inner cavity, 19) providing a clock and/or illuminating a clock to indicate time, date, alarm settings, etc., 20) proving a timer and/or illuminating a timer, 21) proving a user interface and/or illuminating a user interface to that is used by a user to view and/or interface with one or more actual and/or preprogrammed operations of the heating arrangement (e.g., setting warming temperature, setting time of heating, setting activation time, displaying remaining time of heating, displaying time since heating elements terminated, displaying length of time an article has been heated, displaying length of time since an article remained on the outer surface of the portable warming device or in warming and heating cavity after termination of heating elements, etc.) and/or 22) indicating that a lid or door was not opened prior to activation of one or more heating cycles. As can be appreciated, there can be other or addition uses of the one or more light generating visual indicators and/or audible indicators in combination with the heating arrangement. As can also be appreciated, the one or more light generating visual indicators and/or audible indicators can have one or more functions that are independent of and/or used in combination with the heating arrangement of the portable warming device. Non-limiting examples of such uses include, but are not limited to, 1) functioning as a light (e.g., night light), 2) playing music (e.g., radio, CDs, DVDs, MP3s, etc.), 3) generating a light show (e.g., random light displays, lighting displays sensitive to music or other types of sounds, preprogramed light displays, etc.), and/or 4) functioning as an alarm (e.g., wake-up alarm, intruder alarm, fire and/or smoke alarm, $CO_2$ and/or CO alarm, etc.). As can be appreciated, there can be other or addition uses of the one or more light generating visual indicators and/or audible indicators.

In accordance with yet additional and/or alternative non-limiting aspect of the present invention, the portable warming device can include one or more controllers and/or user setting devices; however, this is not required. The one or more controllers can be positioned in a variety of locations on the portable warming device such as, but not limited to, the top housing, the bottom housing, the lid, the door, the outer shell, the inner shell, the space between the outer and inner shell, etc. Non-limiting examples of such controllers and/or user setting devices include, but are not limited to, electronic or mechanical timer, electronic or mechanical clock, audio controllers (e.g., volume controller, radio tuner controller, CD controller, DVD controller, MP3 controller, etc.), visual controllers (e.g., light display controller, light color controller, light intensity controller, etc.), and/or heating element controllers (e.g., mechanical and/or electronic activation/deactivation switch, electronic or mechanical timer, electronic or mechanical clock, temperature settings, etc.). As can be appreciated, there can be other or addition types of controllers and/or user setting devices.

In accordance with yet additional and/or alternative non-limiting aspect of the present invention, the portable warming device can include one or more safety devices; however, this is not required. Non-limiting examples of safety devices include, but are not limited to, circuit breaker, fuse, GFCI, power cord ground, etc. As can be appreciated, other or additional safety devices can be used. The portable warming device can be designed to be water proof or substantially water proof, and/or housing vulnerable electric components in a housing or compartment that is water proof or substantially water proof; however, this is not required.

In accordance with still yet additional and/or alternative non-limiting aspect of the present invention, the portable warming device can include a deactivation arrangement to temporarily terminate one or more operations of the heating arrangement; however, this is not required. In accordance with one non-limiting embodiment of the invention, one or more lid or doors on the portable warming device include a mechanism that deactivates or causes the deactivation of one or more heating elements when the lid or door is opened and/or not properly closed. In accordance with an additional and/or alternative non-limiting embodiment of the invention, one or more lids or doors on the portable warming device include a mechanism that deactivates or causes the deactivation of one or more heating elements when the portable warming device is moved (e.g., pick-up portable warming device, etc.) and/or not properly positioned on a surface (e.g., laid on its side, tipped over, etc.).

In accordance with additional and/or alternative non-limiting aspect of the present invention, one or more components of the portable warming device can be formed of or include a transparent or semi-transparent material; however, this is not required. The use of such materials can enable a user to view one or more of the internal components of the portable warming device, view the contents of the warming or inner cavity, etc.

In accordance with still additional and/or alternative non-limiting aspect of the present invention, the portable warming device can include one or more blowers to enhance and/or increase the rate of warming of the one or more articles on the outer surface of the portable warming device or in the warming or inner cavity and/or to cool one or more components of the portable warming device; however, this is not required. As can be appreciated, the one or more blowers can have other or additional functions. The one or more blowers can be positioned in a variety of locations on the portable warming device such as, but not limited to, the top housing, the bottom housing, the lid, the door, the outer shell, the inner shell, the space between the outer and inner shell, etc. The one or more blowers can be automatically activated/deactivated and/or manually activated/deactivated. For example, the one or more blowers can be automatically activated when 1) immediately after or some time after one or more heating elements have been activated, 2) the temperature of one or more internal components of the portable warming device obtains a certain temperature, 3) immediately after or some time after a certain time of operation of the one or more heating elements, and/or 4) immediately after or some time after the outer surface of the portable warming device or the warming or inner cavity obtains a certain temperature. As can be appreciated, the one or more blowers can be activated for other or additional reasons. In additional and/or alternative example, the one or more blowers can be automatically deactivated when 1) one or more lids or doors of the portable warming device are opened, 2) immediately after or some time after one or more heating elements have terminated heating, 3) immediately after or some time after the temperature of one or more internal components of the portable warming device has fallen below a certain temperature, 4) immediately after or some time after the outer surface of the portable warming device or the warming or inner cavity has fallen below a certain temperature, 5) immediately after or some time after a certain time of operation of the one or more blowers, and/or 6) the portable warming device is not in a proper operating position (e.g., tipped over, etc.). As can be appreciated, the one or more blowers can be deactivated for other or additional reasons. In additional and/or alternative example, the one or more blowers can be manually activated and/or deactivated by use of a switch, timer, etc. As can be appreciated, the one or more blowers can be activated/deactivated by other means. One or more filter materials can be used in combination with the one or more blowers to remove lint, dust, etc.; however, this is not required. When one or more blowers are used, the top housing, the bottom housing, the lid, the door, the outer shell, and/or the outer shell can include one or more openings to facilitate in the flow of air; however, this is not required.

In accordance with yet additional and/or alternative non-limiting aspect of the present invention, the portable warming device can include an aroma or scent generating arrangement; however, this is not required. The aroma or scent generating arrangement can be used to provide a fresh scent, clean scent and/or other desirable scent to the one or more articles positioned on the outer surface of the portable warming device or in the warming or inner cavity and/or to provide a scent to a region about the portable warming device. As can be appreciated, aroma or scent generating arrangement in combination with the disabling, killing and/or eliminating of foreign objects (e.g., bacteria, mold, mildew, fungus, allergens, dust mites, viruses, etc.) on the one or more articles can provide an enhanced experience by the user when using the warmed or heated article; however, this is not required. The aroma or scent generating arrangement can be positioned in a variety of locations on the portable warming device such as, but not limited to, the top housing, the bottom housing, the lid, the door, the outer shell, the inner shell, the space between the outer and inner shell, etc. The aroma or scent generating arrangement can be designed to provide a desired scent to the one or more articles on the outer surface of the portable warming device or in the warming or inner cavity and/or to provide a scent to a region about the portable warming device. The aroma or scent generating arrangement can include and/or be used with one or more blowers; however, this is not required. The aroma or scent generating arrangement can be automatically activated/deactivated and/or manually activated/deactivated. The aroma or scent generating arrangement can be designed to enable a user to change out and/or refill an aroma or scent containing member and/or receptacle; however, this is not required. The aroma or scent generating arrangement can include a volatile material (e.g., liquid, gel, solid, etc.) to release volatile substances (e.g., perfume, air fresheners, etc.) into the towel and/or in the atmosphere surrounding the portable warming device. The aroma or scent generating arrangement can be used independently and/or in conjunction with the heating arrangement of the portable warming device to cause controlled and/or uncontrolled release of the volatile substances. In one non-limiting embodiment of the invention, the volatile material is a consumable article designed to diffuse active volatile substances in the consumable article. In one non-limiting aspect of this embodiment, the consumable article is a heat shrinkable material, which material can have volatile substances impregnated therein. In another and/or alternative non-limiting aspect of this embodiment, the consumable article is designed to shrink as volatile substances are released therefrom. In still another and/or alternative non-limiting aspect of this embodiment, the consumable article includes heat shrink textile fibers such as, but not limited to, chlorofiber non-woven needled sheet bonded by a polyvinyl chloride resin. This particular non-limiting material is nonflammable and is heat shrinkable at elevated temperatures and can be impregnated with a volatile substance. In yet another and/or alternative non-limiting aspect of this embodiment, the consumable article includes a polyamide resin body such as, but not limited to, a Versalon™ type polyamide resin body. Non-limiting examples of polyamide resins that can be used include, but are not limited to, fatty polyamides (e.g., diamines, triaminesand relatively high molecular weight dibasic acids [e.g., the condensation products of dimerized linoleic acid and ethylene diamine], etc.). These types of resins are advantageous in that such resins generally retain their hardness at room temperature. In another and/or alternative non-limiting embodiment of the invention, the volatile substances include perfume oils (e.g., complex mixtures of volatile compounds including esters, ethers, aldehydes, nitrites, alcohols, unsaturated hydrocarbons [e.g., terpenes, etc.], etc.). In still another and/or alternative non-limiting embodiment of the invention, the volatile substances constitute at least about 1 weight percent of the volatile material. In one non-limiting aspect of this embodiment, the volatile substances constitute up to about 100 weight percent of the volatile material. In another and/or alternative non-limiting aspect of this embodiment, the volatile substances constitutes about 5-70 weight percent of the volatile material. In yet another and/or alternative non-limiting embodiment of the invention, the volatile substances can include insecticides, bactericides, odorants, and the like; however, this is not required. In still yet another and/or alternative non-limiting embodiment of the invention, the volatile substances can be diluted form in solvent (e.g., oily glycol type solvent [e.g., dipropylene glycol, ethylene diclycol, etc.], etc.); however, this is not required.

In accordance with still yet additional and/or alternative non-limiting aspect of the present invention, the portable warming device can include an insulating material to reduce the amount of heat transmitted to the outer surface of the outer shell of the portable warming device; however, this is not required. Non-limiting examples of insulating materials include, but are not limited to, rock wool, slag wool, fiberglass, cellulose, polystyrene foam, polyurethane foam, polyisocyanurate foam, etc. The insulating material can be positioned in a variety of location on the portable warming device such as, but not limited to, the top housing, the bottom housing, the lid, the door, the outer shell, the inner shell, the space between the outer and inner shell, etc.

In accordance with additional and/or alternative non-limiting aspect of the present invention, the portable warming device can include one or more components that change color and/or clarity due to temperature changes; however, this is not required. Non-limiting components of the portable warming device can include, but are not limited to, the top housing, the bottom housing, the lid, the door, the outer shell, the inner shell, the space between the outer and inner shell, etc.

In accordance with still additional and/or alternative non-limiting aspect of the present invention, the portable warming device can include a steam warming arrangement which can be used independently or in conjunction with one or more heating elements to heat one or more articles on the outer surface of the portable warming device or in the warming or inner cavity; however, this is not required. The steam warming arrangement can be at least partially positioned in the top housing, the bottom housing, the lid, the door, the outer shell, the inner shell, the space between the outer and inner shell, etc.

In accordance with one non-limiting object of the present invention, there is provided a portable warming device for warming one or more textile materials.

In accordance with an additional and/or alternative non-limiting object of the present invention, there is provided a portable warming device that quickly and efficiently warms one or more textile materials.

In accordance with still an additional and/or alternative non-limiting object of the present invention, there is provided a portable warming device that includes a warming or inner cavity for at least partially encapsulating one or more textile materials during the warming of such textile materials.

In accordance with yet an additional and/or alternative non-limiting object of the present invention, there is provided a portable warming device that includes one or more lids or doors to substantially encapsulate one or more textile materials in the warming or inner cavity of the portable warming device.

In accordance with still yet an additional and/or alternative non-limiting object of the present invention, there is provided a portable warming device that substantially dry heats one or more textile materials.

In accordance with an additional and/or alternative non-limiting object of the present invention, there is provided a portable warming device that primarily warms or heats one or more textile materials by use of a conduction mechanism.

In accordance with still an additional and/or alternative non-limiting object of the present invention, there is provided a portable warming device that includes one or more drains in the warming or inner cavity of the portable warming device.

In accordance with yet an additional and/or alternative non-limiting object of the present invention, there is provided a portable warming device that includes one or more blowers to increase the rate at which one or more textile materials are warmed or heated.

In accordance with still yet an additional and/or alternative non-limiting object of the present invention, there is provided a portable warming device that includes a heating arrangement that terminates the heating of one or more textile materials after some predefined event.

In accordance with an additional and/or alternative non-limiting object of the present invention, there is provided a portable warming device that includes a heating arrangement that is powered by an internal and/or external power source.

In accordance with still an additional and/or alternative non-limiting object of the present invention, there is provided a portable warming device that includes aroma or scent generating arrangement.

In accordance with yet an additional and/or alternative non-limiting object of the present invention, there is provided a portable warming device that includes a light display generating mechanism.

In accordance with still yet an additional and/or alternative non-limiting object of the present invention, there is provided a portable warming device that includes an audio generating mechanism.

In accordance with an additional and/or alternative non-limiting object of the present invention, there is provided a portable warming device that is able to drain moisture from a warming or inner cavity of the portable warming device.

These and other advantages will become apparent to those skilled in the art upon the reading and following of this description taken together with the accompanying drawings.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF THE INVENTION

Figure 1:
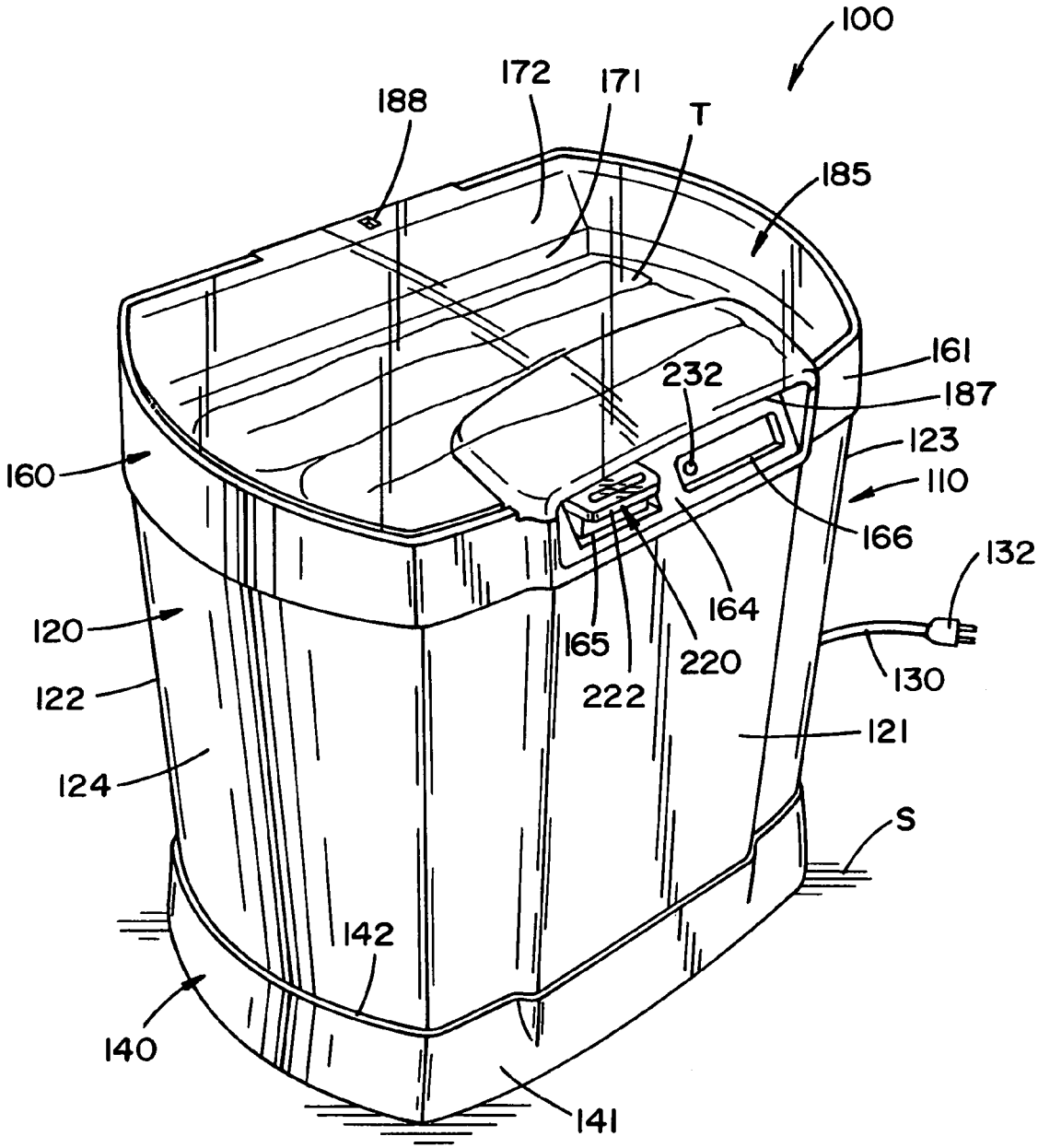
FIG. 1 is a front perspective view of one non-limiting embodiment of a towel warming device in accordance with the present invention.

Referring now to the drawings wherein the showings are for the purpose of illustrating embodiments of the invention only and not for the purpose of limiting the same, FIGS. 1-24 illustrate four (4) non-limiting embodiments of a towel warming device in accordance with the present invention. The portable warming device of the present invention will be described with particular reference to the warming of one or more standard bath towels; however, it will be appreciated that other or additional articles can be warmed by the portable warming device of the present invention. The portable warming device is designed to primarily dry heat one or more towels. The dry heating of the towels is primarily by a heating arrangement that includes a conduction heating mechanism as such as a resistance heating system (e.g., heating mat, heating coils, etc.); however, it will be appreciated that other or additional heating arrangements can be used to warm or heat the one or more towels.

The portable warming device illustrated in FIGS. 1-24 is a portable unit that can be relatively easily and conveniently transported by a user to various locations. The portability of the portable warming device is at least in part based on the size and weight of the portable warming device. In each of the four non-limiting embodiments of the portable warming device described in detail below, the portable warming device has a weight that is typically no more than about 20 lbs.; however, it can be appreciated that the portable warming device can have a weight that is greater than 20 lbs. The relatively low weight of the portable warming device enables an average adult to relatively easily move the portable warming device to various locations. The size of the portable warming device also enables an average adult to relatively easily grasp and move the portable warming device to various locations. In each of the four embodiments of the portable warming device, the portable warming device has a total volume of no more than about 3000 cubic inches; however, it can be appreciated that the portable warming device can have a total volume of that is greater than 3000 cubic inches. The portable warming device of the present invention will be described as a portable device that is typically placed on a generally flat surface (e.g., bathroom floor, atop a bathroom toilet, atop a bathroom countertop, atop a bathroom shelf, etc.), and/or is hung on a wall or other type of structure (e.g., towel rack, etc.); however, it will be appreciated that the portable warming device can be positioned in or on other locations. The portable warming device is useful in warming or heating a towel for use in drying a body after exposure to water, such as showering, bathing, swimming, enjoying a hot tub, etc., and for easing the transition from a warm environment to a relatively cooler environment. The portable warming device is advantageous in part due to the simplicity of operation and installation of the portable warming device, the low cost for manufacturing and retailing the portable warming device, and the relatively small and an unobtrusive size profile of the portable warming device.

Referring now to FIGS. 1-9, one non-limiting embodiment of the portable warming device 100 is illustrated. The portable warming device is designed to warming or heat one or more standard bath towels; however, it will be appreciated that other or additional articles can be warmed or heated by the portable warming device. The portable warming device is designed to be a portable unit that can be relatively easily and conveniently transported by a user to various locations. The portable warming device is designed and formed of materials that reduce the weight of the portable warming device. In one non-limiting configuration of the portable warming device, the portable warming device has a weight, when not including one or more towels or other articles, of no more than about 30 lbs., thus enabling an average adult user to relatively easily move the portable warming device to various locations. More typically, the portable warming device has a weight, when not including one or more towels or other articles, of no more than about 20 lbs., and even more typically the portable warming device has a weight, when not including one or more towels or other articles, of no more than about 10 lbs. The total volume of the portable warming device is also selected to enable the portable warming device to be relatively easily and conveniently transported by a user to various locations. In one non-limiting configuration of the portable warming device, the body of the portable warming device has a total volume of no more than about 5000 cubic inches. More typically, the body of the portable warming device has a total volume of no more than about 2500 cubic inches. Even more typically, the body of the portable warming device has a total volume of about 500-1600 cubic inches. In one non-limiting specific design of the portable warming device, the portable warming device has a weight, when not including one or more towels or other articles, of no more than about 7-8 lbs., a height of about 11-13 inches, a width of about 11-13 inches, and a depth of about 5-7 inches, and a total volume of about 605-1183 cubic inches.

Figure 9:
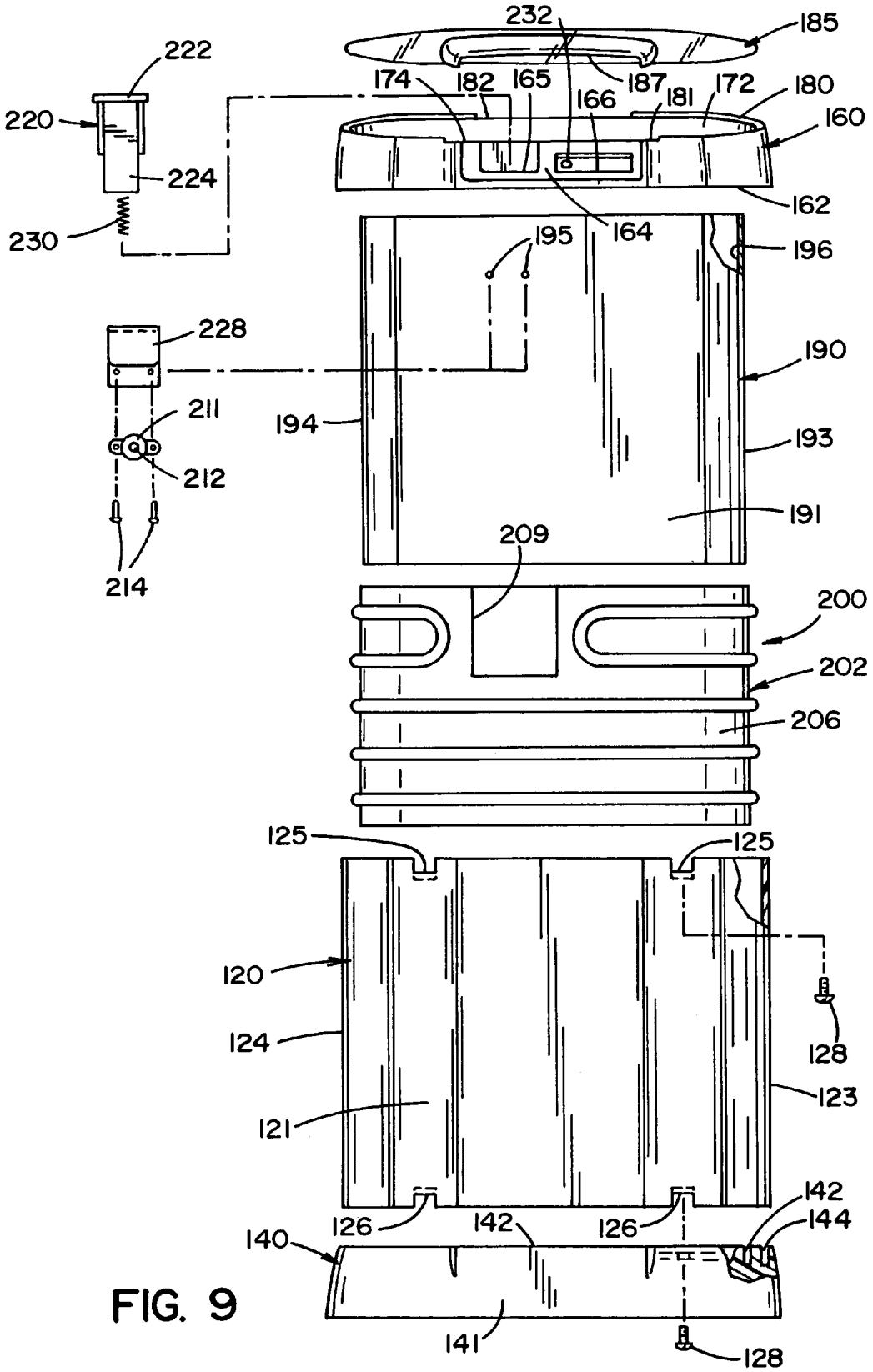
FIG. 9 is a partial exploded view of components of the towel warming device of FIG. 1.

The portable warming device 100 is shown to have a body 110 that is mostly defined by an outer shell 120, a bottom housing 140, a top housing 160, and a lid 185. The outer shell can be formed by a variety of the materials (e.g., aluminum, stainless steel, etc.). The outer surface of the outer shell can have a variety of colors and/or designs to enhance the aesthetics of the portable warming device. The outer shell can have a variety of configurations. As illustrated in FIGS. 1 and 9, the outer shell has a generally oval cross-sectional shape. The top and/or bottom housing can be formed of the same or different material from one another. The top and/or bottom housing can be formed of the same or different material from the outer shell. The top and/or bottom housing can have the same or a different shape from one another. The top and/or bottom housing can be formed of a variety of materials (e.g., polypropylene, etc.). The top and/or bottom housing can include a surface that facilitates in gripping the portable warming device by a user. The bottom housing can include a non-slick surface that inhibits or prevents the bottom housing from slipping and/or inadvertently moving on a generally flat surface S.

Figure 4:
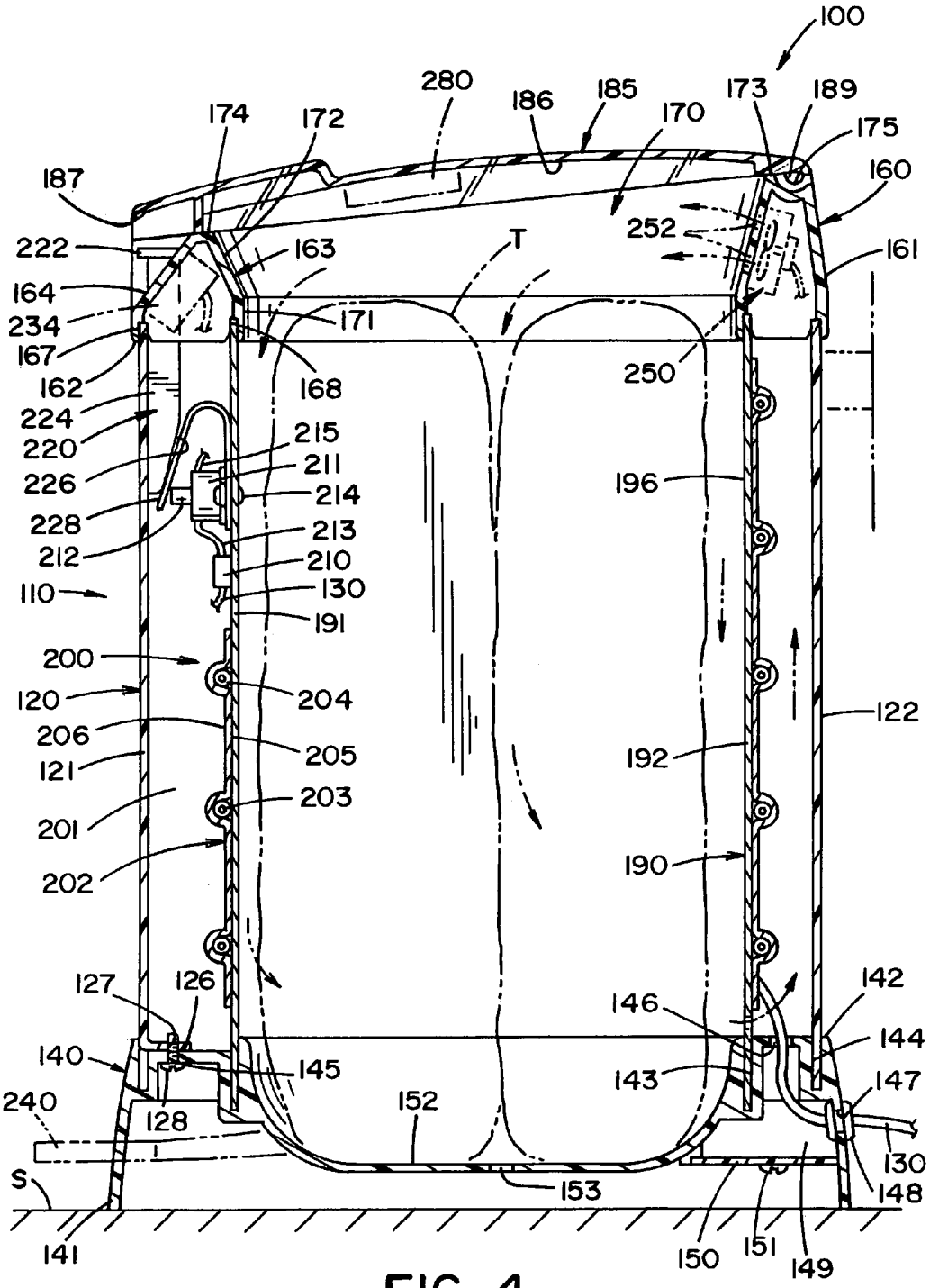
FIG. 4 is a cross-section view along line 4-4 of FIG. 3.

Referring now to FIGS. 4 and 9, outer shell 120 includes a front wall 121, a back wall 122, and side walls 123, 124 connected therebetween. The front and back walls are illustrated as generally parallel to one another; however, this is not required. The side walls are illustrated as having a generally arcuate shape; however, this is not required. In one non-limiting design, the outer shell is formed of a single sheet of stainless steel or a single piece of plastic. The thickness of the outer shell is generally about 0.03-0.25 inch; however, other thicknesses can be used. The outer shell 120 also includes a plurality of connection tabs 125 on the top region of the outer wall and a plurality of connection tabs 126 on the bottom region of the outer shell. Each of these connection tabs includes an opening 127 designed to receive a screw 128, rivet or the like. These connection tabs are used to secure the outer shell to the top and bottom housings as illustrated in FIGS. 4 and 9.

Referring again to FIGS. 4 and 9, bottom housing 140 is designed to support the portable warming device on a generally flat surface S. The bottom housing includes a bottom rim 141 that extends substantially about the complete bottom portion of the bottom housing. The base of the bottom rim can, but is not required to, include and/or be formed of a non-slip matter (e.g., rubber, etc.) so as to inhibit or prevent the bottom housing from slipping and/or inadvertently moving on the generally flat surface S. As illustrated in FIG. 4, when the outer shell is connected to the bottom housing, the outer surface of bottom rim 141 is positioned flush or nearly flush with the outer surface of the outer shell; however, this is not required. The top outer surface 142 of the bottom housing includes an inner slot 143 and an outer slot 144. Outer slot 144 is designed to receive a portion of the bottom edge of the outer shell as illustrated in FIG. 4. The inner slot is designed to receive a portion of the bottom edge of the inner shell 190 as also illustrated in FIG. 4.

Figure 5:
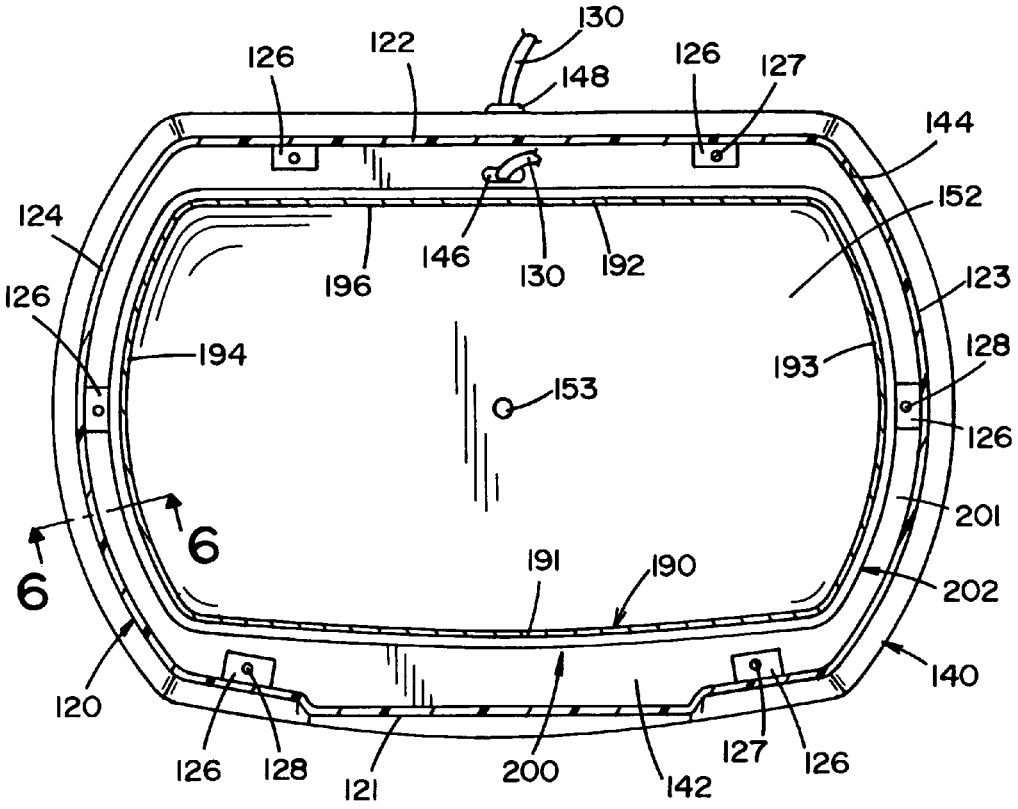
FIG. 5 is a cross-section view along line 5-5 of FIG. 3.

As illustrated in FIGS. 4 and 5, the top outer surface 142 of the bottom housing also includes a plurality of connection openings 145. The connection openings are designed to enable a portion of screw 128 to pass therethrough and engage opening 127 on connection tab 126 thereby securing the outer shell to the bottom housing. Top outer surface 142 also includes a cord opening 146 to enable an electric cord 130 to pass therethrough. Bottom rim 141 also includes a cord opening 147. A cord clip 148 secures the cord in position relative to cord opening 147. A cable cavity 149 is formed between cord openings 146 and 147. A cavity plate 150 which is secured in place by a screw 151 or rivet covers and limits access to the cable cavity.

As illustrated in FIG. 4, the mid-region 152 of the bottom housing has a recess or concave shape. The mid-region has a generally U-shape cross-section; however, the mid-region can have other cross-sectional shapes. A drain opening 153 is positioned generally centrally in the mid-region of the bottom housing. The concave shape of the mid-region facilitates in moisture collecting in the bottom housing to be directed to the drain opening. As can be appreciated, more than one draining can exist and/or the one or more drain openings can be positioned in other locations in the bottom housing. The bottom housing is generally a one piece component formed from a plastic material such as, but not limited to, polypropylene.

Figure 3:
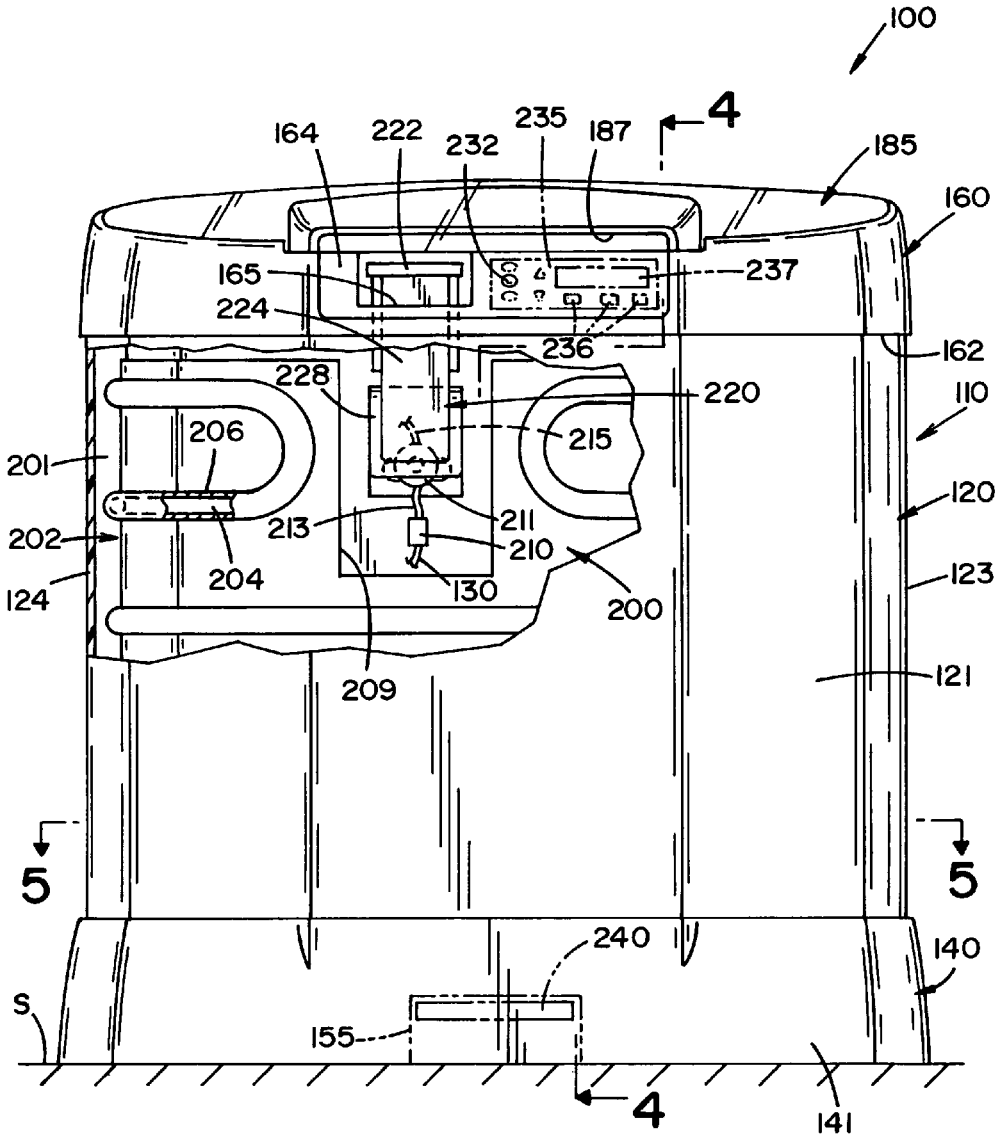
FIG. 3 is a front elevation view of the towel warming device of FIG. 1 wherein a portion of the outer and internal structures are cut away.

Referring now to FIGS. 3 and 4, an optional foot pedal 240 is illustrated in phantom lines. The foot pedal can be used to open and/or close lid 185. The foot pedal, when used, can be connected to the bottom housing so as to cause the lid to be mechanically and/or electrically opened. The foot pedal can be designed to move lid 185 to an open position when the user depresses foot pedal 240. The removal of pressure from the foot pedal can be used to cause or allow the lid to move to a closed position. As illustrated in FIG. 3, when a foot pedal is used, a portion of the bottom rim 141 can be removed to form a pedal slot 155 so as to enable the pedal to be depressed downwardly.

Figure 8:
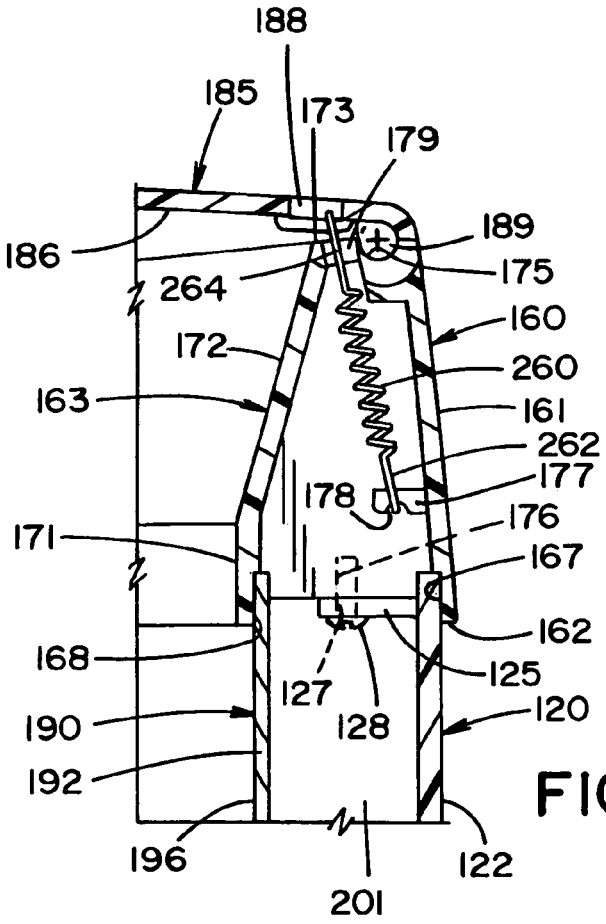
FIG. 8 is an enlarged view of a spring system for the lid of the portable warming device of FIG. 1.

Referring again to FIGS. 4 and 9, top housing 160 includes an outer rim 161, a bottom outer surface 162 and an inner rim 163. The outer rim 161 substantially defines the outer side surface of the top housing. As illustrated in FIG. 9, the top and bottom housings have generally the same shape; however, this is not required. As illustrated in FIG. 4, when the outer shell is connected to the top housing, the outer surface of outer rim 161 is positioned flush or nearly flush with the outer surface of the outer shell; however, this is not required. The inner surface of outer rim 161 includes an indent or slot 167 that is designed to engage and/or receive the top edge portion of the outer shell. As illustrated in FIG. 8, the bottom outer surface 162 includes a plurality of openings 176 that are designed to receive a portion of screw 128, rivet or the like. As partially illustrated in FIG. 9, screw 128 is designed to be partially inserted through opening 128 in connection tab 125 and to engage and be secured in the opening in bottom outer surface 162, thereby securing the top portion of outer shell 120 to the top housing 160.

As illustrated in FIG. 1, a front side of the top housing includes a control surface 164. The control surface is shown to be a sloped surface that extends between the upper surface of outer rim 161 to the top surface of inner rim 163; however, this is not required. Positioned in the control surface 164 are one or more slots and/or openings 165, 166. Opening 165 is shown to provide an opening for an activation switch which is used to activate the heating arrangement of the portable warming device as will be described in more detail below. Opening 166 is illustrated as providing an opening for a light indicator and/or control panel that is used to provide information regarding the operation of the heating arrangement of the portable warming device as will be described in more detail below.

As illustrated in FIG. 4, the inner rim 163 includes an indent or slot 168 that is designed to engage and/or receive the top edge portion of the inner shell 190. The inner shell can be secured to the top housing by frictional engagement arrangement, by an adhesive, and/or by a mechanical fastener (e.g., screw, rivet, etc.).

As best illustrated in FIG. 4, the inner rim includes a lower portion 171 that is in a generally parallel relationship with a corresponding opposite side of the rim. The upper portion 172 of the inner rim is shown to flare outwardly to create a funnel-type shape for the interior opening 170 that is substantially defined by the outer surface of the inner rim. The flare angle of the inner rim at the front region of the portable warming device is shown to be greater than the flare angle of the inner rim at the back region of the portable warming device; however, this is not required. The flare angle of the inner rim at the front region of the portable warming device is about 10-60° and the flare angle of the inner rim at the back region of the portable warming device is about 3-40°. The funnel shaped interior opening is used to facilitate in the insertion and/or removal of a towel from the warming or inner cavity of the portable warming device.

Figure 2:
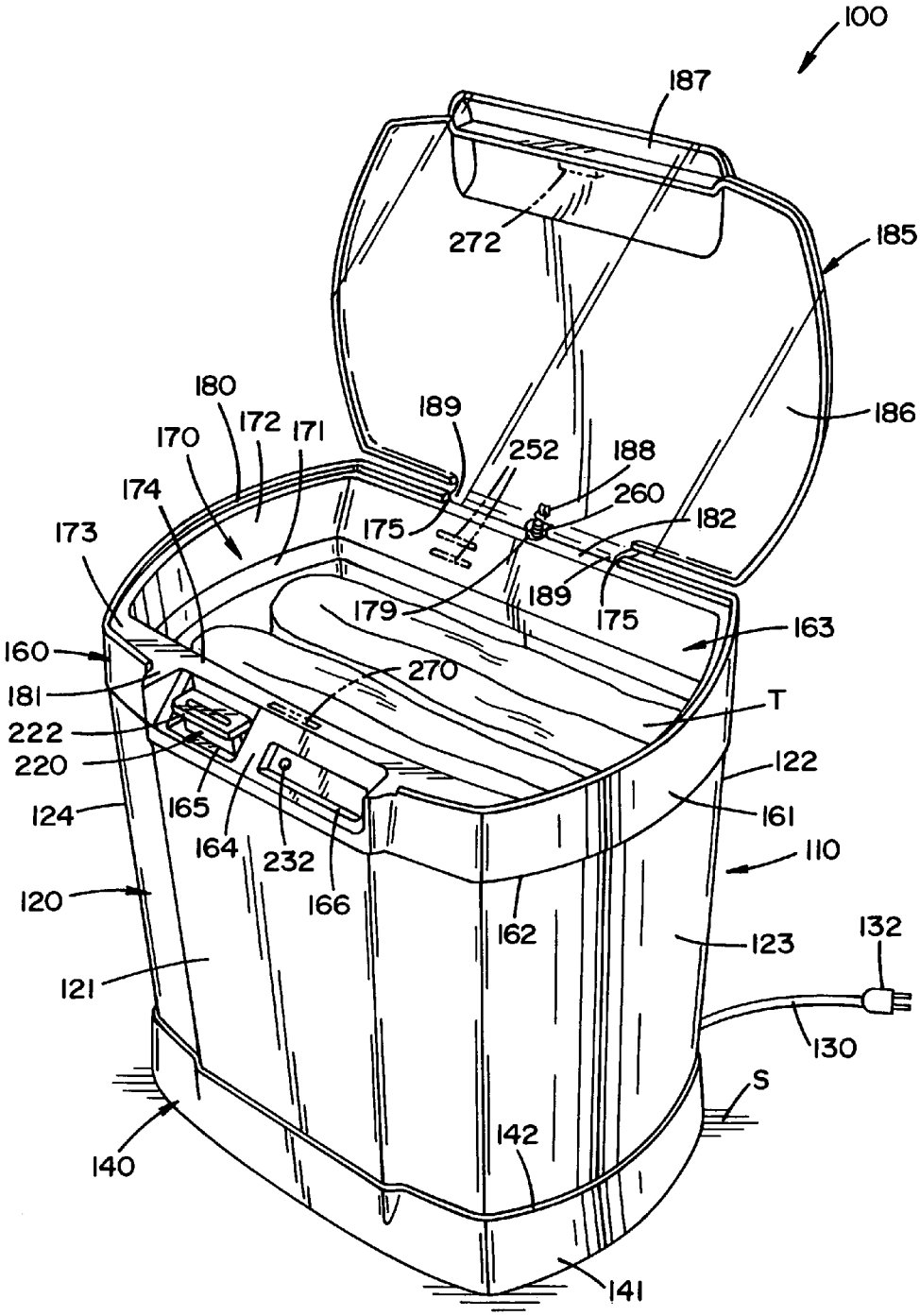
FIG. 2 is a front perspective view of the towel warming device of FIG. 1 wherein in the lid is in an open position.

The top surface 173 of the top housing includes a lid landing 174 and two lid connector openings 175 at the back region of the portable warming device. The lid landing terminates against an inner wall 180 to define a lid cavity that receives the lid in a closed position. The lid connector is best illustrated in FIGS. 2, 4 and 8. The lid connector openings are designed to receive a pivot node and/or pin in the lid as will be described in more detail below.

As illustrated in FIG. 8, a spring connector 177 having a spring notch 178 is positioned on the inner surface of outer rim 161. The spring connector is used to enable a spring 260 to be connected between the top housing 160 and the lid 185 so as to facilitate in the opening and/or closing of the lid. The top surface 173 of top housing 160 also includes a spring slot 179 to enable a portion of the spring to pass through the top housing. The front and back portions of the upper outer rim 161 include a lid handle slot region 181 and a lid mount region 182. The lid handle slot region 181 enables the lid to fully close as shown in FIG. 1. The lid mount region 182 enables the lid to pivotly rotate on the top housing.

Referring now to FIGS. 2 and 4, a blower can be optionally used with the portable warming device to facilitate in the heating of a towel in the warming or inner cavity of the portable warming device. A blower 250 is shown in phantom lines as positioned in the top housing. As can be appreciated, the blower, when used, can be alternatively or additionally be positioned in the lid, the bottom housing and/or the space between the inner and outer shell. The blower, when used, is typically integrated with the heating arrangement; however, this is not required. When the blower is positioned in the top housing, one or more vent openings 252 are positioned in the inner rim of the top housing. The vent openings enable air to be blown into the warming or inner cavity of the portable warming device as indicated by the arrows shown in FIG. 4. As can be appreciated, the inner shell and/or bottom housing can also include one or more vent openings. The top housing is generally a one piece component formed from a plastic material such as, but not limited to, polypropylene.

Referring now to FIG. 1, lid 185 is illustrated as in a closed position, thereby substantially encapsulating a towel T in the warming or inner cavity of the portable warming device. Lid 185 is illustrated in FIG. 1 as formed of a transparent or semi-transparent material so that a user can view of the contents of the warming or inner cavity when the lid is in the closed position. As can be appreciated, the lid can be formed of a material that is not transparent or semi-transparent. The lid is generally a one piece component formed from a plastic material such as, but not limited to, polypropylene.

Referring now to FIG. 2, the lid is illustrated in the open position. When the lid is in the open position, a user can insert or remove towel T from the warming or inner cavity of the portable warming device. As illustrated in FIG. 1, lid 185 is shaped so that the edge of lid 185 can properly rest on lid landing 174 of top housing 160. Lid 185 includes an inner surface 186. The inner surface 186 of the lid, the inner surface of inner rim 163 of the top housing, the inner surface 196 of the inner shell 190, and the top surface of the mid-region 152 of the bottom housing 140 substantially define the warming or inner cavity of the portable warming device.

As best shown in FIG. 2, lid 185 includes a handle 187 that enables a user to conveniently grasp the lid and thereby move the lid to the open and/or closed position. Referring now to FIG. 8, the lid includes a spring opening 188 that is designed to engage one end of spring 260. Spring 260 includes a first end 262 that is secured to spring notch 178 of spring connector 177. The second end 264 of spring 260 is secured to spring opening 188. As described above, the spring is used to partially counterbalance the weight of the lid so as to facilitate in the opening and/or closing of the lid. The spring can also or alternatively be used to facilitate in maintaining the lid in the open position when a user is inserting or removing a towel from the warming or inner cavity of the portable warming device. The back side of lid 185 includes two pivot nodes 189 that are designed to be telescopically received in lid connector openings 175. As can be appreciated, a pin can be used with or substituted for the two pivot nodes 189. As can also be appreciated, other or additional arrangements can be used to pivotly or rotatable connect the lid to the upper housing. The pivot nodes enable the lid to pivot between an open and closed position.

Referring now to FIG. 2, the lid can optionally include a lid closing arrangement. The lid closing arrangement can be or include one or more magnets; however, other or additional arrangements can be used to maintain the lid in a closed position. As shown in FIG. 2, a magnet or magnet receiving member 270, represented in phantom lines, is positioned on the front portion of lid landing 174 of top housing 160. A second magnet or magnet receiving member 272 is positioned in the region of handle 187. The two magnets or a magnet and a magnet receiving member are used to maintain the lid in a closed position. As can be appreciated, the lid closure arrangement can include other or additional mechanisms to maintain the lid in a closed position (e.g., hook and loop fastener, latch, clip, etc.).

Referring now to FIG. 4, the lid can optionally include an aroma or scent generating arrangement. As shown in FIG. 4, the aroma or scent generating arrangement 280 is positioned on the lid 185. As can be appreciated, the aroma or scent generating arrangement can be positioned in other or additional location on the portable warming device. The aroma or scent generating arrangement, when used, can produce a fresh and/or pleasing scent to the towel in the warming or inner cavity of the portable warming device and/or produce a fresh and/or pleasing scent in the region about the portable warming device. The aroma or scent generating arrangement, when used, can be used in conjunction with or independent from the heating arrangement and/or blower of the portable warming device.

Referring now to FIGS. 4, 5 and 9, the inner shell 190 includes a front wall 191, a back wall 192, and two side walls 193, 194. As shown in FIGS. 4 and 5, front and back walls 191, 192 are positioned generally parallel to one another; however, this is not required. Sides wall 193, 194 are illustrated as having a generally arcuate shape; however, this is not required. In one non-limiting design, the inner shell is formed of a single sheet of a heat conducting, corrosion resistant material such as, but not limited to, aluminum. The thickness of the inner shell is generally about 0.03-0.25 inch; however, other thicknesses can be used. As illustrated in FIGS. 4 and 9, the inner shell includes two openings 195 that are used to secure one or more components of a heating arrangement to the outer surface of the inner shell as will be described in more detail below. As can be appreciated, openings 195 can be eliminated when one or more components of a heating arrangement are secured to the outer surface of the inner shell without need of the openings. The size and shape of the inner shell are selected so that the inner shell can fit within the outer shell as shown in FIG. 4. The size of the inner shell in combination with the lid and top surface of the bottom housing is selected so that at least one standard sized bath towel can be positioned in the warming or inner cavity when the lid is in a closed position. Typically the warming or inner cavity is sized so that no more than three standard sized bath towels can be positioned in the warming or inner cavity and the lid can be easily moved to and maintained in a closed position. In one non-limiting arrangement, the inner shell and bottom housing are designed such that the warming or inner cavity when the lid in a closed position has a volume of less than about 2000 cubic inches, and more typically about 300-900 cubic inches.

Figure 6:
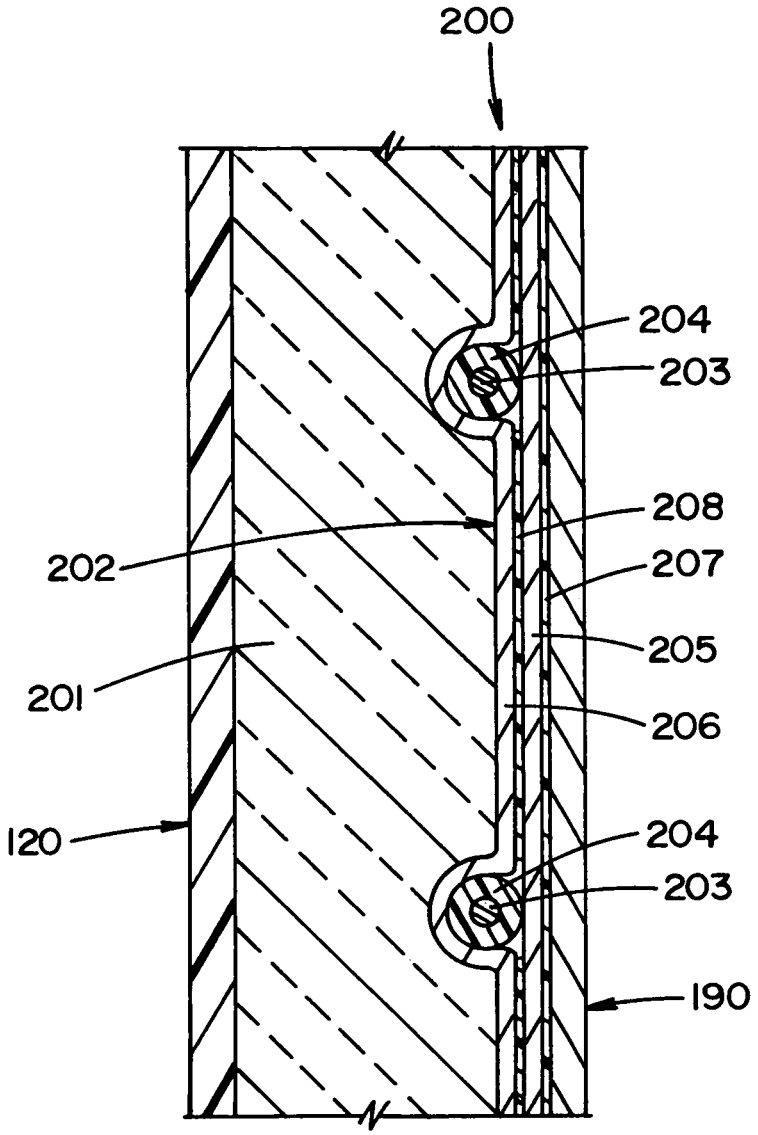
FIG. 6 is an enlarged cross-section of a portion of the heating system as shown along line 6-6 in FIG. 4.

Referring now to FIGS. 1, 3, 4, 6, 7 and 9, the portable warming device 100 includes a heating arrangement 200. The heating arrangement is designed to substantially dry heat one or more towels in the warming or inner cavity of the portable warming device. As illustrated in FIG. 4, many of the components of the heating arrangement are positioned in a heating cavity 201 that is partially defined by the space between the outer surface of the inner shell and the inner surface of the outer shell. The heating arrangement includes a heating mat 202 that is secure to and/or positioned in close proximity to a majority of the outer surface of the inner shell. Generally, the heating mat is secured to at least about 60% of the outer surface of the inner shell, and typically at least about 70-99% of the outer surface of the inner shell. As best illustrated in FIG. 6, the heating mat is secured to the outer surface of the inner shell and spaced from the inner surface of the outer shell. The heating mat can be secured to the outer surface of the inner shell by a variety of arrangements (e.g., adhesive, heat melting, rivets, etc.). The close proximity of the heating mat to the outer surface of the inner shell facilitates in the heat transfer from the heating mat to the inner shell and to the warming or inner cavity. The space between the heating mat and the inner surface of the outer shell reduces the amount of heat that is transferred to the outer shell due to the insulating effect of air. As can be appreciated, an insulating material, not shown, can be inserted between the heating mat and the inner surface of the outer shell to reduce the amount of heat transferred to the outer shell; however, this is not required. As illustrated in FIG. 9, heating mat 202 has generally the same shape as the outer surface of inner shell 190 so as to cover substantially a majority of the outer surface of the inner shell; however, this is not required. The heating mat 202 includes a cutout portion 209 to provide a space for one or more of the components of the heating arrangement to be secured to the outer surface of the inner shell as illustrated in FIG. 3 and discussed in more detail below.

Referring now to FIG. 6, the heating mat 202 includes one or more electrically conductive wires 203 that are at least partially coated in one or more layers of an electrical insulting material 204. Non-limiting examples of electrically conductive wires 203 include copper or aluminum wires. The electrically conductive wires generate heat as current flows though the wires (i.e., resistance heating). The electrical insulating material is typically not a heat insulating material. Non limiting examples of electrical insulating material 204 include silicone. The conductive wire encased in the electrical insulting material is sandwiched between two layers of heat conducting material 205, 206. Non-limiting examples of the heat conducting material includes metal tape. The layers of heat conducting material can be formed of the same or different material. The layers of heat conducting material can have the same or different heat conducting properties. For instance, heat conducting material 205 can have greater heat conducting properties than heat conducting material 206 so as to promote heat transfer to the inner shell and to reduce the amount of heat transfer to the outer shell; however, this is not required. As illustrated in FIG. 6, heat conducting material 205 is secured to the outer surface of inner shell by an adhesive 207. Likewise, heat conducting material 206 is secured to electrical insulating material 204 and heat conducting material 205 by an adhesive 208. As mentioned above, heat conducting material 205 can be secured to the outer surface of inner shell, and/or heat conducting material 206 can be secured to electrical insulating material 204 and/or heat conducting material 205 in other or additional ways (e.g., mechanical fastener, melt bonding, etc.). The heating mat is designed to heat the towel in the warming or heating cavity to at least about 130° F. within about 2-10 minutes. As such, the heating mat is designed to generate about 200-1000 watts of energy. The heating mat is also designed to heat the inner surface of the inner shell to a temperature of at least about 130° F. and no more than about 330° F. Temperatures that exceed 330° F. can result in damage to certain types of materials. In one non-limiting arrangement, the heating mat is designed to heat the inner surface of the inner shell to a temperature of about 180-250° F. within about 2-8 minutes. The heat mat can also be designed to heat a towel in the warming or inner cavity to a sufficiently high temperature so as to disable, kill and/or eliminate one or more foreign objects (e.g., bacteria, mold, mildew, fungus, allergens, dust mites, viruses, etc.) on the towel; however, this is not required.

Figure 7:
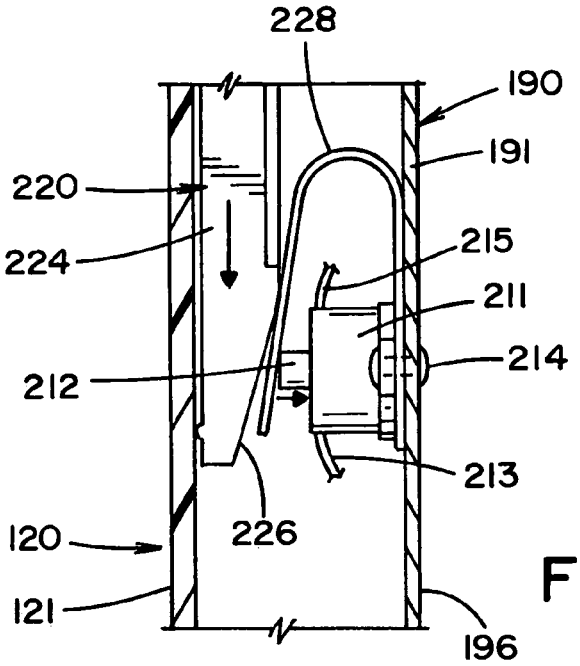
FIG. 7 is an enlarged view of the actuator switch of the heating system as shown in FIG. 4.

Referring now to FIGS. 3, 4 and 7, heat arrangement 200 includes a control circuitry that controls the flow of current through power cord 130 to heating mat 202. The control circuitry includes a thermal fuse 210 that is connected to power cord 130. The thermal fuse is designed to cut the current to the heating mat when the temperature of the heating mat exceeds a certain temperature (e.g., 290° F., etc.) The thermal fuse thus protects the towel in the warming or inner cavity from becoming too hot and potentially damaging the towel in the warming or inner cavity and/or protects damage to one or more components of the heating arrangement (e.g., heating mat, etc.) and/or other components of the portable heating device (e.g., plastic components used in the portable warming device, etc.). Control circuitry also includes a thermostat 211 having an activation button 212. The thermostat is connected to the thermal fuse by wire connector 213. The thermostat is connected to the outer wall of inner shell by two rivets 214. The two rivets are positioned through openings 195 in inner shell 190 to connect with thermostat 211 as illustrated in FIG. 7. As illustrated in FIG. 3, the thermostat 211 is connected to the inner shell in the region of the cutout portion 209 of heating mat 202. Thermostat 211 is electrically connected to heating mat 202 by cord connector 215. The thermostat 211 is designed to allow current to flow to the heating mat 202 when the thermostat is activated by the depressing of activation button 212. Once the thermostat is activated, the thermostat allows current to flow to the heating mat until the thermostat detects a certain predetermined temperature (e.g., 250° F., etc.) and then terminates the electric current to the heating mat. As can be appreciated, current to the heating mat can be controlled in other or additional ways.

Referring now to FIGS. 1 and 4, a user activation button 220 is shown to be positioned in opening 165 on top housing 160. Activation button 220 includes a flange 222 that enables a user to easily push the activation button. The activation button also includes an engagement arm 224 that includes a sloped end portion 226 designed to engage a button spring 228 on thermostat 211. As best illustrated in FIG. 7, when activation button 220 is pushed downwardly as indicated by the arrow, the sloped end portion 226 causes the bottom spring 228 to engage activation button 212 on thermostat 211 and thereby cause electric current to flow into heating mat 202 when adaptor end 132 of electric cord 130 is plugged into a wall outlet. When the user releases flange 222 on the activation button, a spring 230 causes the activation button to move upwardly to its original position.

Referring now to FIGS. 1 and 2, the heating arrangement 200 includes one or more visual indicators 232 that are positioned in opening 166 on top housing 160. As shown in FIG. 1, a single light indicator 232 (e.g., LED light, etc.) is positioned in opening 166. The light indicator is designed to light when current is being directed to heating mat 202. As can be appreciated, the light indicator can be used to indicate other or additional functions of the heating arrangement 200. Referring now to FIGS. 3 and 4, a control box 234 drawn in phantom lines can be optionally used. The control box, when used, can be used in conjunction with light indicator 232, or be substituted for a light indicator. The user panel 235 of the control box includes a plurality of user controls 236 (e.g., switches, etc.) and displays 237 to operate one or more functions of the portable warming device and/or to provide the user information about the portable warming device and/or about one or more features of the portable heating device. The control box can include various electric circuits, microprocessors, fuses, thermostats, timers, clocks, tuners, players, speakers, microphones, remote control receivers/transmitters, audio/video connectors, etc. Non-limiting examples of function of the portable warming device that can be controlled by and/or viewed by a user on the control box include, but is not limited to, 1) indicating that the heating mat is activated and/or deactivated, 2) indicating that the portable warming device is connected to a power source, 3) indicating that one or more heating elements are cooling down and/or heating up, 4) indicating when an article is properly heated, 5) indicating when one or more articles can or should be inserted and/or removed from the warming or inner cavity, 6) indicating when the lid can or should be opened or closed, 7) indicating that lid is open or closed, 8) indicating the proper operation and/or a malfunction of the heating arrangement, 9) indicating that one or more articles in the warming or inner cavity have been heated to some temperature and/or indicating the inner cavity temperature, 10) illuminating one or more controls and/or displays on the portable warming device, 11) indicating that one or more controls on the portable warming device have been activated, deactivated, etc., 12) indicating that the heating mat was activated but no articles where placed in the warming or inner cavity, 13) indicating that the heating mat was activated but articles in the warming or inner cavity were not removed after completion or partial completion of one or more heating cycles, 14) indicating that the lid was not opened after completion or partial completion of one or more heating cycles, 15) indicating that one or more components of the portable warming device are not working, are not properly working, and/or require service and/or replacement, 16) indicating that a power source is recharging, needs recharging and/or needs to be replaced, 17) providing a temperature display and/or illuminating a temperature display to display ambient temperature and/or temperature in warming or inner cavity, 18) providing a clock and/or illuminating a clock to indicate time, date, alarm settings, etc., 19) proving a timer and/or illuminating a timer, 20) proving a user interface and/or illuminating a user interface to that is used by a user to view and/or interface with one or more actual and/or preprogrammed operations of the heating arrangement (e.g., setting warming temperature, setting time of heating, setting the number of heating cycles, setting activation/deactivation time of the heating mat, displaying remaining time of heating, displaying time since current to heating mat terminated, displaying length of time an article has been heated, displaying length of time since an article remained in warming and heating cavity after termination of heating mat, etc.), 21) indicating that a lid was not opened prior to activation of one or more heating cycles, 22) controls for opening and/or closing the lid, 23) controls for operating a radio, cd player, DVD player, MP3 player, etc., 24) controls for illuminating the portable warming device and/or activating a light display on the portable warming device, 25) controls for activating/deactivating a blower, 26) controls for activating/deactivating an aroma or scent generating arrangement, 27) connectors for data entry and/or transfer, 28) a LED monitor, 29) TV tuner, and/or 30) audio and/or video connectors. As can be appreciated, there can be other or additional features of the control box.

The heating arrangement can include one or more safety devices (e.g., circuit breaker, fuse, GFCI, power cord ground, etc.) to enhance the operation of the portable warming device, however, this is not required.

The heating arrangement can include a latch or other arrangement on lid 185 to cause the heating mat to deactivate when the lid is not in the closed position; however, this is not required. As can also be appreciated, the heating arrangement can include a button or other type of detector used to deactivate the heating mat when the bottom housing is not properly placed on a generally flat surface (e.g., portable warming device laid on its side and/or tipped over, etc.); however, this is not required.

A non-limiting method for warming a towel by portable warming device 100 will now be discussed. The towel warming is generally positioned in a location desired by the user so as to provide convenient access to the warmed or heated towel (e.g., bathroom countertop, atop a toilet tank, on a bathroom floor, etc.). The electric cord 130 is connected to a source of electrical current, such as a wall outlet. The user warms or heats a towel by folding, shoving or otherwise pacing the towel in the warming or inner cavity of the portable warming device. The towel is positioned in the warming or inner cavity by opening lid 185 by grasping the 187 and lifting the lid into the open position as illustrated in FIG. 2. The opening of the lid to the open position provides access to the warming or inner cavity of the portable device. After the lid is moved to an open position, the user is able to insert a towel into the warming or inner cavity of the portable warming device. Due to the relatively large access aperture provided by the opening of the lid, the towel can be inserted into the warming or inner cavity in any desired manner (e.g., neatly folded and carefully positioned within the warming or inner cavity, haphazardly stuffed into the warming or inner cavity, etc.). Regardless of the configuration of the towel when being positioned in the warming or inner cavity, the towel is at least partially enveloped or encapsulated by the inner surface 196 of the inner shell 190 and the top surface of the mid-region 152 of the bottom housing 140 so as to enable the heating mat 202 to warm or heat the towel. Once the towel is positioned in the warming or inner cavity, the lid is moved to the closed position as illustrated in FIG. 1 to substantially encapsulate the towel in the warming or inner cavity of the portable warming device. Once the lid is closed, the user suitably activates the portable warming device by depressing flange 222 on activation button 220. The depression of the activation button causes the sloped end portion 226 on the activation button to engage and move bottom spring 228 to engage activation button 212 on thermostat 211 and thereby cause electric current to flow into heating mat 202. The activation of the thermostat allows current to flow to the heating mat until a predetermined temperature is detected by the thermostat. As the heating mat heats the inner surface of the inner shell, the heat from the inner surface of the inner shell is conducted through the wall of the inner shell to the outer surface of the inner shell so as to elevate the temperature of the outer surface. The outer surface of the inner shell that is in contact with the towel in the warming or inner cavity dry heats the towel. Once the thermostat detects a predetermined elevated temperature, the thermostat cuts the flow of current to the heating mat. As can be appreciated, the thermostat can include, be used with a timer, and/or be substituted for a timer that allows current to flow to the heating mat for a predetermined period of time, and/or the timer can be manually set by the user. If the timer can be manually set by the user, the user can set the timer for a period of time that the user believes he/she will be in the shower, bath, etc. After the user activates the portable warming device, the user then proceeds to take a shower, bath, etc. After the user exits the shower, bath etc., the user opens the lid and removes the warmed or heated towel from the warming or inner cavity of the portable warming device and dries oneself with the warmed towel. The heating mat can be designed to quickly warm or heat a towel after activation of the actuator switch; however, this is not required. In such an arrangement, a user can still enjoy a warmed or heated towel even if the user takes a short shower, bath, etc. The heating mat can also be designed to retain a significant amount of heat after the flow of current has been discontinued to the heating mat so as to continue to warm or heat a towel after current has been terminated to the heating mat; however, this is not required. This design of the heating mat provides a warmed or heated towel to a user ever if the user takes an extended shower, bath, etc. which exceeded the time period that the current was directed to the heating mat. The enclosure formed by the closed lid, the inner shell and the bottom housing also retain heat in the warming or heating cavity thereby facilitating in maintaining the towel at a warm temperature after current has been terminated to the heating mat. After use of the portable warming device, the user can leave the portable warming device in the same location, or move the portable warming device to another location (e.g., linen closet, under a bathroom vanity, etc.).

Referring now to FIGS. 10-13 another non-limiting embodiment of the portable warming device is illustrated. The portable warming device 300 is disposed in a generally magazine rack-like configuration and is designed to heat a towel 304 by maintaining the towel in proximity to a heating arrangement associated with the portable warming device.

Figure 10:
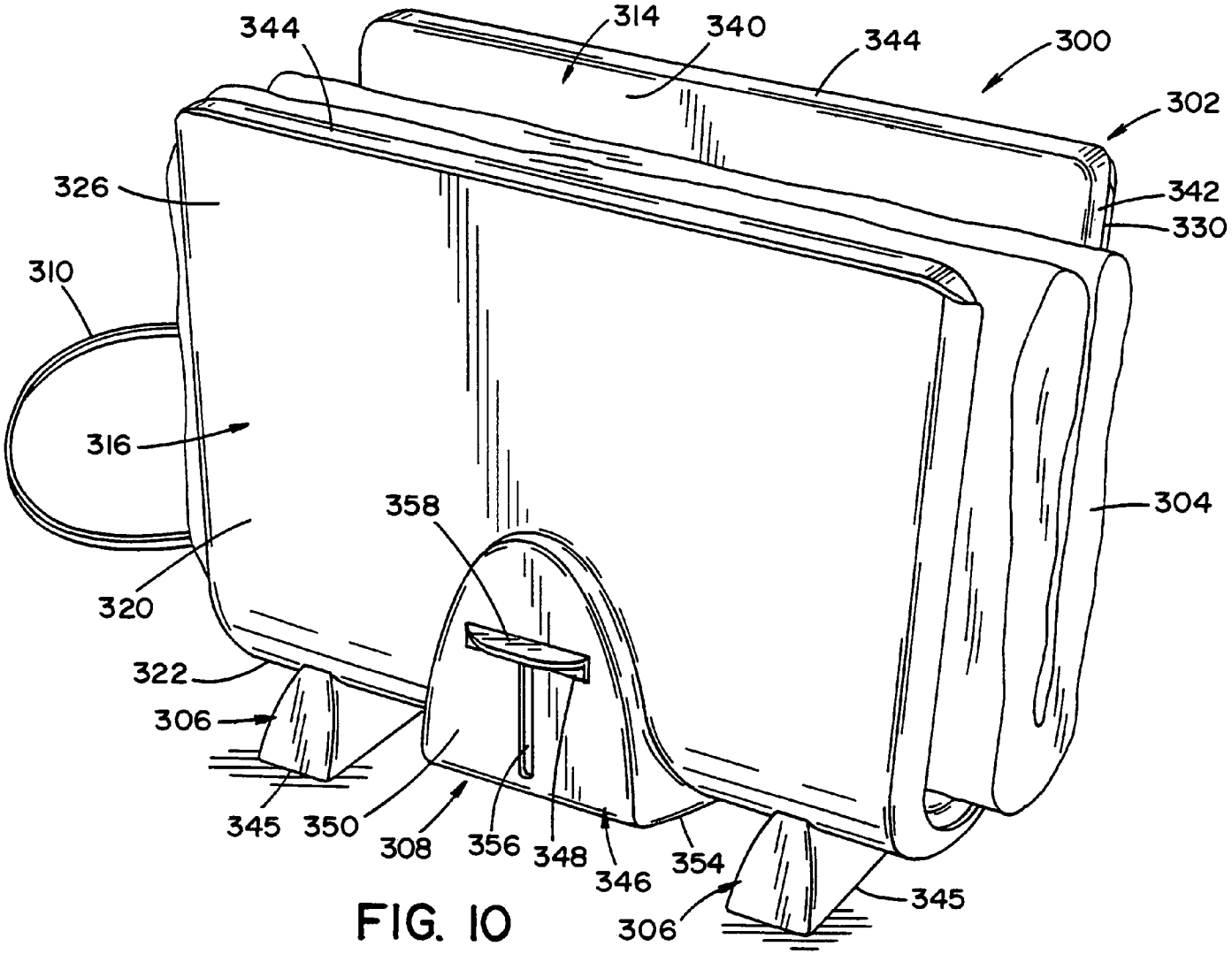
FIG. 10 is a front perspective view of another non-limiting embodiment of a towel warming device in accordance with the present invention.
Figure 11:
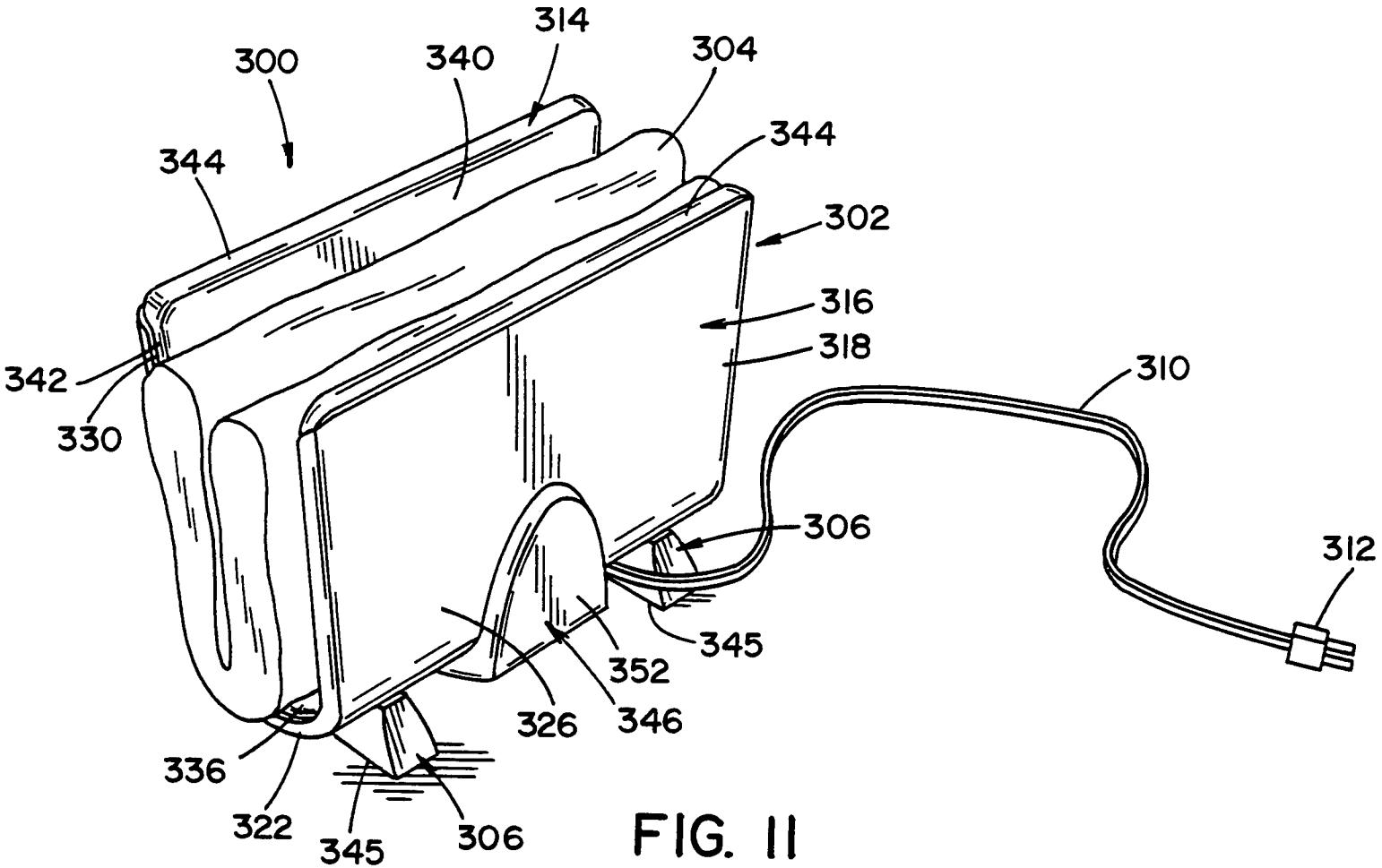
FIG. 11 is a rear perspective view of the towel warming device of FIG. 10.

Portable warming device 300 includes a support frame 302 that has a generally U-shape. The support frame is designed to support a towel between the upright vertical walls 318, 320 of the support frame. The support frame is maintained in an upright position by two base supports 306. Referring now to FIGS. 10 and 11, the support frame 302 includes an outer shell 316, and an inner shell 314 that is supported by the outer shell. A heat mat, not shown is positioned between the inner and outer shells. The inner shell has an inner surface 340 that is designed to contact the surface of a towel 304 when the towel is positioned in the portable warming device. The heating mat is designed to transfers heat to the inner shell which in turn transfers heat to towel 304 when towel 304 is maintained in support frame 302.

The outer shell 316 includes opposed and generally vertical walls 318, 320 that are maintained in a spaced apart relationship by a connecting portion 322. The vertical walls 318, 320 and the connecting portion 322 of the outer shell 316 can be of unitary construction; however, this is not required. The vertical wall and connection portions can be constructed from a plastic, metal, etc. which materials have the desired thermal, and durability properties. The vertical walls 318, 320 and connecting portion 322 can be of any suitable dimension suitable to holding one or more standard towels 304. In one non-limiting arrangement, the vertical walls 318, 320 and connecting portion 322 have a length that is slightly shorter than the length of a standard bath towel, resulting in a portion of the towel 304 being laterally exposed from one or both of the side ends of portable warming device 300 when the towel 304 is positioned in support frame 302. This particular design of the support frame enables a user to remove and insert towel 304 in support frame 302 without having to touch the support frame. As can be appreciated, the size of the support frame can be greater so that the ends of the towel do not extend beyond the sides of the support frame.

The connecting portion 322 is illustrated as a generally arcuate member disposed in a manner that translates its curvature to the vertical walls 318, 320. The curvature of the connecting portion maintains vertical walls 318, 320 in a spaced apart and in a slightly angularly offset relationship to each other. In this arrangement, the bottom portions of vertical walls 318, 320 that are connected to the connecting portion 322 are spaced apart a distance that is less than the distance separating the upper portions of vertical walls 318, 320. This arrangement of the vertical walls facilitates in the insertion of towel 304 into the support frame. As can be appreciated, the vertical walls can be equally spaced apart from one another or spaced apart in other orientations with respect to one another.

Figure 12:
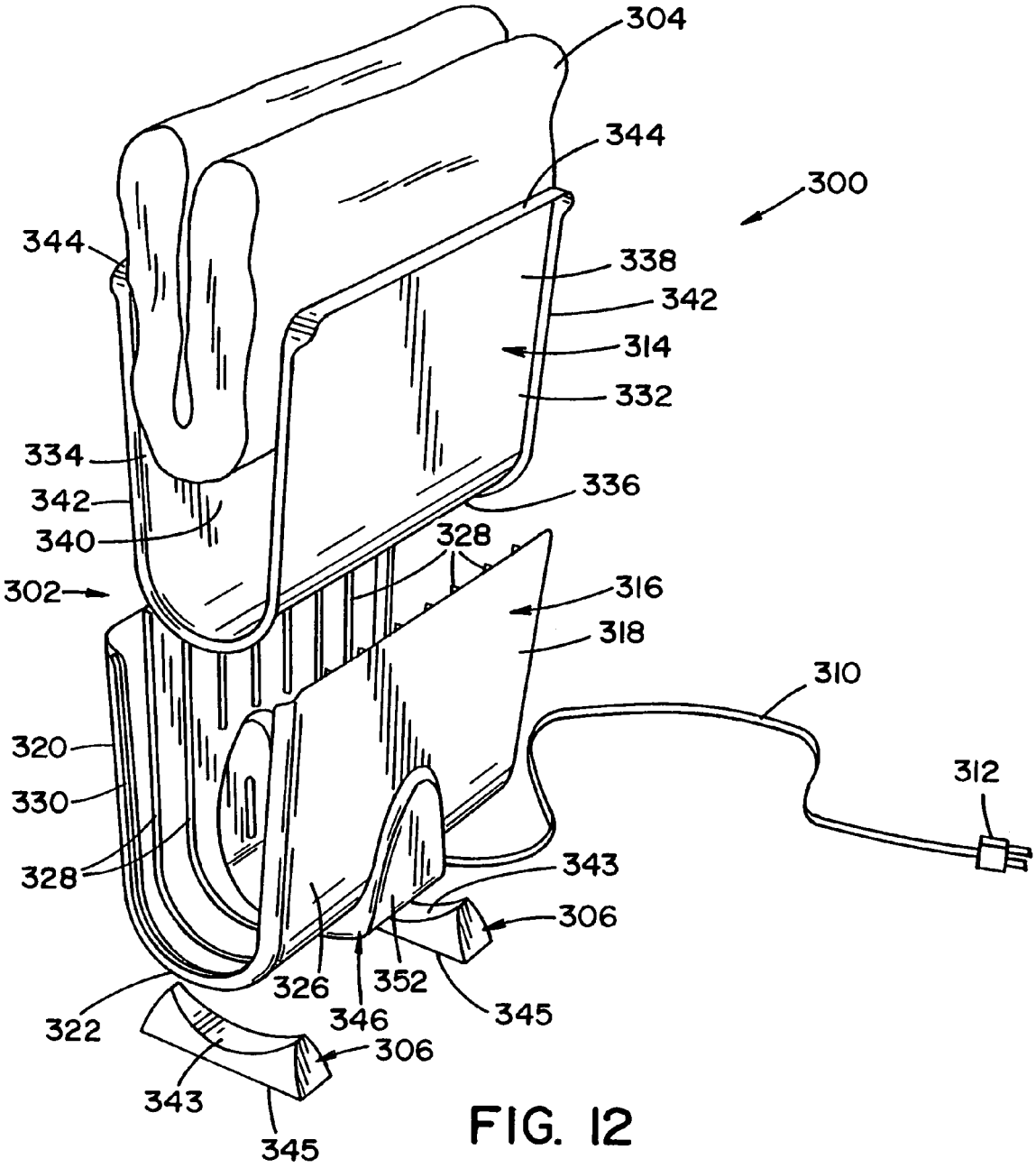
FIG. 12 is a partial exploded view of components of the towel warming device of FIG. 10.

As best illustrated in FIG. 12, vertical walls 318, 320 are spaced apart distance from one another to causes a towel 304 to at least slightly compressed when positioned between the vertical walls. The compression of the towel between the vertical walls 318, 320 can increase the transfer of heat to the towel 304 generated by the heating mat.

Referring again to FIG. 12, inner surface 324 of outer shell 316 includes a plurality of rib-like protrusions 328 extending along substantially the entire inner surface 324. The rib-like protrusions 328 extend vertically along the inner surface 324 of each of the vertical walls 318, 320 and are continuously disposed along the inner surface 324 of connecting portion 322. The rib-like protrusions 328 are used to at least partially increase the structural rigidity of outer shell 316. The rib-like protrusions also are used to maintain the heating mat in a spaced apart relationship from the inner surface 324 of outer shell 316 so as to reduce the rate of heat transfer from the heating mat to outer surface 326 of outer shell 316. The rib-like protrusions 328 can also be used to facilitate in the ventilation of air in the space between the heating mat and the inner surface of the support member. The ventilation of the air also can reduce the rate of heat transfer from the heating mat to outer surface 326 of outer shell 316. The outer shell 316 can include one or more ventilation apertures, not shown, to facilitate in the ventilation of the air; however, this is not required. As can also be appreciated, an insulation material, not shown, can be used to reduce the rate of heat transfer from the inner shell to outer surface 326 of outer shell 316; however, this is not required. As can be appreciated, heat conducting material and/or heat insulating material, not shown, can be used to reduce and/or to customize the heat profile if the inner shell.

As illustrated in FIGS. 10-13, the inner shell 314 supports the towel in the portable warming device. The inner shell 314 is illustrated as having a shape that is generally complementary to the shape of the outer shell 316. As illustrated in FIG. 12, inner shell 314 has a generally U-shaped configuration designed to fittingly engage in general association with the inner surface 324 of outer shell 316. Similar to outer shell 316, inner shell 314 includes a pair of opposed and generally vertical walls 332, 334 and a connecting portion 336 which maintains the vertical walls in a spaced apart relationship from one another. The vertical walls 332, 334 and the connecting portion 336 can be of a unitary construction; however, this is not required. Inner shell 314 also includes an outer surface 340 and an inner surface 338. The vertical walls 332, 334 and connecting portion 336 can be any suitable dimensions particularly suited for the accommodation of a towel. In one non-limiting configuration, the vertical walls 332, 334 and connecting portion 336 have a length that is shorter than the length of a conventional bath towel, thereby resulting in a portion of the towel 304 being laterally exposed at one or both ends of the inner shell. As can be appreciated, the vertical walls 332, 334 and connecting portion 336 can have a length that is equal to or greater than the length of a conventional bath towel. When the vertical walls 332, 334 and connecting portion 336 have a length that is slightly shorter than the length of a conventional bath towel, the portion of the towel extending from one or more ends of the inner shell are exposed so as to assist a user in removing the towel 304 from the portable warming device. The inner shell is constructed from material (e.g., metal, plastics, or other heating conducting material) having the desired thermal properties to conduct heat to the towel positioned in the portable warming device.

As illustrated in FIG. 12, the connecting portion 336 of inner shell 314 is an arcuate and generally semispherical member disposed in a manner that translates its curvature to the vertical walls 332, 334. As can be appreciated, connecting portion can have other shapes. The curvature of connecting portion 336 maintains vertical walls 332, 334 in spaced apart and slightly angularly offset relationship to each other. As such, the bottom portions of the walls 332, 334 (i.e., those portions generally near the connecting portion 336) are generally spaced apart by a distance that is smaller than the distance separating upper portions of vertical walls 332, 334 (i.e., those portions generally distal to the connecting portion 336). This arrangement suitably facilitates the insertion of towel 304 into the interior of inner shell 314. This configuration creates an inner shell having a funnel-like, upwardly tapered characteristic. As can be appreciated, the connecting portion 336 can be shaped so as to cause vertical walls 332, 334 to be generally equally spaced from one another and generally parallel to one another. As can also be appreciated, the vertical walls can have other spacing relationships from one another.

The connecting portion 336 is constructed from a suitable material, such as an appropriate metal, plastic, etc., that imparts a degree of resilient flexibility and biasing on the connection portion 336; however, this is not required. In one non-limiting arrangement, the vertical walls 332, 334 are spaced apart and angularly offset in a manner that enables a towel 304 to be placed between the vertical walls and to be compressed by the inner surface 334 of the inner shell. The compressive force applied to the towel 304 by the inner shell can increase the transfer rate of heat from the inner shell to the towel 304. Although not shown, the outer surface 338 of the inner shell 314 can include a plurality of perforations used to increase the rate of heat transfer from the heating mat to the towel positioned in the inner shell.

In one non-limiting configuration, a spaced region exists between the inner surface 338 of the inner shell 314 and the inner surface 324 of the outer shell 316 when the inner shell and outer shell are connected together. The spaced region functions in part as a situs for the positioning of the heating mat. In one particular non-limiting arrangement, the heating mat is disposed along substantially the entire surface of the space region, i.e., along substantially the entirety of the inner surface 338 of the inner shell 314. As illustrated in FIG. 12, the outer surface 340 of the inner shell forms the warming or inner cavity of the portable warming device. As illustrated in FIGS. 10 and 11, towel 304 is folded in the warming or inner cavity of the portable warming device. The folding of the towel in a compact fashion promotes the heat transfer from the inner shell to the towel. As can be appreciated, the towel need not be folded, and can be inserted into the warming or inner cavity of the portable warming device in a variety of ways. FIGS. 10 and 11 also illustrate that the warming or inner cavity of the portable warming device is sized to receive a single standard bath towel; however, it will be appreciated that the warming or inner cavity of the portable warming device can be sized to hold more than one standard sized bath towel. The warming or inner cavity is also configured to enable liquid (e.g., water, etc.) to drain from the warming or inner cavity. During the operation of the portable warming device, a user may place a damp towel or other type of article in the warming or inner cavity. Over time, moisture from the damp towel can begin to accumulate in the bottom portion of the warming or inner cavity that is defined by the top surface of connection portion 336. Moisture that begins to collect in the bottom portion of the warming or inner cavity is able to drain out of the bottom portion of the warming or inner cavity by moving to the side edge of the connection portion 336 and then dripping out of the warming or inner cavity. The removal of moisture from the warming or inner cavity can result in a dryer feel to the warmed or heated towel. The removal of moisture from the warming or inner cavity can also or alternatively reduce or inhibit discoloration and/or damage to the warming or inner cavity and/or other components of the portable warming device. Although not shown, the connection portion 336 can include one or more opens or slots that can function as a drain; however, this is not required.

Referring now to FIG. 12, inner shell 314 includes a lip 342 that runs along substantially the entire length of each of the lateral edges of the inner shell. The lip 342 is generally perpendicular to inner surface 338 of the inner shell; however, this is not required. The inner shell 314 also is shown to have a rim 344 extending along substantially the entire length of the upper edge of the inner shell. The rim is also generally perpendicular to inner surface 338; however, this is not required. The rim may or may not be continuous with the lip 342. Outer shell 316 is shown to include a channel 330 that runs along substantially the entire length of each of the lateral edges of the outer shell. The channel is designed to receive at least a portion of lip 342 when the inner and outer shells are connected together.

Figure 13:
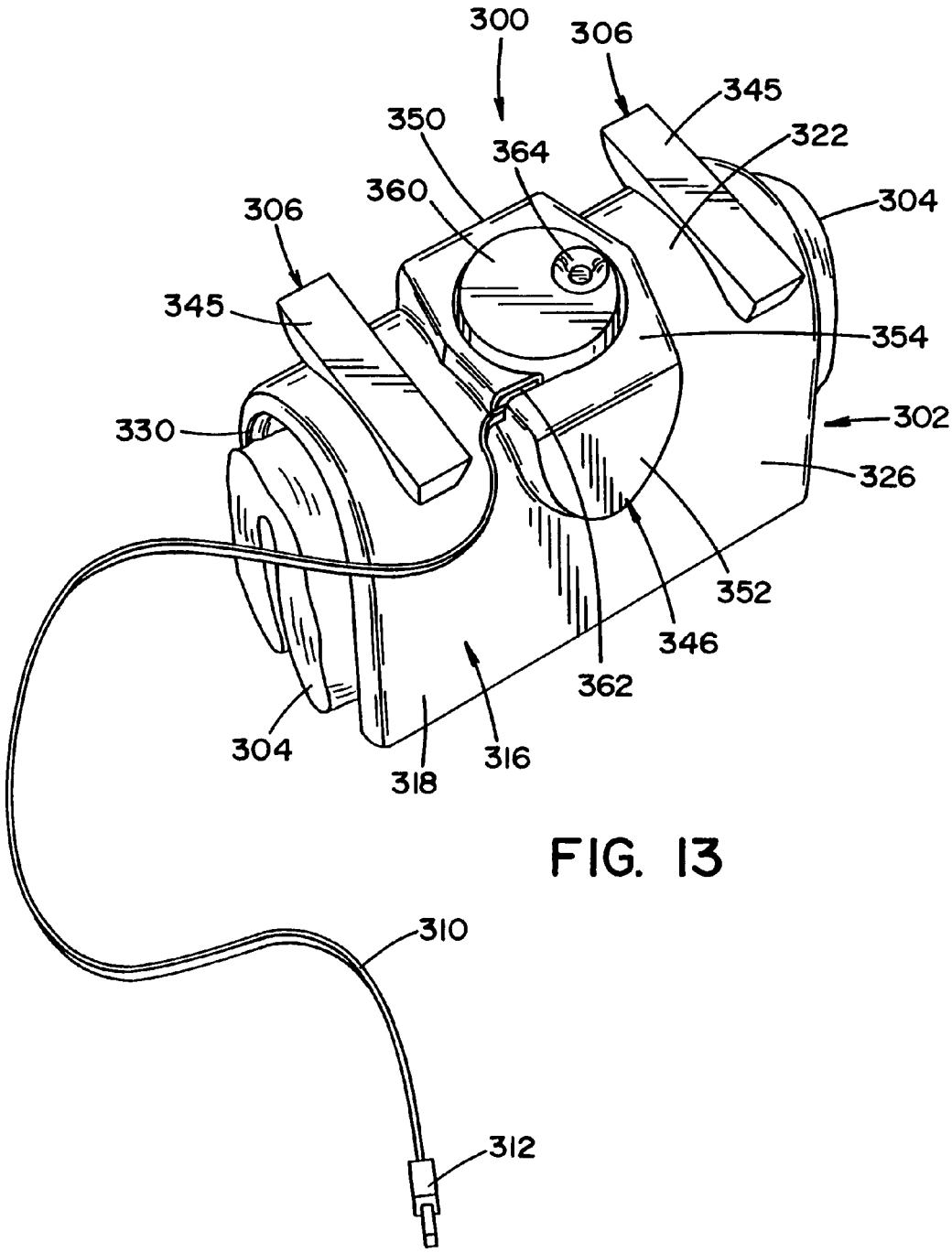
FIG. 13 is a bottom view of the towel warming device of FIG. 10.

Referring now to FIG. 10, the portable warming device 300 generally includes one or more bases 306 associated to maintaining the portable warming device in a desired orientation. As illustrated in FIGS. 12 and 13, base 306 is provided as a foot-like member designed to maintain the outer shell 316 in an upright, generally vertical orientation. Base 306 is shown to be an elongate generally rectangular member having a surface engaging portion 345 and a top engaging portion 343. The surface engaging portion 345 is generally flat and adapted to be positioned on an appropriate surface, such as ground, carpet, countertop, etc. and may additionally include features (e.g., rubber pad, etc.) thereon to increase the frictional engagement between the base and the surface upon which the base is positioned. The top engaging portion 343 includes an arcuate recessed portion designed to receive the arcuate connecting portion 322 of outer shell 316. Typically the outer shell is secured (permanently or non-permanently) to the one or more base 306 (e.g., adhesive, bolts, screws, rivets, etc.). As can be appreciated, the bases can have other configurations. As can further be appreciated, the portable warming device can be absent the one or more bases. It can still be further appreciated that the portable warming device can include one or more connectors to enable the portable warming device to be mounted on a wall, suspended from a towel rack, etc.

Referring now to FIG. 10, the portable warming device 300 includes a heating arrangement that includes control circuitry, generally denoted by numeral 308. The control circuitry is designed to receive user-generated actuation of the portable warming device 300. As can be appreciated, the portable warming device can be simply designed so that when the portable warming device is connected to a power source, the portable warming device is activated, and when the portable warming device is disconnected from the power source, the portable warming device is deactivated. In this particular configuration, the control circuitry is very simple or non-existent. Control circuitry 308 is positioned in a control housing 346. The control housing is associated with the outer shell 316. As can be appreciated, the control circuitry can be positioned between the inner and outer shell and/or in outer locations on the portable warming device, thereby partially or fully eliminating the control housing. The control circuitry 308 is designed to be in communication with and/or connected to the heating mat. In one non-limiting configuration, the control housing 346 is provided as a member generally complementary in shape to the outer shell 316 and includes a pair of generally vertical walls 350, 352, and a connecting portion 354 which maintains the vertical walls 350, 352 in generally spaced apart configuration. In this particular configuration, the control housing 346 is associated with a bottom portion of the outer surface 326 of outer shell 316. As can be appreciated, the connecting portion can be a separate component from the outer shell or integrally formed with the outer shell.

The control circuitry 308 includes an electrical power cord 310 coupled to the heating mat. The power cord 310 is designed to interface with a source of electrical current. In one non-limiting configuration, the power cord 310 is a ribbon-like generally flat cord that is designed to interface with a conventional wall-mounted source of electrical current through a conventional male plug adaptor 312.

The control housing 346 is illustrated as including a user actuable switch 348 which the user interacts with to operate the portable warming device 300. The user actuable switch 348 is designed to be communicatively coupled to the heating mat in a manner that actuation of the switch 348 causes electric current to flow to the heating mat. The user actuable switch is illustrated as a mechanical switch; however, it can be appreciated that other types of switches can be used. In one non-limiting arrangement, the user actuable switch 348 is coupled to a timer element, not shown. In this arrangement, the actuation of the user actuable switch causes the heating mat to heat for a predetermined period of time. Referring again to FIG. 10, the user actuable switch 348 is disposed along a slot 356 fashioned in the control housing and the user actuable switch is designed to be moveable in a linear fashion throughout the slot 356. In operation, a user grasps a protruding flange 358 on the user actuable switch 348, depresses the protruding flange 358 so as to move the user actuable switch downwardly in slot 356. The flange can be sized and configured for hand and/or foot actuation by a user. Once the user actuable switch 348 is depressed, the heating mat becomes actuated and emits heat therefrom. A timer (e.g., mechanical timer, electronic timer, etc.), when used, allows current to flow to the heating mat for a predetermined amount of time. After the user actuable switch has been depressed, the user releases the protruding flange to enable the user actuable switch to return to its original position by a spring or other type of device. In one non-limiting arrangement, a timer is designed to gradually return the user actuable switch 348 to its beginning position as the predetermined period of time elapses. In this non-limiting arrangement, once the switch 348 has returned to its beginning position, electric current ceases to be supplied to the heating mat. As can be appreciated, other or additional control arrangements can be used to enable the user to activate and/or deactivate the heating mat.

The heating mat, not shown, is used as the heating source to heat the inner surface 340 of the inner shell 314. The heating mat is designed to generate sufficient heat to heating the inner surface 340 of inner shell 314 to a desired elevated temperature. Typically the heating mat is designed to generate sufficient heat to heating the inner surface 340 of inner shell 314 to a temperature of at least about 120° F., and more typically about 150-300° F. As can be appreciated, when the towel is heated by inner surface 340 to an elevated temperature, foreign objects (e.g., bacteria, mold, mildew, fungus, allergens, dust mites, viruses, etc.) on the towel can be disabled, killed and/or eliminated from the towel; however, this is not required. In one non-limiting configuration, the heating mat is an electrical resistance heating mat. The heating mat is designed to generate sufficient heat to heat the inner surface 340 of inner shell 314 to a desired elevated temperature in less than about 10 minutes; however, it can be appreciated that other time limits can be used. The heating mat generally includes a top layer, a bottom layer, and a heating element disposed therebetween. The top layer and bottom layer can be generally flat, thin members, which generally mirror each other, and constructed of an electrically insulating and durable material. Non-limiting examples of materials that can be used for the top and/or bottom layers include, but are not limited to, vinyl (e.g., Duraflex™, available from Duraflex, Tewkesbury, England), acrylonitrile-butadiene-styrene (ABS) plastic, polyvinylchloride (PVC), polyarylate, polycarbonate, high density polyethylene (HDPE), acrylic-styrene-acrylonitrile (ASA), polystyrene (PS), styrene-acrylonitrile (SAN), polyarylsulfone, and any suitable heat transferable and electrically insulating material. Non-limiting examples of commercially available heating mats that can be used in the portable warming device include heating mats available from Calesco, those available under the tradename Performance Master Advantage Plus, and the like. The heating mat can include one or more layers of protective heat conducting material (e.g., plastic tape, metal tape, fiberglass material, etc.); however, this is not required. The protective heat conducting material, when used, can be designed to capture, absorb and/or reflect radiant energy from the heating mat and at least partially directed such energy to the inner shell; however, this is not required. The protective heat conducting material, when used, can also be designed to provide additional electrical and/or heat insulating properties to the heating mat; however, this is not required. In another non-limiting configuration, the heating mat includes a heating element that is at least partially coated in an electrically insulating material. Non-limiting examples of electrically insulating materials include, but are not limited to, vinyl (e.g., Duraflex™, available from Duraflex, Tewkesbury, England), acrylonitrile-butadiene-styrene (ABS) plastic, polyvinylchloride (PVC), polyarylate, polycarbonate, high density polyethylene (HDPE), acrylic-styrene-acrylonitrile (ASA), polystyrene (PS), styrene-acrylonitrile (SAN), polyarylsulfone, silicones, and any suitable heat transferable and electrically insulating material. The heating element and electrically insulating material can be covered on one or more sides by one or more layers of a protective heat conducting material (e.g., plastic tape, metal tape, fiberglass material, etc.); however, this is not required. The electrically insulating material, when used, can also be designed to capture, absorb and/or reflect radiant energy from the heating element at least partially directed such energy to the inner shell; however, this is not required. The electrically insulating material, when used, can also be designed to provide additional electrical and/or heat insulating properties to the heating element; however, this is not required.

The heating element of the heating mat generally includes one or more elongate heating wires (e.g., copper, tin, lead, platinum, alloys thereof, etc.) positioned in the heating mat. The one or more heating wires can be sinuously looped throughout the heating mat in a manner that maximizes the amount of the one or more heating wires disposed in the heating mat, thereby increasing its heat-emitting capacity; however, it can be appreciated that other orientations of the one or more heating wires in the heating mat can be used. The heating element is designed to be electrically coupled to control circuitry 308. The control circuitry is designed to directed electric current into the heating element to cause the heating element to generate heat, as known to one of ordinary skill in the art.

As mentioned above, the control circuitry 308 couples the heating element to a source of electrical current so as to enable a user to control and/or direct operation of the heating mat. As mention above, the heating mat is generally designed to be couplable to a source of electrical current through a conventional electric cord 310 electrically associated with the heating mat in a well-known manner. The electric cord 310 generally includes at one end a plug adaptor 312 and/or other type of connector designed to be connected to a source of electric current (e.g., 120V AC, one or more batteries, etc.). The electric cord generally is provided in sufficient length to facilitate in positioning of the portable warming device 300 in any desired position and/or location. The electrical cord 310 can be designed to be suitably retractable into the body of the portable warming device to simplify storage of the device and/or to reduce the amount of unneeded cord being exposed from the portable towel device; however, this is not required. As can be appreciated, the portable warming device can include one or more projections or receptacles designed to receive the electric cord; however, this is not required. Such one or more projections or receptacles can be used to wrap the electric cord on the portable warming device, store the electrical cord in the portable warming device, and/or detachably connect the electric cord to the portable warming device; however, this is not required.

The control circuitry 308 can include one or more buttons, switches, program surfaces, etc. to enable a user to control and/or direct the operation of the heating element; however, this is not required. The one or more control elements generally include one or more mechanical and/or electrical mechanisms to enable a user to activate and/or deactivate the flow of electrical current to the heating element. The one or more mechanical and/or electrical mechanisms can include a user interface that is designed to receive user input and translate the received user input into the activation and/or deactivation of the flow of electric current to the heating mat; however, this is not required. As indicated above, the user interface can be any appropriate device such as, but not limited to, a conventional on/off switch, a pushbutton switch, a rotary dial, a slidable mechanism, programming buttons, programming screen, etc. The control circuitry 308 can include one or more mechanical and/or electrical mechanisms (e.g., clock, timer, electric circuit, etc.) designed to terminate the flow of electric current to the heating mat after a certain period of time; however, this is not required. In one non-limiting arrangement, one or more mechanical and/or electrical mechanisms can include a timer that is activated in response to the actuation of a user interface and causes electrical current to flow to the heating mat for a predetermined period of time. Upon the expiration of the predetermined period of time, the flow of electrical current to the heating mat is discontinued. The predetermined period of time can be an automatic predetermined time period and/or be a user selected time period. One non-limiting configuration of a user selected time period arrangement includes a timer having a switch, knob, rheostat-like slide, etc. that enables a user to manually select or input a particular time setting (e.g., five minutes, ten minutes, thirty minutes, etc.). Another non-limiting configuration of a user selected time period arrangement includes a programmable interface designed to receive user-generated instructions for operation of the portable warming device. The programmable interface can be designed to enable a user to activate and/or deactivate the heating element in the heating mat and/or to preprogram the automatic activation and/or deactivation the heating element in the heating mat at a future time period and/or period time periods. In one non-limiting example, some users follow well-established routines such as, for example, always entering the shower at 6:30 A.M. during workdays. Accordingly, the programmable interface can be designed to be programmed with user generated instructions to automatically activate the heating element at a certain time (e.g., 6:30 A.M. during workdays, etc.), for a certain duration of time (e.g., 5 minutes, 10 minutes, etc.), and/or warm or heat the towel to a certain temperature (e.g., 200° F., 250° F., etc.). The programmable interface includes any conventionally known user programmable mechanism (e.g., hardwired circuit, data processing device, etc.).

The control circuitry 308 can also be designed to provide information to a user; however, this is not required. For example, the control circuitry can include a visual and/or audible arrangement (e.g., light, meter, beeping noise, song, buzzer noise, etc.) designed to inform the user that 1) the heating element has been activated and is in the process of warming or heating a towel, 2) the heating element is deactivated, 3) the heating element is cooling down, etc. As can be appreciated, the visual and/or audible arrangement can be used to provide the user with other or additional information. The visual and/or audible arrangement can be in close proximity to written indicium (e.g., "heating", "on/off", "power on", "power off", "cooling down", "ready", "error", etc.) to provide the user information about the visual and/or audible arrangement.

As mention above, the control circuitry 308 can include a user interface to enable a user to select a desired temperature to warm or heat the towel; however, this is not required. Non-limiting examples of such a user interface can include, but is not limited to, a rotary dial that enables a user to select a plurality of available temperatures, an electronic and/or programmable interface that enables a user to select a plurality of available temperatures, etc.

The control circuitry 308 can include one or more user interface protective elements designed to govern various aspects of the operation of the portable warming device; however, this is not required. Non-limiting examples of user interface protective elements include, but are not limited to, activation/deactivation key, activation/deactivation combination or code, etc. The user interface protective elements can be used to inhibit or prevent the unauthorized operation of the portable towel warming device.

The control circuitry 308 can include one or more user integrated protective elements designed to govern various aspects of the operation of the portable warming device; device; however, this is not required. Non-limiting examples of integrated protective elements include, but are not limited to, timer, a temperature cutoff switch, ground fault circuit interrupter (GFCI) components, general components designed to resist the deleterious impact of water, etc.

Referring now to FIG. 13, the bottom surface of the control housing 346 includes a spooling mechanism 360 that is designed to spooling the electrical cord 310 into the control housing. The spooling mechanism 360 is designed to reduce the amount of electrical cord 310 that exposed during operation and/or storage of the portable warming device. The spooling mechanism 360 can be rotatably mounted to a bottom surface of the connecting portion 354 of the control housing 346. The spooling mechanism also includes a spool (not shown) that is designed to receive the cord 310. The spooling mechanism 360 also includes an engagement surface 364, such as a hole member, that is designed to receive a user's finger therein to enable a user to rotate the spooling mechanism 360 and spool the cord 310 thereby. The control housing 346 suitably includes a channel 362 therein for passage of the electrical cord 310. As can be appreciated, the spooling mechanism can be spring operated, motor operated, and/or be designed in other manners. As can also be appreciated, the spooling mechanism can be fully eliminated and/or substituted with a cord storage cavity or other type of cord storing arrangement.

Portable warming device 300 can be positioned in a variety of locations (e.g., counter top, floor, commode seat or top, tub deck, shelf, chair seat, bench, table, toilet seat, toilet tank top, etc.). When the portable warming device is positioned on a generally flat surface, the base 306 interfaces with the generally flat surface to support the portable warming device in a desired position. As can be appreciated, the outer shell 316 can include one or more connectors (e.g., one or more arm-like members, straps, clips, mount openings, etc.) to enable the portable warming device to be fastened to a wall, hung from a towel, etc.

The portable warming device 300 can include an aroma or scent generating arrangement to impart a desirable aroma to the towel and/or to release a desired aroma in the area about the portable warming device; however, this is not required. In one non-limiting arrangement, a volatile material (e.g., liquid, gel, solid, etc.) is used to release volatile substances (e.g., perfume, air fresheners, etc.) into the towel and/or in the atmosphere surrounding the portable warming device. The aroma or scent generating arrangement can be used independently and/or in conjunction with the heating arrangement of the portable warming device to cause controlled and/or uncontrolled release of the volatile substances.

The portable warming device 300 can include one or more blowers to facilitate in the warming or heating of the one or more towels positioned in the inner or warming cavity of the portable warming device; however, this is not required.

The inner cavity of the portable warming device 300 can be eliminated and the heating mat can be used to form the inner surface of the warming or inner cavity; however, this is not required. In this arrangement, the heating mat is secure to the rib-like protrusions 328 and/or inner surface 324 of the outer shell 316.

The heating mat configuration described in the embodiments discussed in regard to FIGS. 1-9 can be also or alternatively used in the portable warming device 300.

A non-limiting method for warming a towel by portable warming device 300 will now be discussed. The towel warming device is generally positioned in a location desired by the user so as to provide convenient access to the warmed or heated towel (e.g., bathroom countertop, atop a toilet tank, on a bathroom floor, etc.). The electric cord 310 is connected to a source of electrical current, such as a wall outlet. The user warms or heats a towel 304 by folding and pacing the towel in the warming or inner cavity of the portable warming device. The insertion of the towel 304 may or may not require a small degree of force due to the biasing of vertical walls 350, 352. Once the towel is positioned in the warming or inner cavity, protruding flange 358 on user actuable switch 348 is depressed by the user so as to move the user actuable switch downwardly in slot 356. The pressing of actuable switch 348 causes electric current to flow to heating mat. The flow of current to the heating mat causes heat to be dissipated therefrom. The actuable switch 348 can be coupled to a timer mechanism that permits the flow of current to the heating mat for a predetermined period of time. After actuable switch 348 has been depressed, the user then proceeds to take a shower, bath, etc. After the user exits the shower, bath etc., the user removes the warmed or heated towel from the warming or inner cavity of the portable warming device and dries oneself with the warmed towel. The heating mat can be designed to quickly warm or heat a towel after activation of the actuator switch; however, this is not required. As such, a user can still enjoy a warmed or heated towel even if the user takes a short shower, bath, etc. The heating mat can also be designed to retain a significant amount of heat after the flow of current has been discontinued to the heating mat so as to continue to warm or heat a towel after current has been terminated to the heating mat; however, this is not required. This design of the heating mat provides a warmed or heated towel to a user ever if the user takes an extended shower, bath, etc. which exceeded the time period that current was directed to the heating mat. After use of the portable warming device, the user can leave the portable warming device in the same location, or move the portable warming device to another location (e.g., linen closet, under a bathroom vanity, etc.).

Referring now to FIGS. 14-18, still another non-limiting embodiment of the portable warming device is illustrated. The portable warming device 400 includes a device body, a heating element disposed therein, and control circuitry for controlling the operation of a heating element.

Figure 14:
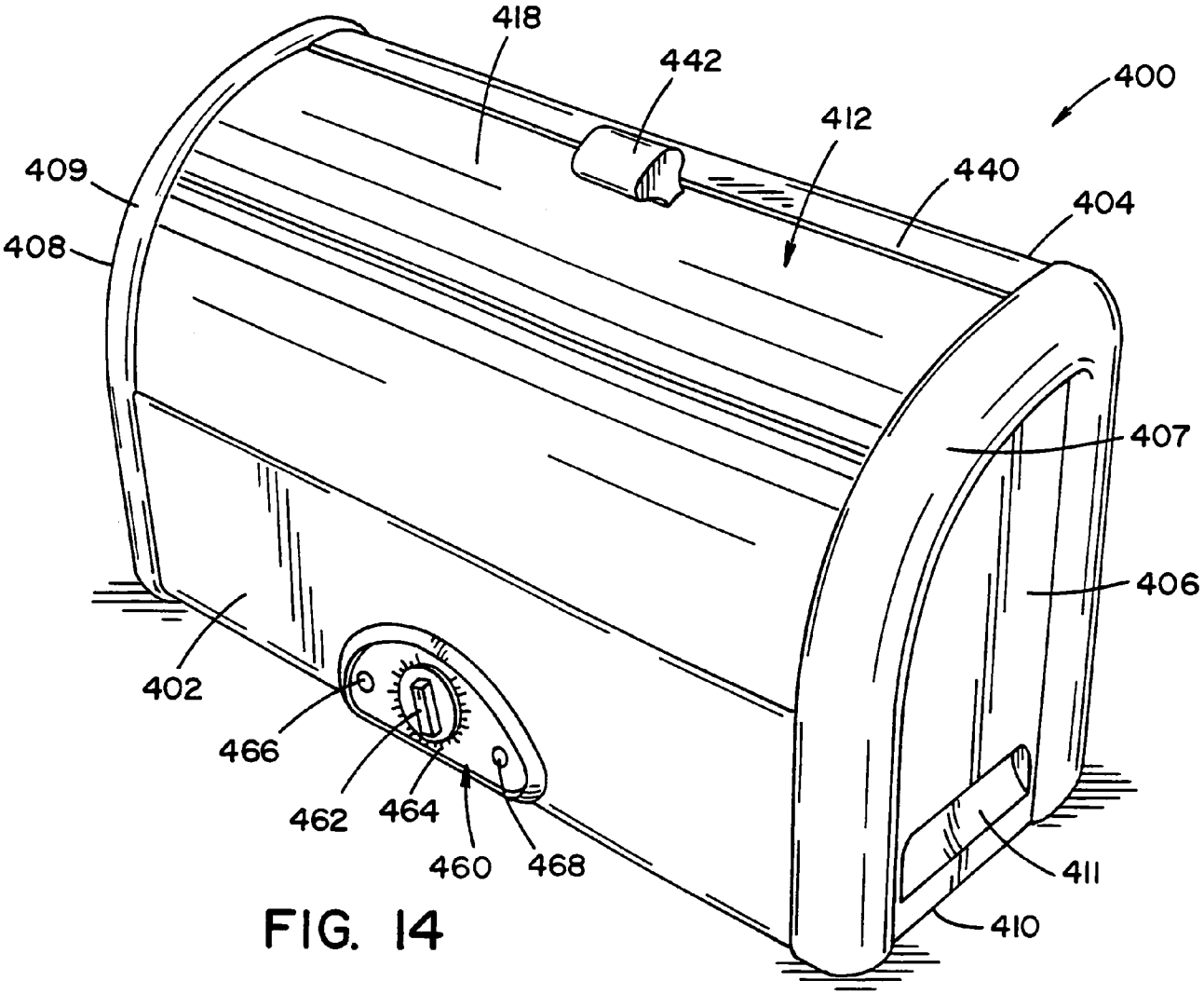
FIG. 14 is a front perspective view of still another non-limiting embodiment of a towel warming device in accordance with the present invention.
Figure 15:
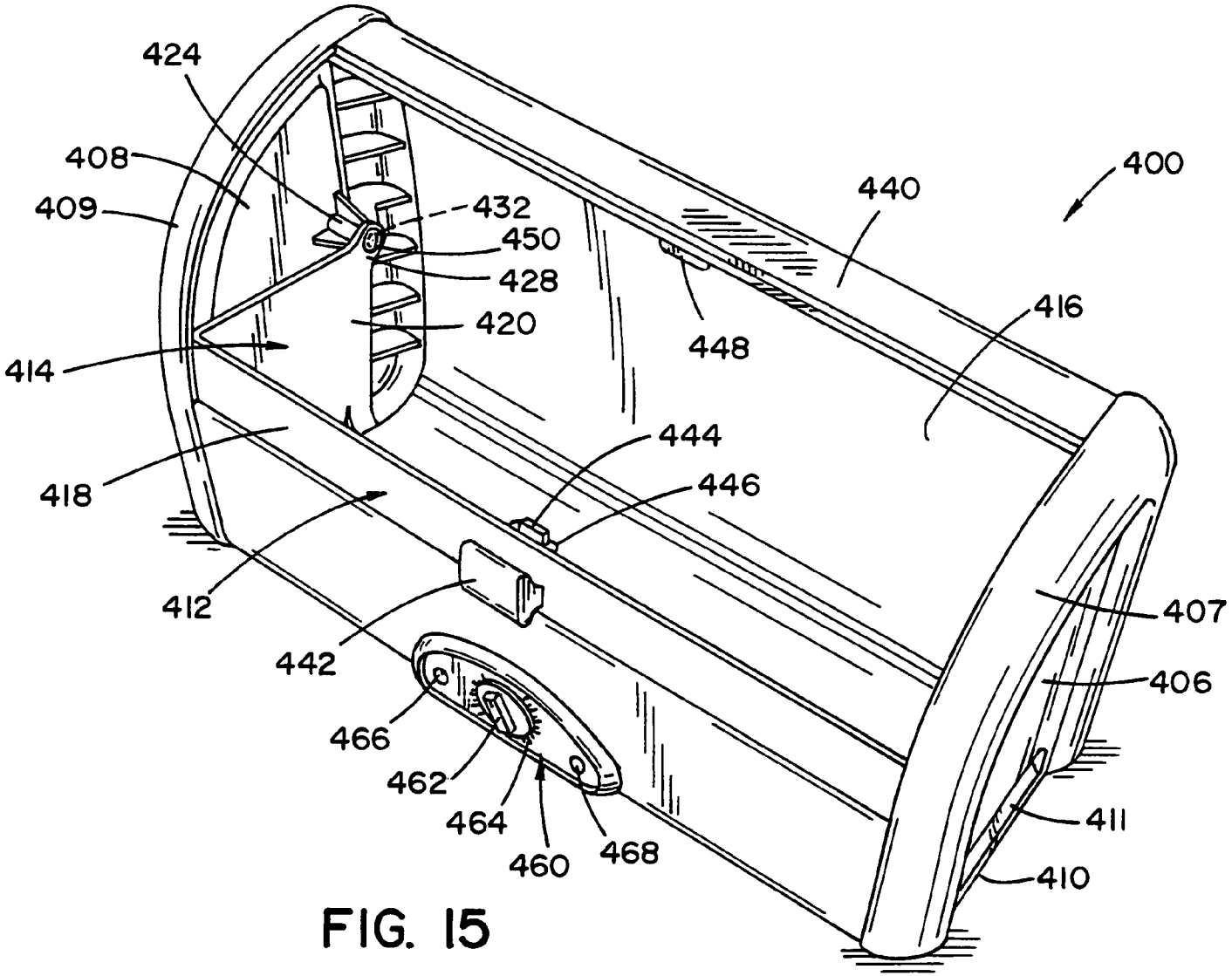
FIG. 15 is a front perspective view of the towel warming device of FIG. 14 wherein a door or lid is in an open position.

The device body 401 of portable warming device 400 can be formed by any suitable construction, configuration and material. As illustrated in FIGS. 14 and 15, device body 401 includes a front wall 402, a rear wall 404, spaced apart side walls 406, 408, a bottom wall 410 and an access door 412. The front wall 402 and rear wall 404 are disposed in a spaced apart relationship to each other and together define the front and rear portions of the device body. The front wall 402 and rear wall 404 are oriented in a generally parallel relationship to one another; however, this is not required. The front wall 402 is illustrated as having a reduced height relative to the rear wall 404; however, this is not required. The reduced height profile of front wall 402 suitably configures the device body in a manner for use with access door 412 as will be more fully described below. The rear wall 404 includes a flange-like lip member 440 extending from a top portion of rear wall 404 and toward front wall 402 to at least partially define a top portion of the device body; however, this is not required. The flange-like lip member 440 can extend generally perpendicular to the top portion of rear wall 404; however, this is not required. As will be more fully discussed below, the lip member 440 is designed to cooperate with access door 412 to define a closing interface for the portable device 400.

Figure 17:
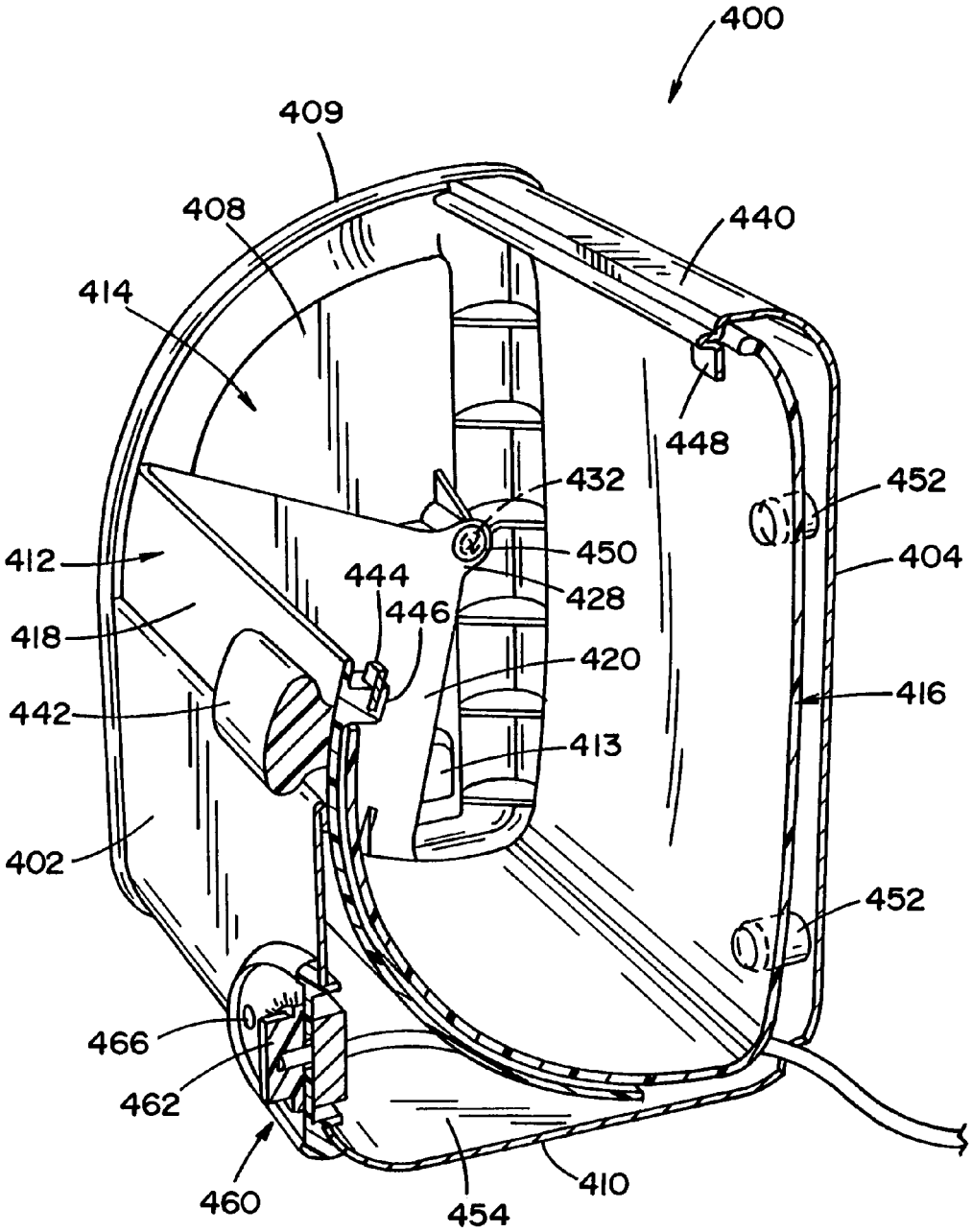
FIG. 17 is a partially cut away perspective view of the towel warming device of FIG. 14.

The bottom wall 410 of the device body 401 defines a bottom portion of the portable warming device 400. The bottom wall 410 can be designed to be an integral component with front wall 402 and rear wall 404; however, this is not required. As can be appreciated, one or more components of the device body can be separate components. The bottom wall 410 is shown to be disposed in a generally perpendicular relationship to the front wall 402 and rear wall 404; however, this is not required. The bottom wall 410 has a sufficient length to maintain the front and rear walls in a desired spaced apart relationship. The bottom wall 410 is designed to cooperate with the front and rear walls to define a generally cross sectional J-shaped configuration as illustrated in FIG. 17; however, it will be appreciated that the device body 401 can have many other cross-sectional shapes. The front wall 402, bottom wall 410 and rear wall 404 are illustrated as a unitary structure; however, this is not required. The front wall 402, bottom wall 410 and rear wall 404 are illustrated as a unitary structure. The unitary structure can be produced by a variety of methods such as, but not limited to, extrusion molding techniques, blow molding techniques, metal stamping techniques. The device body 401 can be formed or one or more materials. Typically the material used to form the device body is a material (e.g., plastic, metal, wood, ceramic, etc.) exhibiting the desired strength and/or thermal properties desired for the device body.

The side walls 406, 408 of the device body 401 are disposed in a spaced apart relationship. The side walls are shown to be oriented in a generally parallel relationship to one another; however, this is not required. The side walls are illustrated as in an abutting engagement with the respective lateral ends of the front wall 402, rear wall 404 and bottom wall 410; however, this is not required. The side walls 406, 408 can be designed to be cap-like members and/or connection members that cooperate with the front, rear and bottom wall structure of the device body to complete the lateral vertical walls of the device body and to define an inner compartment 414. As illustrated in FIGS. 14 and 15, the side walls 406, 408 include arcuate portions 407, 409 that define a portion of both an upper edge and a side edge of the side wall. As can be appreciated, the side walls are not required to include such arcuate portions. The arcuate portions 407, 409 are illustrated as originating from a side edge of the side walls 406, 408 at a position generally in proximity to an upper portion of the front wall 402 and advance therefrom in a rounded configuration terminating at a position generally in proximity to the lip member 440 of the rear wall 404. As will be more fully described below, the side wall arcuate portions 407, 409 can be designed to cooperate with the access door 412; however, this is not required. The side walls 406, 408 are constructed from any material (e.g., metal, plastic, word, ceramic, etc.) exhibiting strength and/or thermal properties desired for such components. The side walls 406, 408 can be produced by a variety of methods such as, but not limited to, extrusion molding techniques, blow molding techniques, metal stamping techniques. The side walls 406, 408 can be formed of one or more materials. The side walls 406, 408 can include a handle 411, 413; however, this is not required. The handles, when used, facilitate in enabling a user to transport and/or manipulation of the portable warming device 400. Such handles 411, 413 can be provided as distinct components that are pivotally or rigidly connected to the side walls, or be at least partially formed in the side walls (e.g., contours, etc.).

The device body 401 includes an inner compartment 414 as illustrated in FIG. 15. The inner compartment is designed to receive heating mat 416 and a towel to be warmed or heated by the portable warming device, as will be described in more detail below. The inner compartment 414 is defined by front wall 402, rear wall 404, bottom wall 410, side walls 406, 408, and access door 412. Although not shown, one or more of the walls can include rib-like protrusions that can be used provide a structural rigidity to the one or more walls; however, this is not required. The rib-like protrusions can also or alternatively be used to maintain the heating mat in spaced apart relationship relative to one or more of the walls; however, this is not required. Such spacing can be used to reduce and/or to customize the heat profile of the warming or inner cavity and/or the outer surface of one or more walls; however, this is not required. As can be appreciated, heat conducting material and/or heat insulating material, not shown, can be used to reduce and/or to customize the heat profile of the warming or inner cavity and/or the outer surface of one or more walls; however, this is not required.

The access door 412 provides access to the user to inner compartment 414. The access door 412 is designed to be moveable between a closed position as illustrated in FIG. 14 and an open position as illustrated in FIG. 15. The open position of the access door allows access to the inner compartment 414, and the closed positioned inhibits or prevents access to the inner compartment 414. The access door 412 is illustrated as including an elongate longitudinal portion 418 and a pair of arms 420, 422. Arms 420, 422 are generally positioned perpendicularly relative to longitudinal portion 418; however, this is not required. The elongate longitudinal portion 418 has an arcuate shape along its longitudinal axis to enable the access door 412 to generally mirror the arcuate configuration of side walls 406, 408, thereby providing an overall rounded longitudinal edge for the portable warming device 400. As can be appreciated, the access door can have other shapes. The access door can be constructed from any material (e.g., metal, plastic, word, ceramic, etc.) exhibiting strength and/or thermal properties desired for the access door. The access door can be produced by a variety of methods such as, but not limited to, extrusion molding techniques, blow molding techniques, metal stamping techniques. The access door can be formed of one or more materials.

Figure 16:
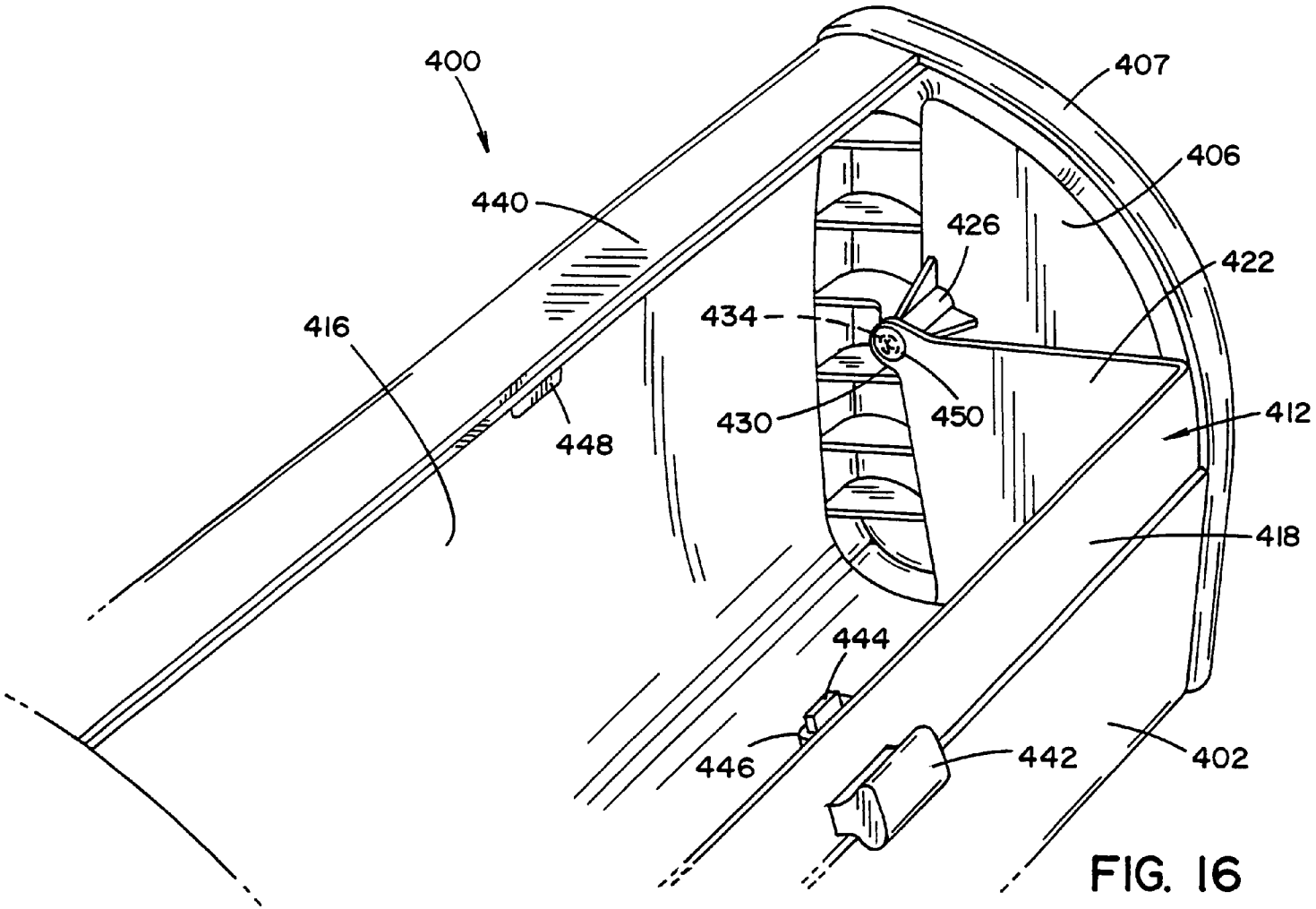
FIG. 16 is an enlarged perspective view of the connection arrangement for the door or lid of the towel warming device of FIG. 14.

As illustrated in FIGS. 15-17, access door arms 420, 422 cooperate with the portable warming device 400 to enable the access door 412 to rotate, pivot or slide between open and closed positions. In one non-limiting arrangement, access door arms 420, 422 have an overall plan shape generally as a circular quadrant. The arcuate surfaces of access door arms engage the bottom face of the access door 412 and extend therefrom into generally tapered portions 428, 430. The tapered portions 428, 430 of access door arms 420, 422 interface with inner surfaces of side walls 406, 408 in a rotating or pivoting assembly that provides for the rotating or pivoting of the access door 412. As illustrated in FIG. 16, the pivot assembly includes an interface between the access door 412 and the device body 401. In one non-limiting arrangement, the pivot assembly includes boss members 424, 426 extending from the side walls 406, 408. The boss members 424, 426 are positioned on the side walls to enable an interface between the boss members and the tapered portions 428, 430. Each tapered portion includes a hole 432, 434 bored therethrough and is designed to overly a corresponding bore, not shown, in boss members 424, 426. The pivot assembly also includes a pivot pin-like fastening member 450 disposed through the holes 432, 434 of the access door arms 420, 422 and the bores of boss members 424, 426. The fastening member 450 is designed to secure the access door 412 to device body 401 and to enable the access door to open and close. As can be appreciated, the access door can be rotatably, pivotly or slidably connected by a variety of other or additional arrangements to the device body. As can also be appreciated, the access door can be designed to be partially or fully removable from the device body so as to provide access to the inner compartment.

The access door 412 is illustrated in FIGS. 14 and 15 to include a handle 442 used to facilitate in the user's manipulation of the access door 412. Handle 442 can be of any suitable configuration that can be grasped and held by the user during the opening and/or closing of the access door 412. The portable warming device 400 can also include a mechanism (e.g., magnet, hook and loop fasteners, latch, lock, electronic locking arrangements, etc.) to secure the access door 412 in a closed position; however, this is not required. As illustrated in FIGS. 15-17, the securing arrangement includes a magnet 444 located on the access door 412. The magnet is used to magnetically associate with a corresponding structure 448 on the device body 401. In this non-limiting arrangement, the access door 412 includes an inwardly (i.e., toward the inner compartment 414) projecting shoulder portion 446 that is designed to maintain the magnet 444 in secure association with the access door 412. Rear wall 404 includes a flange-like magnet engaging portion 448 that is designed to magnetically interact with the magnet 444 when the magnet 444 is positioned in proximity to the magnet engaging portion 448 and to maintain the magnet 444 in proximity to the magnet engaging portion 448, thereby securing the access door 412 in a closed position. As will be appreciated, other or additional arrangements can be used to secure the access door in a closed position. The access door can also include a spring, counterweight and/or other mechanism to facilitate in moving the access door between an open and closed position; however, this is not required. As can be appreciated, the access door 412 can have a variety of configurations. For example, the access door 412 can be designed to pivot or rotate in a manner that causes the access door to pivot or rotate upwardly and away from the device body to expose the inner compartment 414. By way of an additional example, access door 412 can have an accordion-like configuration that enables the access door to compact into a condensed state and thereby provide access to the inner compartment 414, and/or enable the access door to slide between an open and closed position to provide access to the inner compartment 414.

The device body can be constructed so as to have any suitable dimension and/or configuration. In one non-limiting arrangement, the device body includes an inner compartment 414 having a volume sufficient to receive at least one standard bath towel. In another non-limiting arrangement, the device body includes an inner compartment 414 having a volume sufficient to receive no more than two standard bath towels. As can be appreciated, the device body can include an inner compartment 414 having a volume sufficient to receive more than two standard bath towels.

The portable warming device 400 includes a heating arrangement that includes a heating element, not shown, and control circuitry to control the operation of the heating element. The heating arrangement is designed to warm or heat one or more towels that are placed in the inner compartment 414. The heating element can be similar to the heating mat or other type of configuration that was described above with regard to the embodiments of FIGS. 1-13. The heating element is generally designed to be located in the inner compartment. In one non-limiting configuration, the heating arrangement includes a heating mat 416 positioned in the inner compartment 414. The heating mat is sized and shaped to fit in a majority of the interior surface of the inner compartment increase the amount of heat transferred from the heating mat to the towel.

As illustrated in FIG. 17, heating mat 416 has a generally rectangular shape; however, it can be appreciated that the heating mat can have other shapes. The heating mat 416 is disposed along at least a portion of the inner surface of rear wall 404, bottom wall 410 and front wall 402 so as to provide a pocket-like arrangement designed to receive one or more towels. This pocket-like arrangement defines at least a portion of the inner or warming cavity of the portable warming device. Although not shown, the heating mat can be positioned on at least a portion of one or both of the side wall 406, 408; however, this is not required. The heating mat 416 is also shown to be maintained in a spaced apart relationship from at least one of the walls 402, 404, 410; however, this is not required. The spacing of the heating mat from one or more of the walls can be used to minimize the amount of heat transferred to the walls 402, 404, 410. Spacer assemblies 452 can be provided to facilitate in creating the spaced apart relationship between the heating mat and the one or more walls. As can be appreciated: a heat insulating material, not shown, can be positioned between the heating mat and one or more walls to so as to reduce the amount of heat transferred to the walls 402, 404, 410; however, this is not required. As illustrated in FIG. 17, the spacer assemblies 452 include boss-like members extending from the inner surfaces of walls 402, 404, 410. The boss-like members are designed to cooperate with rivet-like fasteners and/or other types of fasteners to secure the heating mat to the spacer assemblies. As can be appreciated, other or additional arrangements can be used to maintain the heating mat in a spaced relationship form one or more of the walls. The warming or inner cavity is also configured to enable liquid (e.g., water, etc.) to drain from the warming or inner cavity. During the operation of the portable warming device, a user may place a damp towel or other type of article in the warming or inner cavity. Over time, moisture from the damp towel can begin to accumulate in the bottom portion of the warming or inner cavity that is defined by the bottom portion of the heat mat 416. Moisture that begins to collect in the bottom portion of the warming or inner cavity is able to drain out of the bottom portion of the warming or inner cavity by moving to the side edge of the heating mat 416 and then dripping out of the warming or inner cavity. The removal of moisture from the warming or inner cavity can result in a dryer feel to the warmed or heated towel. The removal of moisture from the warming or inner cavity can also or alternatively reduce or inhibit discoloration and/or damage to the warming or inner cavity and/or other components of the portable warming device. Although not shown, the heating mat 416 can include one or more opens or slots that can function as a drain; however, this is not required.

Referring again to FIG. 17, heating mat 416 is shown to approach an upper edge of the front wall 402 in an arcuate manner that defines a generally closed compartment 454. The closed compartment 454 is defined by a bottom surface of the heating mat 416, a portion of an upper surface of the bottom wall 410, and substantially all of an inner surface of the front wall 402. As will be more fully described below, the closed cavity 454 suitably provides a convenient location for the placement of the control circuitry components of the heating arrangement that control the operation of the heating mat 416. Additionally, the closed cavity 454 defines an area into which the access door 412 can be at least partially maintained when the access door in the open position.

Although not shown, the heating mat can be positioned between an inner shell, not shown, and the wall of the device body; however, this is not required. In this arrangement, the inner shell forms at least a portion of the surface of the inner or warming cavity of the portable heating device and the heating mat heats the inner shell, which in turn is used to heat the one or more towels in the inner or warming cavity.

The heating arrangement of the portable warming device 400 includes control circuitry that is designed to control the activation and/or deactivation of the heating mat 416. The configuration and/or features of the control circuitry can be the same or similar to the control circuitry described above with regard to the embodiments of FIGS. 1-13. As can be appreciated, the portable warming device can be simply designed so that when the portable warming device is connected to a power source, the portable warming device is activated, and when the portable warming device is disconnected from the power source, the portable warming device is deactivated. In this particular configuration, the control circuitry is very simple or non-existent. As illustrated in FIGS. 15 and 17, the control circuitry 460 includes an arrangement designed to be coupled to heating mat 416 so as to supply a source of electrical energy to the heating mat. The source of electrical current is generally provided through a conventional electric cord 461 electrically associated with the control circuitry in a well-known manner. The electric cord 461 generally includes at one end a plug adaptor and/or other type of connector designed to be connected to a source of electric current (e.g., 120V AC, one or more batteries, etc.). The electric cord generally is provided in sufficient length to facilitate in positioning of the portable warming device 400 in any desired position and/or location. The electrical cord can be designed to be suitably retractable into the body of the portable warming device to simplify storage of the device and to reduce the amount of unneeded cord being exposed from the portable towel device; however, this is not required. As can be appreciated, the portable warming device can include one or more projections or receptacles designed to receive the electric cord; however, this is not required. Such one or more projections or receptacles can be used to wrap the electric cord on the portable warming device, store the electrical cord in the portable warming device, and/or detachably connect the electric cord to the portable warming device.

Figure 18:
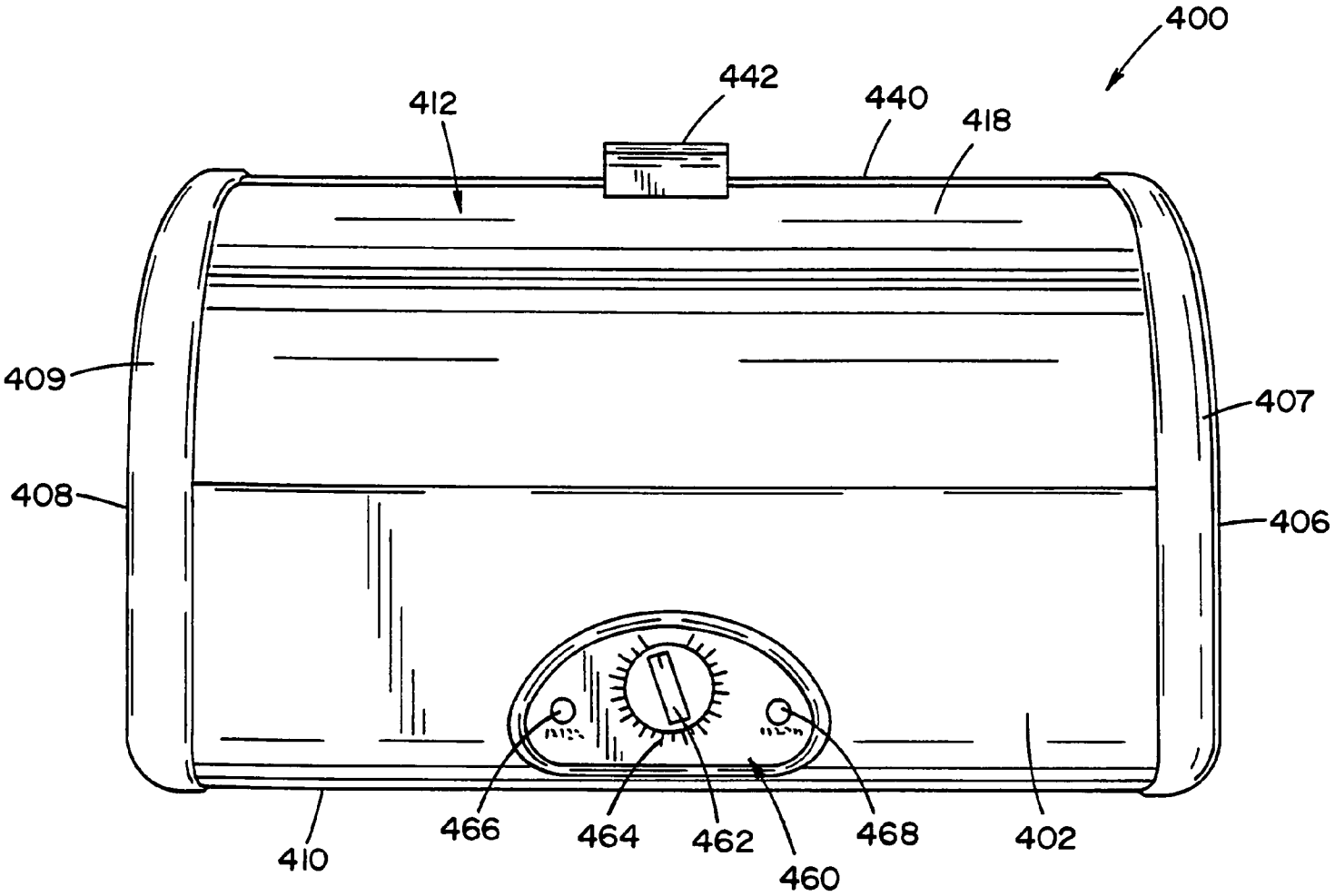
FIG. 18 is a plan view of the towel warming device of FIG. 14.

Referring now to FIGS. 17 and 18, the control circuitry 460 includes a user interface to enable a user to activate and/or deactivate the portable warming device. In one non-limiting arrangement, the user interface includes a knob 462 such as an analog, rotary dial type. The knob can be part of a timer mechanism and include time indicia positioned about the knob to enable a user to rotate the knob 462 to a desired duration; however, this is not required. In such an arrangement, the user is able to preselect a desired heating time. Upon rotation of knob 462, the control circuitry enables electrical current to be directed to the heating mat for a period of time so as to heat the one or more towels located in the inner or warming cavity of the portable warming device 400. When the time period elapses, the electric current to the heating mat is terminated. As can be appreciated, other or additional mechanical and electronic controls can be included on the portable warming device as described above with regard to the embodiments of FIGS. 1-13 so as to control the activation and/or deactivation of the heating mat. The heating mat can be designed to generate sufficient heat to heat the warming or inner cavity of the portable warming device to a temperature sufficient to heat the one or more towels in the warming or inner cavity to a temperature that results in foreign objects (e.g., bacteria, mold, mildew, fungus, allergens, dust mites, viruses, etc.) on the towel to be disabled, killed and/or eliminated from the towel; however, this is not required.

The control circuitry 460 can also be designed to provide information to a user; however, this is not required. For example, the control circuitry can include a visual and/or audible arrangement (e.g., light, meter, beeping noise, song, buzzer noise, etc.) designed to inform the user that 1) the heating element has been activated and is in the process of warming or heating a towel, 2) the heating element is deactivated, 3) the heating element is cooling down, etc. As can be appreciated, the visual and/or audible arrangement can be used to provide the user with other or additional information. The visual and/or audible arrangement can be in close proximity to written indicium (e.g., "heating", "on/off", "power on", "power off", "cooling down", "ready", "error", etc.) to provide the user information about the visual and/or audible arrangement.

As mention above, the control circuitry 460 can include a user interface to enable a user to select a desired temperature to warm or heat the towel; however, this is not required. Non-limiting examples of such a user interface can include, but is not limited to, a rotary dial that enables a user to select a plurality of available temperatures, an electronic and/or programmable interface that enables a user to select a plurality of available temperatures, etc.

The control circuitry 460 can include one or more user interface protective elements designed to govern various aspects of the operation of the portable warming device; however, this is not required. Non-limiting examples of user interface protective elements include, but are not limited to, activation/deactivation key, activation/deactivation combination or code, etc. The user interface protective elements can be used to inhibit or prevent the unauthorized operation of the portable towel warming device.

The control circuitry 460 can include one or more user integrated protective elements designed to govern various aspects of the operation of the portable warming device; device; however, this is not required. Non-limiting examples of integrated protective elements include, but are not limited to, timer, a temperature cutoff switch, ground fault circuit interrupter (GFCI) components, general components designed to resist the deleterious impact of water, etc.

Portable warming device 400 can be positioned in a variety of locations (e.g., counter top, floor, commode seat or top, tub deck, shelf, chair seat, bench, table, toilet seat, toilet tank top, etc.). When the portable warming device is positioned on a generally flat surface, the base 406 interfaces with the generally flat surface to support the portable warming device in a desired position. As can be appreciated, one or more of the walls of the device body can include one or more connectors (e.g., one or more arm-like members, straps, clips, mount openings, etc.) to enable the portable warming device to be fastened to a wall, hung from a towel, etc.

The portable warming device 400 can include an aroma or scent generating arrangement to impart a desirable aroma to the towel and/or to release a desired aroma in the area about the portable warming device; however, this is not required. In one non-limiting arrangement, a volatile material (e.g., liquid, gel, solid, etc.) is used to release volatile substances (e.g., perfume, air fresheners, etc.) into the towel and/or in the atmosphere surrounding the portable warming device. The aroma or scent generating arrangement can be used independently and/or in conjunction with the heating arrangement of the portable warming device to cause controlled and/or uncontrolled release of the volatile substances.

The portable warming device 400 can include one or more blowers to facilitate in the warming or heating of the one or more towels positioned in the inner or warming cavity of the portable warming device; however, this is not required.

The heating mat configuration described in the embodiments discussed in regard to FIGS. 1-9 can be also or alternatively used in the portable warming device 400.

A non-limiting method for warming a towel by portable warming device 400 will now be discussed. The towel warming is generally positioned in a location desired by the user so as to provide convenient access to the warmed or heated towel (e.g., bathroom countertop, atop a toilet tank, on a bathroom floor, etc.). The electric cord 461 is connected to a source of electrical current, such as a wall outlet. The user warms or heats a towel by folding, shoving or otherwise pacing the towel in the warming or inner cavity of the portable warming device. The towel is positioned in the warming or inner cavity by opening access door 412 by grasping the door handle 442 and sliding the access door downward into a stored position in closed cavity 454 as illustrated in FIGS. 15 and 17. The movement of the access door to the open position provides access to the inner compartment 414 which includes the warming or inner cavity of the portable device. After the access door is moved to an open position, the user is able to insert a towel into the warming or inner cavity of the portable warming device. Due to the relatively large access aperture provided by the opening of the access door, the towel can be inserted into the warming or inner cavity in any desired manner (e.g., neatly folded and carefully positioned within the warming or inner cavity, haphazardly stuffed into the warming or inner cavity, etc.). Regardless of the configuration of the towel when being positioned in the warming or inner cavity, the towel is at least partially enveloped or encapsulated by the heating mat 416 so as to enable the heating mat to warm or heat the towel. Once the towel is positioned in the warming or inner cavity, the access door is moved to the closed position to substantially encapsulate the towel in the warming or inner cavity of the portable warming device. Once the access door is closed, the user suitably activates the portable warming device by rotating the knob 462. The rotation of knob 462 causes electric current to flow to the heating mat 416. The flow of current to the heating mat causes heat to be dissipated therefrom. Knob 462 can be coupled to a timer mechanism that permits current to flow to the heating mat for a predetermined period of time; however, this is not required. When a timer is used, the timer can be automatically set to allow current to flow to the heating mat for a predetermined period of time, and/or the timer can be manually set by the user. If the time can be manually set by the user, the user can set the timer for a period of time that the user believes he/she will be in the shower, bath, etc. After the user activates the portable warming device, the user then proceeds to take a shower, bath, etc. After the user exits the shower, bath etc., the user opens the access door and removes the warmed or heated towel from the warming or inner cavity of the portable warming device and dries oneself with the warmed towel. The heating mat can be designed to quickly warm or heat a towel after activation of the actuator switch; however, this is not required. In such an arrangement, a user can still enjoy a warmed or heated towel even if the user takes a short shower, bath, etc. The heating mat can also be designed to retain a significant amount of heat after the flow of current has been discontinued to the heating mat so as to continue to warm or heat a towel after current has been terminated to the heating mat; however, this is not required. This design of the heating mat provides a warmed or heated towel to a user ever if the user takes an extended shower, bath, etc. which exceeded the time period that the current was directed to the heating mat. The enclosure formed by the closed access door and the device body also retains heat in the warming or heating cavity thereby facilitating in maintaining the towel at a warm temperature after current has been terminated to the heating mat. After use of the portable warming device, the user can leave the portable warming device in the same location, or move the portable warming device to another location (e.g., linen closet, under a bathroom vanity, etc.).

Referring now to FIGS. 19-24, yet another non-limiting embodiment of the portable warming device is illustrated. The portable warming device 500 is designed to be permanently suspended or be removably suspended from any suitable support such as, but not limited to, a conventional wall-mounted towel bar, towel rack, shower curtain rod, etc. The portable warming device 500 is illustrated as a generally rectangular mat-like member having a configuration designed to be suspended from a wall mounted towel rack and to warm a towel by draping the towel over the towel rack and portable warming device 500. As can be appreciated, the portable warming device 500 can have other configurations. In this particular embodiment of the invention, the portable warming device does not include a warming or inner cavity. This particular embodiment of the invention is designed to warm or heat a towel or other type of article by placing the towel or other type of article in contact with and/or in closed contact with one or more outer surfaces of the portable warming device as will be described in detail below.

Figure 19:
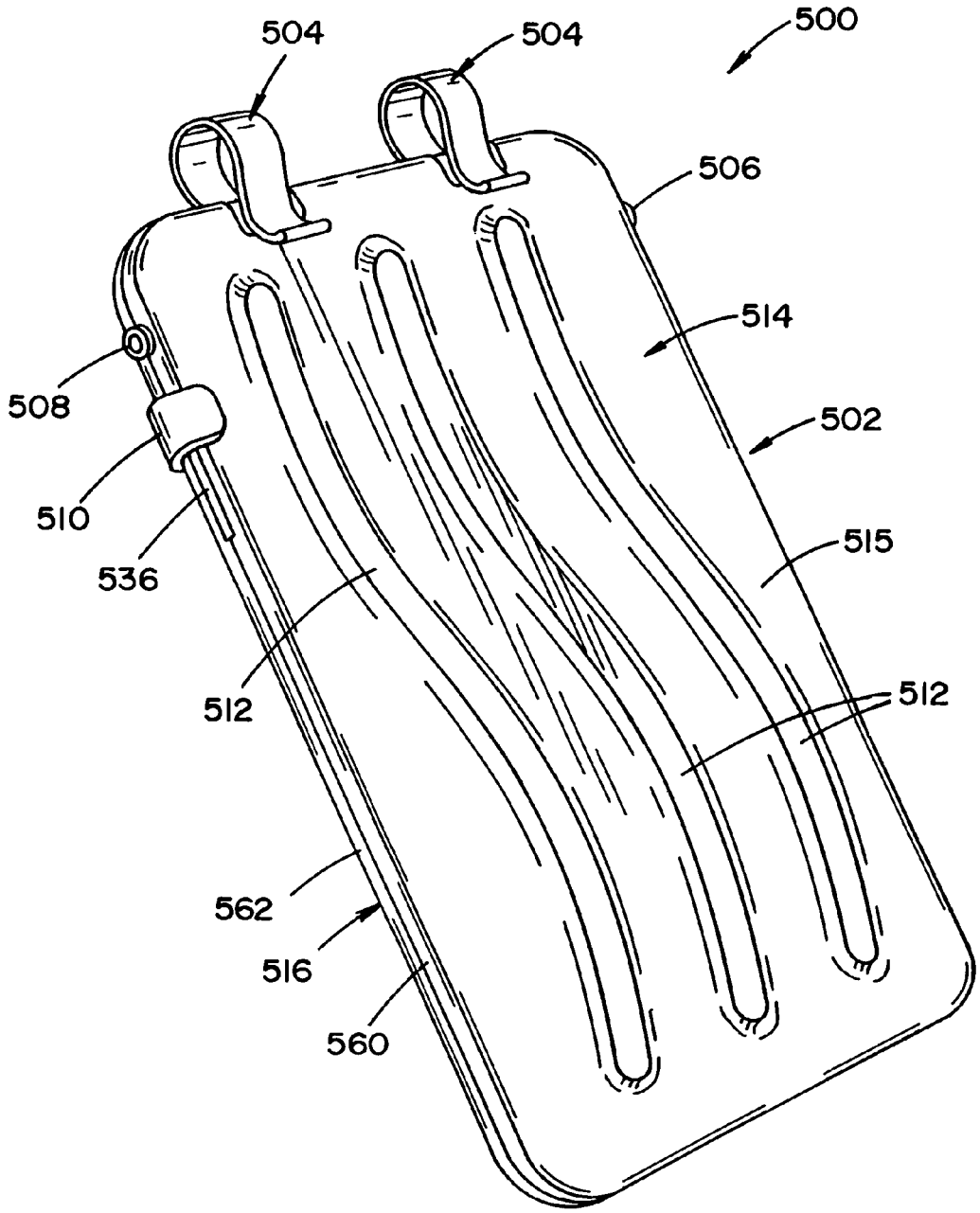
FIG. 19 is a perspective view of still another non-limiting embodiment of a towel warming device in accordance with the present invention.

Referring now to FIG. 19, portable warming device 500 includes an elongate rectangular mat-like body 502 and at least one fastener 504. The fastener is designed to suspend the warming device 500 from a towel rack or the like. The portable warming device 500 also includes an electrical interface 506, and a user interface 510. The mat-like body 502 includes one or more elongate striations 512; however, this is not required. The one or more elongate striations are used to increase the surface area to heat a towel and/or to enhance the aesthetics of the portable warming device. The one or more elongate striations 512 can be sinuously shape; however, other or alternative configurations can be used.

Figure 20:
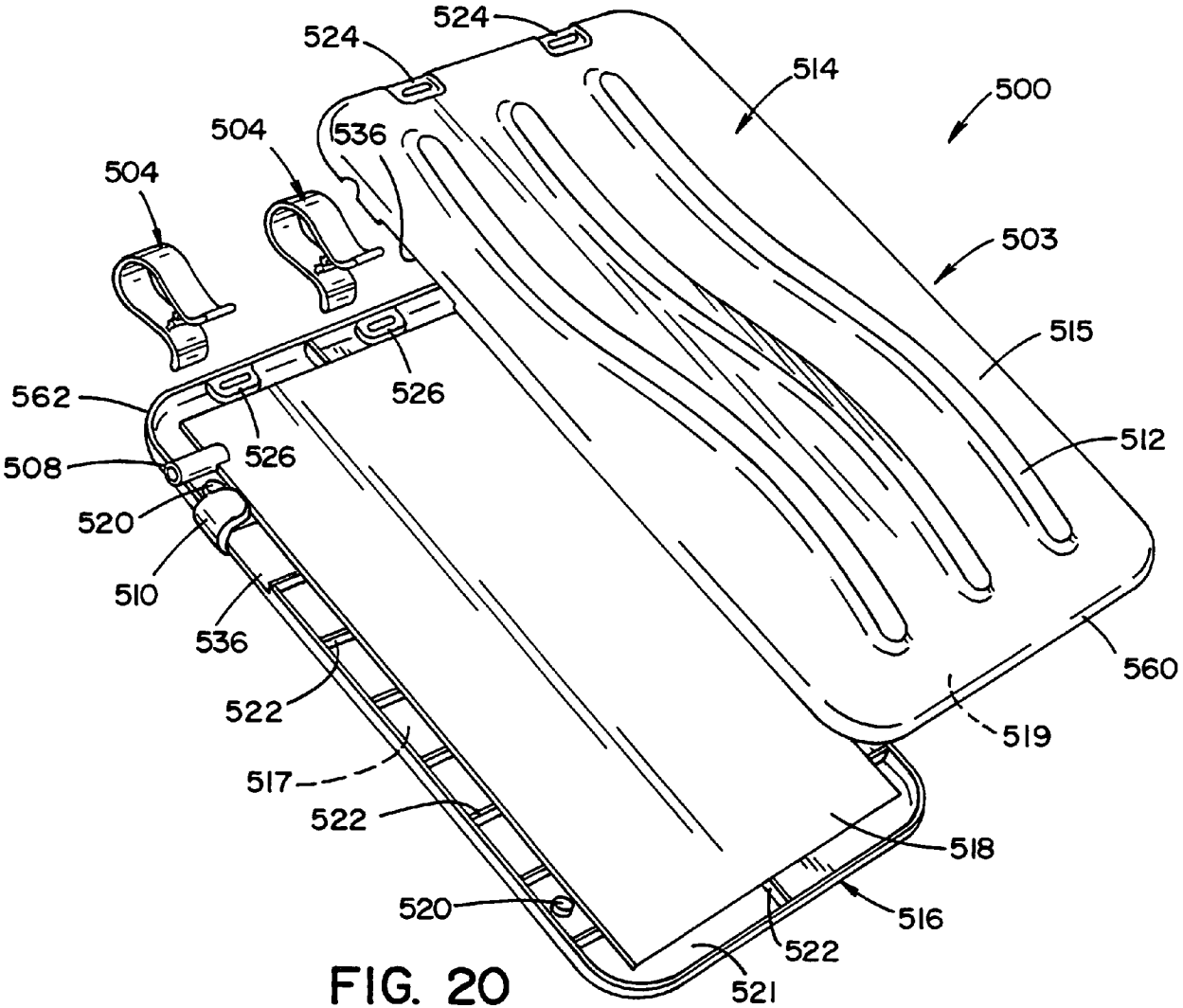
FIG. 20 is a partial exploded view of components of the towel warming device of FIG. 19.

Referring now to FIG. 20, the body 502 of the portable warming device 500 includes a first layer 514 and a second layer 516, each of which are generally a mirror image of one other. The first layer 514 and a second layer 516 each have outer surface 515, 517 and an inner surface 519, 521, respectively. Layers 514, 516 are securely engageable with each other through a securing arrangement (e.g., adhesive, melted seam, snap connectors, etc.). One non-limiting securing arrangement includes a pin-like member 520 protruding from the inner surface 521 of the second layer 516 and designed to fittingly engage with a complementary structure, not shown, located on the inner surface 519 of the first layer 514. As can be appreciated, other or additional securing arrangements can be used. Layers 514, 516 can also include rim-like edge flanges 560, 562 that are designed to interact with each other in a manner to increase the fitting engagement therebetween; however, this is not required.

Figure 21:
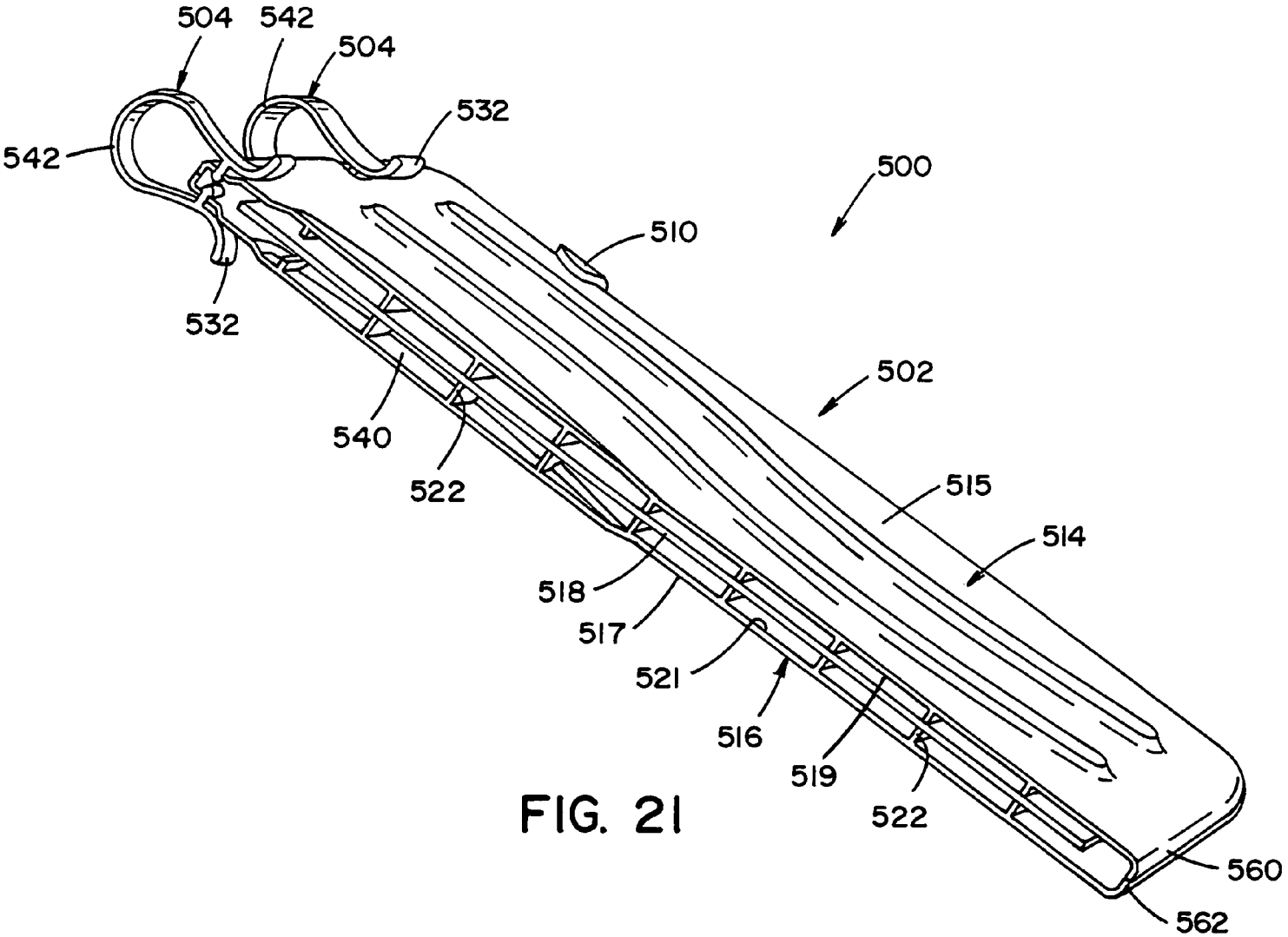
FIG. 21 is a perspective cut away view of the towel warming device of FIG. 19.

Referring now to FIGS. 20 and 21, first layer 514 and second layer 516 are designed to fit together so as to define an inner compartment 540 therebetween. The edge flanges 560, 562 of each of the layers 514, 516 can be designed to protrude in a manner such that the edge flanges abuttingly engage one another to facilitate in the formation of the spaced relationship between the two layers; however, this is not required. A heating mat 518 is positioned in the inner compartment 540. The heating mat forms at least a part of the heating arrangement for the portable warming device. The heating mat can have the same or similar features as described above with regard to the embodiments of FIGS. 1-17. The heating mat 518 is shown to be oriented in the inner compartment 540 and oriented to be generally coplanar with the layers 514, 516; however, such orientation is not required. The heating mat is designed to emanate heat therefrom in a manner to cause the outer surfaces 515, 517 of the layers 514, 516 to be heated and thereby warm or heat a towel on the portable warming device: The inner surfaces 519, 521 of layers 514, 516 can include a plurality of rib-like protrusions 522; however, this is not required. The rib-like protrusions 522 are designed to maintain the heating mat 518 in spaced apart relationship relative to inner surface 519, 521 of layers 514, 516. Such spacing can be used to reduce and/or to customize the heat profile of the outer surfaces 515, 517 of layers 514, 516. As can be appreciated, heat conducting material and/or heat insulating material, not shown, can be used to reduce and/or to customize the heat profile of the outer surfaces 515, 517 of layers 514, 516. Additionally or alternatively, rib-like protrusions 522 can be used to provide a structurally reinforcing framework that imparts rigidity to layers 514, 516.

Figure 22:
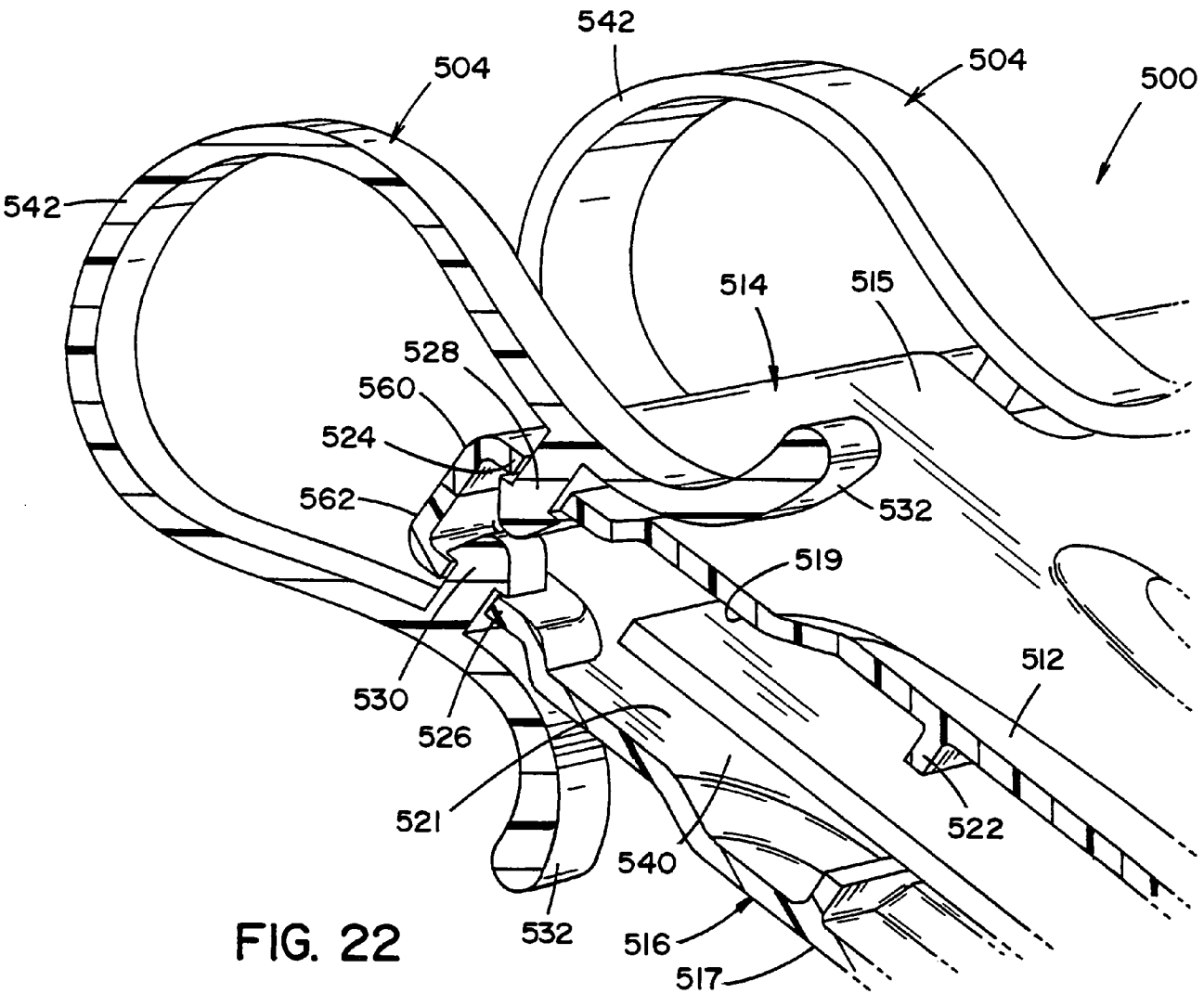
FIG. 22 is an enlarged view of a fastener assembly of the towel warming device of FIG. 19.
Figure 23:
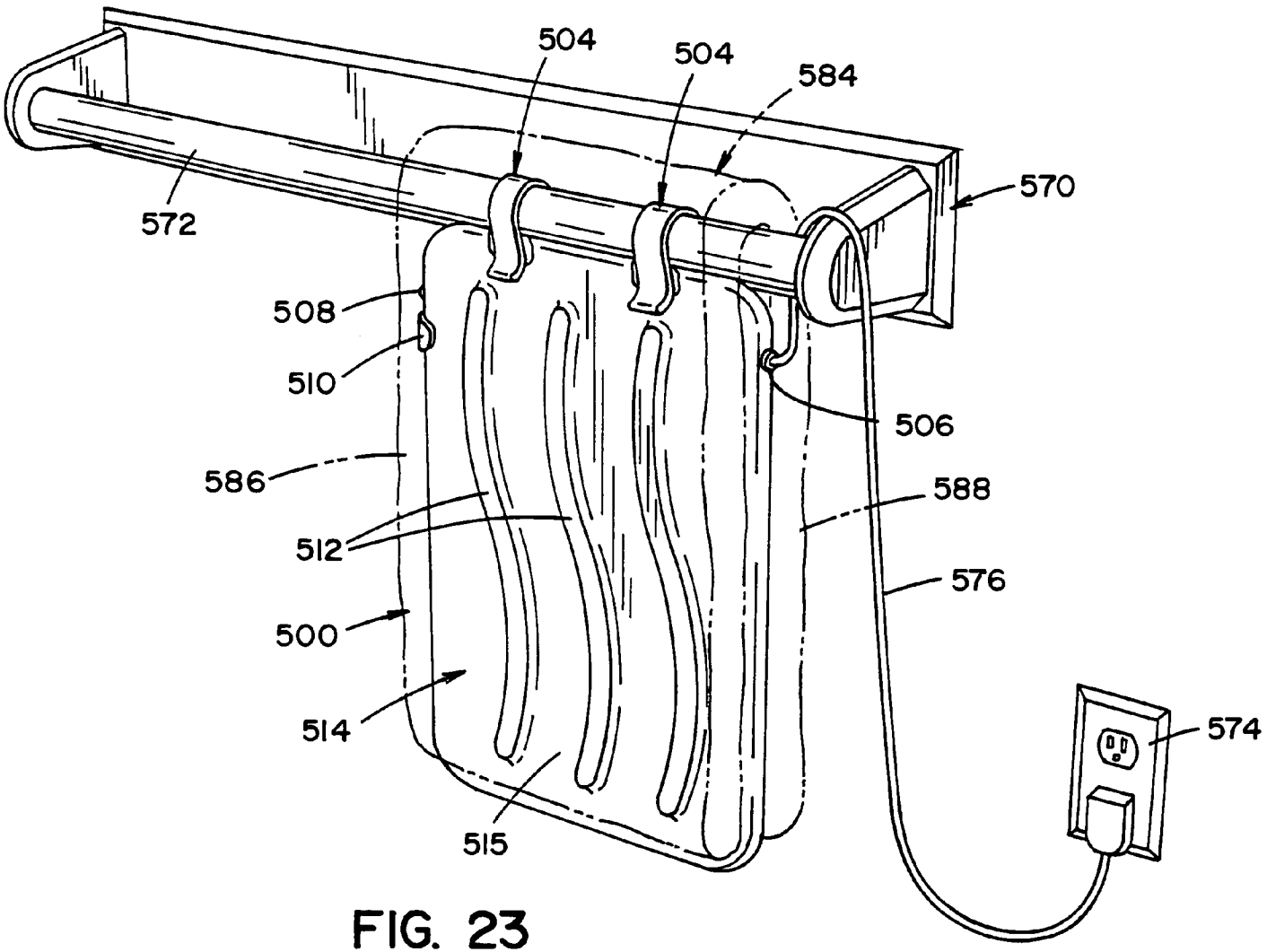
FIG. 23 is a perspective view of the towel warming device of FIG. 19 suspended from a wall-mounted towel rack and having a towel associated therewith; and, FIG. 24 is a perspective view of two towel warming devices of FIG. 19 suspended from a wall-mounted towel rack and interconnected to one another.

Referring now to FIG. 23, the portable warming device 500 also includes at least one fastener 504 that is designed to suspend the portable warming device 500 from a conventional wall mounted towel rack 570. The fastener can be designed to releasably or permanently secure the portable warming device 500 to towel rack 570. As illustrated in FIG. 22, fastener 504 is generally an elongate strap-like member releasably securable to the portable warming device 500 and is designed to fittingly engage around a tubular portion 572 of the towel rack 570 so as to maintain the portable warming device 500 in proximity thereto. As can be appreciated, the fastener can have other configurations. As illustrated in FIGS. 20 and 22, the fastener 504 is shown to be an elongate strap-like member characterized by user graspable portions 532 associated with opposite ends of the strap, body engaging portions 528, 530, and a towel rack engaging portion 542. In non-limiting configuration, the towel rack engaging portion 542 is a centrally located portion of the fastener 504 strap and is designed to be arcuately disposed about and lay on the tubular portion 572 of the towel rack 570. The body engaging portions 528, 530 are a pair of members each positioned distal to the rack engaging portion 542 and protruding from the strap collinearly. With reference to the body engaging portions 528, 530, each layer 514, 516 includes a fastener engaging portion 524, 526 designed to releasably and securely receive the body engaging portions 528, 530 therein. The fastener engaging portions 524, 526 are provided as apertures fashioned in each layer 514, 516 and the body engaging portions 528, 530 are provided as protruding portions having a structure designed to pass into and fittingly engage with the fastener engaging portions 524, 526. Additionally, the user graspable portions 532 are designed to be terminal portions of the fastener 504 strap and provide a graspable structure for a user to engage during either associating the portable warming device 500 with a towel rack or for disassociating the portable warming device 500 from the towel rack. It is to be appreciated that the foregoing discussion of the fastener 504 is by way of example only, and that many other or additional suitable structures can be used to suspend the portable warming device 500 from a towel rack or similar structure. It can also be appreciated that fastener 504 can be a strap-like member wherein one end is designed to fixedly secure to the portable warming device 500 and the other end of is designed to be connected to towel rack or like structure and to support the portable warming device 500 on the towel rack or like structure.

Referring now to FIGS. 19, 20, 23, and 24, the portable warming device 500 includes an electrical interface 506. Electrical interface 506 is part of the heating arrangement of the portable warming device. The electrical interface is used to couple the portable warming device 500 to a source of electrical current, such as a wall outlet 574, a battery pack, etc. The electrical interface 506 can include a male or female coupler that is designed to connect to a complementary adaptor associated with a power cord 576 or other suitable structure. The power cord 576 is shown to be an elongate electric coupling member having an adaptor designed to engage and be electrically coupled to electrical interface 506 at one end of the power cord and have a wall outlet engaging adaptor integrated with the other end of the power cord. The adaptor is designed to engage and be electrically coupled to electrical interface 506 can be designed to releasably engage electrical interface 506, or be permanently connected to electrical interface 506.

Figure 24:
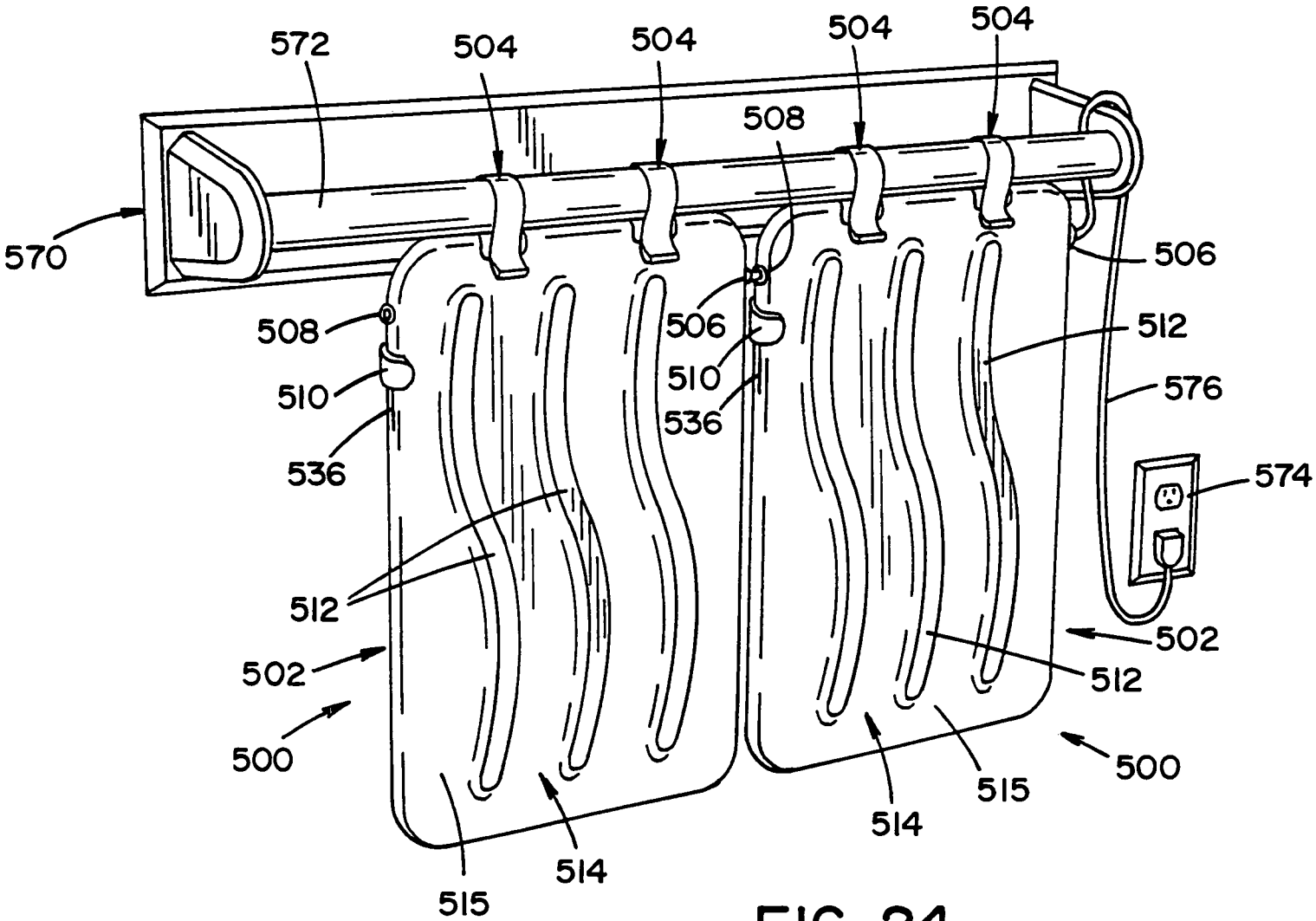

As illustrated in FIGS. 23 and 24, a single portable warming device 500 can be suspended from a towel rack or like structure or a plurality of portable warming devices can be electrically connected together and be suspended from a towel rack or like structure. As illustrated in FIG. 24, two portable warming devices are electrically coupled together, thereby obviating the need to directly couple the second portable warming device to a separate wall outlet. When the portable warming device is design so it can be electrically coupled to another portable warming device, such portable warming device includes an electrical interface 508. As can be appreciated, if the portable warming device is design so it cannot be electrically coupled to another portable warming device, electrical interface 508 can be eliminated from the portable warming device. The electrical interface 508 is generally a male or female coupler. When two portable warming devices are electrically connected together as illustrated in FIG. 24, electrical interface 508 of the first portable warming device is coupled to the electrical interface 506 of the second portable warming device. As illustrated in FIG. 24, a short cord is used to electrically couple together the two portable warming devices; however, it can be appreciated that the two portable warming devices can be electrically coupled together by other or additional arrangements. In this non-limiting arrangement, the first portable warming device includes an electrical interface 506 that is electrically connected to a power source such as wall plug 574 and the second portable warming device is electrically connected to the first portable warming device by a small electric cord connecting electrical interface 508 of the first portable warming device to the electrical interface 506 of the second portable warming device. In this non-limiting arrangement, when the first warming device 500 is coupled to a source of electric current and the electrical interface 508 of the first warming device 500 is coupled to the electrical interface 506 of the second warming device 500, the first and second warming devices are configured to operate and dissipate heat.

Portable warming device 500 can include user interface 510 to enable a user to actuate operation of the warming device 500; however, this is not required. The portable warming device can be simply designed so that when the portable warming device is connected to a power source, the portable warming device is activated, and when the portable warming device is disconnected from the power source, the portable warming device is deactivated. As illustrated in FIG. 19, user interface 510 is a push button and/or slidable switch coupled to the control circuitry of the heating arrangement in a manner that activation of the user interface causes electrical current to flow to the heating mat 518. In one non-limiting embodiment, user interface 510 is in the form of a switch that is slidable along a slot 536 fashioned into one or more of the edge flanges 560, 562. The user interface can be coupled to a timer; however, this is not required. When a timer is used, the timer enables the flow of electric current to the heating mat 518 for a predetermined period of time. As can be appreciated, other or additional control circuitry can be used to manually and/or automatically activate and/or deactivate the heating mat. Non-limiting examples of control circuitry that can be used is described above with regard to the embodiments of FIGS. 1-17.

Layers 514, 516 and the fasteners 504 can be constructed from any suitable material displaying the desired thermal and/or structural properties for such components. In one non-limiting arrangement, layers 514, 516 and fasteners 504 are primarily constructed from plastic. As illustrated in FIGS. 23 and 24, the portable warming device 500 has dimensions to enable the portable warming device to be connected to a conventional towel rack and enable a user to hang a towel 584 from the towel rack 570 so that a major portion 586, 588 of at least one side of towel 584 overlies and is in contact with and/or in close proximity with outer surface 515, 517 of the portable warming device 500.

The portable warming device 500 can include an aroma or scent generating arrangement to impart a desirable aroma to the towel and/or to release a desired aroma in the area about the portable warming device; however, this is not required. In one non-limiting arrangement, a volatile material (e.g., liquid, gel, solid, etc.) is used to release volatile substances (e.g., perfume, air fresheners, etc.) into the towel and/or in the atmosphere surrounding the portable warming device. The aroma or scent generating arrangement can be used independently and/or in conjunction with the heating arrangement of the portable warming device to cause controlled and/or uncontrolled release of the volatile substances.

The portable warming device 500 can include one or more blowers to facilitate in the warming or heating of the one or more towels, which one or more blowers are positioned in the inner compartment of the portable warming device; however, this is not required.

The heating mat configuration described in the embodiments discussed in regard to FIGS. 1-9 can be also or alternatively used in the portable warming device 500.

A non-limiting method for warming a towel by portable warming device 500 will now be discussed. The towel warming device is generally positioned in a location desired by the user so as to provide convenient access to the warmed or heated towel (e.g., towel rack). The portable warming device is secured to a towel rack by manipulating the fasteners 504 so that the fasteners are disposed around the tubular portion 572 of towel rack 570. Once the fasteners are positioned over the towel rack, the body engaging portions 528, 530 on the fasteners are fittingly engaged with the fastener engaging portions 524, 526 so that the body 502 of the portable warming device is suspended from the towel rack as illustrated in FIG. 23. If two portable warming devices are to be secured to the towel rack as illustrated in FIG. 24, the fasteners on the second portable warming device are also positioned over the towel rack and the body engaging portions of the fasteners are fittingly engaged with the fastener engaging portions so that the body of the second portable warming device is secured to the towel rack. After the one or more portable warming devices are secured to the towel rack, the user connects one end of a power cord 576 to a wall outlet 574 and the other end to electrical interface 506 on the body of the portable warming device. When two portable warming devices are secured to a towel rack, an electric connector is connected from electrical interface 506 on one portable warming device to electrical interface 508 on the other portable warming device so that both portable warming devices can receive current from wall outlet 574. The user warms or heats a towel by placing the towel over the towel rack in a manner that a portion 586 of the towel 584 is in contact with and/or in close proximity to one side of the portable warming device 500 and another portion 588 is in contact with and/or in close proximity to another side of the portable warming device. After the towel is positioned over the towel rack and portable warming device, the user suitably depresses the user interface 510 and/or slides the user interface in slot 530 to cause current to flow into the heating mat. The user can subsequently terminate flow to the heating mat by depressing the user interface 510 and/or sliding the user interface in slot 530 to cause current to stop flowing into the heating mat. Alternatively, user interface 510 can include or be associated with a timer that permits current flow to the heating mat for a predetermined period of time. When a timer is used, the timer can be automatically set to allow current to flow to the heating mat for a predetermined period of time, and/or the timer can be manually set by the user. If the timer can be manually set by the user, the user can set the timer for a period of time that the user believes he/she will be in the shower, bath, etc. After the user activates the portable warming device, the user then proceeds to take a shower, bath, etc. After the user exits the shower, bath etc., the user removes the warmed or heated towel from the portable warming device and dries oneself with the warmed towel. The heating mat can be designed to quickly warm or heat a towel after activation of the actuator switch; however, this is not required. As such, a user can still enjoy a warmed or heated towel even if the user takes a short shower, bath, etc. The heating mat can also be designed to retain a significant amount of heat after the flow of current has been discontinued to the heating mat so as to continue to warm or heat a towel after current has been terminated to the heating mat; however, this is not required. This design of the heating mat provides a warmed or heated towel to a user ever if the user takes an extended shower, bath, etc. which exceeded the time period that current was directed to the heating mat. After use of the portable warming device, the user can leave the portable warming device on the towel rack or remove the portable warming device from the towel rack and place the portable warming device in another location (e.g., linen closet, under a bathroom vanity, etc.).

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

We claim:

1. A portable textile warmer designed to dry heat warm a textile comprising:

a housing body having a bottom portion, a top portion, an inner shell, and a lid; said inner shell having an inner surface that at least partially forms a warming cavity; said warming cavity having a base wall and a side wall; said warming cavity having a volume to hold at least one standard bath towel; said lid positionable on said top portion of said housing; said lid movable between an open and a closed position wherein said lid in the closed position causing said one or more textiles in said warming cavity to be substantially encapsulated by said warming cavity; said lid in the open position enabling one or more textiles to be inserted or removed from said warming cavity; and, a heating arrangement designed to dry heat one or more textiles positioned in said warming cavity; said heating arrangement including a resistive heating element, a heating controller, a current connector, and an activation switch; said resistive heating element positioned on an outer surface of said inner shell and about said side wall of said warming cavity, in close proximity to said outer surface of said inner shell and about said side wall of said warming cavity, or combinations thereof; said resistive heating element designed to heat said inner surface of said inner shell; said current connector designed to connect to a current source to provide current to said resistive heating element; said heating controller terminating a flow of current to said resistive heating element once a predetermined period of time has passed since said activation switch has been actuated by a user, after a temperature sensor senses a predetermined temperature after a user has actuated said activation switch, or combinations thereof.

2. The portable textile warmer as defined in claim 1, wherein an outer surface of said resistive heating element includes an electrically insulating material.

3. The portable textile warmer as defined in claim 2, wherein said electrically insulating material includes silicone.

4. The portable textile warmer as defined in claim 1, wherein said resistive heating element is at least partially positioned adjacent to a protective heat conducting material, said protective heat conducting material positioned on an outer surface of said inner shell, in close proximity to said outer surface of said inner shell, or combinations thereof.

5. The portable textile warmer as defined in claim 4, wherein said resistive heating element is at least partially positioned between two layers of said protective heat conducting material.

6. The portable textile warmer as defined in claim 1, wherein said heating controller includes a thermostat, a thermal fuse, or combinations thereof.

7. The portable textile warmer as defined in claim 1, wherein said lid is rotatably connected to said top portion of said housing.

8. The portable textile warmer as defined in claim 1, wherein said lid includes a transparent material, a semi-transparent material, or combinations thereof.

9. The portable textile warmer as defined in claim 1, including a lid counterbalance, said lid counterbalance facilitating in maintaining said lid in a closed position, facilitating maintaining said lid in an open position, or combinations thereof.

10. The portable textile warmer as defined in claim 1, wherein said lid includes a lid closure mechanism to maintain said lid in a closed position.

11. The portable textile warmer as defined in claim 1, wherein said heating arrangement includes a lid open detector terminates current to said resistive heating element when said lid is in a non-closed position.

12. The portable textile warmer as defined in claim 1, including an aroma generating device.

13. The portable textile warmer as defined in claim 1, including at least one blower.

14. The portable textile warmer as defined in claim 1, wherein said heating arrangement includes at least one visual indicator to indicate when current is flowing through said resistive heating element.

15. The portable textile warmer as defined in claim 1, wherein said bottom of said warming cavity includes at least one drain opening to enable fluid to drain out from said warming cavity.

16. The portable textile warmer as defined in claim 1, wherein said current connector includes an electric power cord and a wall outlet connector.

17. The portable textile warmer as defined in claim 1, wherein said heating arrangement has a single heating cycle after being activated by said activation switch.

18. The portable textile warmer as defined in claim 1, wherein said heating controller terminates a flow of current to said resistive heating element after said temperature sensor senses a predetermined temperature.

19. The portable textile warmer as defined in claim 1, wherein said activation switch is positioned on said top portion of said body housing, said activation switch including a depressible switch.

20. The portable textile warmer as defined in claim 1, wherein said heating controller includes an arrangement to enable a user to adjust a time of heating, a heating temperature, or combinations thereof.

21. A portable towel warmer designed to dry heat at least one towel comprising:

a body having a bottom housing, a top housing, an inner shell, an outer shell and a single lid; said inner shell having an inner surface that at least partially forms a warming cavity; said body having a total volume of less than about 8000 cubic inches; said warming cavity including a base wall and at least one side wall formed by said inner surface of said inner shell; said warming cavity having a volume to hold at least one standard bath towel and up to two standard bath towels; said lid pivotly connected on said top housing; said lid movable between an open and a closed position wherein said lid in the closed position causing the at least one towel in said warming cavity to be substantially encapsulated by said warming cavity; said lid in the open position enabling the at least one towel to be inserted or removed from said warming cavity; said bottom of said inner shell including at least one drain opening to enable fluid to drain out from said warming cavity; and, a heating arrangement at least partially positioned in said housing and designed to dry heat the at least one towel positioned in said warming cavity; said heating arrangement including a heating mat, a heating controller, a current connector, a visual indicator, and an activation switch; said heating arrangement designed to generate at least about 100 watts of energy and no more than about 1500 watts of energy and to heat said warming cavity to a temperature of at least about 105° F. and no more than about 330° F.; a majority of said heating mat positioned between said inner and outer shell of said body; a majority of said heating mat positioned on an outer surface of said inner shell and about said side wall of said warming cavity, in close proximity to said outer surface of said inner shell and about said side wall of said warming cavity, or combinations thereof; said current connector designed to connect to a current source to provide current to said heating mat; said visual indicator including an indicator to show when current is flowing through said heating mat; said current connector including an electric power cord and a wall outlet connector; said heating controller terminating a flow of current to said heating mat once a predetermined period of time has passed since said activation switch has been actuated by a user, after a temperature sensor senses a predetermined temperature after a user has actuated said activation switch, or combinations thereof; said body and said heating arrangement having a total weight of no more than about 30 pounds.

22. The portable towel warmer as defined in claim 21, wherein said heating mat includes a first and second heating conducting protective layers and a resistive heating element positioned between said first and second heating conducting protective layers, said resistive heating element at least partially covered by an electrical insulating material.

23. The portable towel warmer as defined in claim 21, wherein said heating mat is at least partially adhesively secured to said outer surface of said inner shell.

24. The portable towel warmer as defined in claim 21, wherein said heating mat is spaced a farther distance from said outer shell than from said inner shell.

25. The portable towel warmer as defined in claim 24, wherein said heating mat is positioned at least about 80% of said outer surface of said inner shell.

26. The portable towel warmer as defined in claim 21, wherein said heating controller terminates a flow of current to said heating mat after a temperature sensor senses a predetermined temperature.

27. The portable towel warmer as defined in claim 22, wherein said electrically insulating material includes silicone.

28. The portable towel warmer as defined in claim 21, wherein said heating controller includes a thermostat, a thermal fuse, or combinations thereof.

29. The portable towel warmer as defined in claim 21, including a lid counterbalance, said lid counterbalance facilitating in maintaining said lid in said closed position, facilitating in maintaining said lid in said open position, or combinations thereof.

30. The portable towel warmer as defined in claim 21, wherein said lid includes a lid closure mechanism to maintain said lid in said closed position.

31. The portable towel warmer as defined in claim 21, wherein said heating arrangement includes a lid open detector to terminate current to said heating mat when said lid is in a non-closed position.

32. The portable towel warmer as defined in claim 21, including an aroma generating device.

33. The portable towel warmer as defined in claim 21, including at least one blower.

34. The portable towel warmer as defined in claim 21, wherein said heating arrangement has a single heating cycle after being activated by said activation switch.

35. The portable towel warmer as defined in claim 21, wherein said heating controller terminates a flow of current to said resistive heating element after a predetermined amount of time of current flow to said resistive heating element.

36. The portable towel warmer as defined in claim 21, wherein said activation switch is positioned on said top housing, said activation switch including a depressible switch.

37. The portable towel warmer as defined in claim 21, wherein said heating controller includes an arrangement to enable a user to adjust a time of heating, a heating temperature, or combinations thereof.

38. The portable towel warmer as defined in claim 21, wherein said bottom housing includes a top surface having an arcuate shape, said top surface defining at least a portion of said warming cavity.

39. The portable towel warmer as defined in claim 21, wherein said visual indicator includes a plurality of indicators, said plurality of indicators including at least two indicators designed to indicate that said heating arrangement is connected to a power source, indicating that said heating mat is heating, indicating that said heating mat is cooling, indicating that the at least one towel in said warming cavity is properly heated, indicating when said lid is not properly closed, indicating when at least one component of said heating arrangement is not properly working, indicating when a towel can or should be inserted in said warming cavity, illuminating at least one control on said body, illuminating at least one display on said body, indicating that said heating controller has been activated, indicating that said heating controller has been deactivated, indicating that said lid was not opened after completion of a heating cycle of said heating mat, indicating a temperature in said warming cavity, indicating an ambient temperature, indicating a current time, indicating a time the at least one towel has been heated in said warming cavity, or combinations thereof.

40. The portable towel warmer as defined in claim 21, wherein said heating arrangement includes a programmable interface designed to receive user-generated instructions for at least one feature of said portable heating device.

41. The portable textile warmer as defined in claim 14, wherein said heating arrangement includes a plurality of visual indicators.

42. The portable textile warmer as defined in claim 41, wherein at least two of said visual indicators are selected from the group of indicators that indicate that said heating arrangement is connected to a power source, said heating mat is heating, said heating mat is cooling, at least one towel in said warming cavity is properly heated, said lid is not properly closed, at least one component of said heating arrangement is not properly working, a towel can or should be inserted in said warming cavity, illuminates at least one control on said body, illuminates at least one display on said body, said heating controller has been activated, said heating controller has been deactivated, said lid was not opened after completion of a heating cycle of said heating mat, a temperature in said warming cavity, an ambient temperature, a current time, a time the at least one towel has been heated in said warming cavity, or combinations thereof.

43. A portable towel warmer designed to dry heat at least one towel comprising:

a body having a bottom housing, a top housing, an inner shell, an outer shell and a single lid; said inner shell having an inner surface that at least partially forms a warming cavity; said body having a total volume of less than about 8000 cubic inches; said warming cavity including a base wall and at least one side wall formed by said inner surface of said inner shell; said warming cavity having a total volume of at least about 175 cubic inches; said single lid pivotally connected on said top housing; said lid movable between an open and a closed position wherein said lid in the closed position causing the at least one towel in said warming cavity to be substantially encapsulated by said warming cavity; said lid in the open position enabling the at least one towel to be inserted or removed from said warming cavity; a bottom of said inner shell including at least one drain opening to enable fluid to drain out from said warming cavity and out of said body; said bottom housing including a non-slick surface to inhibit or prevent said bottom housing from slipping or inadvertently moving on a surface; and, a heating arrangement at least partially positioned in said housing and designed to dry heat the at least one towel positioned in said warming cavity without use of a fan or blower; said heating arrangement including a heating mat, a heating controller, a current connector, a plurality of visual indicators, and an activation switch; said heating arrangement designed to generate at least about 100 watts of energy and no more than about 1500 watts of energy and to heat said warming cavity to a temperature of at least about 105° F. and no more than about 330° F.; a majority of said heating mat positioned between said inner and outer shell of said body; said heating mat is positioned about said side wall of said warming cavity and at least about 80% of said outer surface of said inner shell; said current connector designed to connect to a current source to provide current to said heating mat; at least one of said visual indicators including an indicators to indicate when current is flowing through said heating mat; said activation switch is positioned on said top housing; said activation switch including a user depressible switch; said body and said heating arrangement having a total weight of no more than about 30 pounds.

44. The portable towel warmer as defined in claim 43, wherein said heating mat includes a first and second heating conducting protective layer and a resistive heating element positioned between said first and second heating conducting protective layer, said resistive heating element at least partially covered by an electrical insulating material, said heating mat is spaced a farther distance from said outer shell than from said inner shell.

45. The portable towel warmer as defined in claim 44, wherein said heating controller terminates a flow of current to said heating mat after a temperature sensor senses a predetermined temperature, said heating controller includes a thermostat, a thermal fuse, or combinations thereof.

46. The portable towel warmer as defined in claim 45, wherein at least one of said visual indicators is positioned on said top housing and adjacent said actuator switch.

47. The portable towel warmer as defined in claim 46, wherein said heating mat is spaced a farther distance from said outer shell than from said inner shell.

48. The portable towel warmer as defined in claim 47, wherein said body and said heating arrangement having a total weight of about 7-8 pounds, said body having total volume of about 605-1183 cubic inches.

49. The portable towel warmer as defined in claim 48, wherein said heating arrangement has a single heating cycle after being activated by said activation switch.

50. The portable towel warmer as defined in claim 49, wherein at least one of said visual indicators includes an indicator to indicate when a towel can or should be inserted in said warming cavity.

51. The portable towel warmer as defined in claim 50, wherein said heating controller terminates a flow of current to said resistive heating element after a predetermined amount of time of current flow to said resistive heating element.

* * * * *